US007080422B2

(12) United States Patent
Ben-Levi

(10) Patent No.: US 7,080,422 B2
(45) Date of Patent: Jul. 25, 2006

(54) AUTOMATIC PATIENT TURNER

(76) Inventor: Michael Ben-Levi, 104 S. Hayworth Ave., #202, Los Angeles, CA (US) 90048

( * ) Notice: Subject to any disclaimer, the term of this patent is extended or adjusted under 35 U.S.C. 154(b) by 0 days.

(21) Appl. No.: 11/348,719

(22) Filed: Feb. 6, 2006

(65) Prior Publication Data

US 2006/0123552 A1 Jun. 15, 2006

Related U.S. Application Data

(63) Continuation-in-part of application No. 11/075,259, filed on Mar. 8, 2005, now abandoned, which is a continuation-in-part of application No. 10/165,703, filed on Jun. 8, 2002, now abandoned.

(51) Int. Cl.
*A61G 7/057* (2006.01)
*A61G 7/015* (2006.01)

(52) U.S. Cl. ..... 5/715; 5/615

(58) Field of Classification Search ..... 5/715, 5/710, 607, 615, 713, 714
See application file for complete search history.

(56) References Cited

U.S. PATENT DOCUMENTS 3,717,885 A * 2/1973 De Mare ..... 5/607
3,775,781 A * 12/1973 Bruno et al. ..... 5/607
3,895,403 A * 7/1975 Davis ..... 5/81.1 T
4,527,298 A * 7/1985 Moulton ..... 5/615
4,934,002 A * 6/1990 Watanabe ..... 5/607
5,092,007 A * 3/1992 Hasty ..... 5/715
5,103,519 A * 4/1992 Hasty ..... 5/715
5,121,512 A * 6/1992 Kaufmann ..... 5/713
5,142,720 A * 9/1992 Kelso et al. ..... 5/630
5,781,949 A * 7/1998 Weismiller et al. ..... 5/715
5,966,762 A * 10/1999 Wu ..... 5/710
5,966,763 A * 10/1999 Thomas et al. ..... 5/715
6,119,292 A * 9/2000 Haas ..... 5/715
6,154,900 A * 12/2000 Shaw ..... 5/81.1 R
6,253,402 B1 * 7/2001 Lin ..... 5/713

* cited by examiner

*Primary Examiner*—Alexander Grosz

(57) ABSTRACT

The Automatic Patient Turner is the ultimate in pressure sore prevention by automatically, periodically, and alternately tilting, and then laterally turning an immobile patient from one complete side to the other in a manner similar to, yet gentler and less intrusive than, manual turning, due to the patterned, sequential inflation and deflation of strategically placed inflatables. When the bent knees are perpendicular, being sandwiched between a pair of knee inflatables, they serve as a lever arm in the turning process when pressure is exerted against them by inflated inflatables. This causes the bent knees to move well beyond their perpendicular position in the direction of the turn. With the deflation of the knee inflatables, the bent knees descend laterally pulling the entire body of the patient completely to one side as a back-support pillow inflates, where the patient will lie upon a flat mattress until turned to the other side.

5 Claims, 44 Drawing Sheets

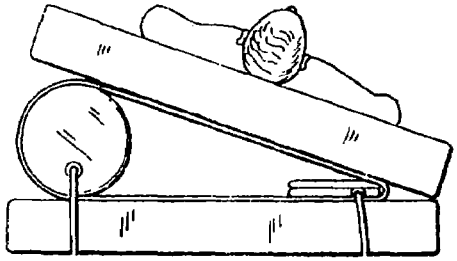
Fig. 1-A (Prior Art)
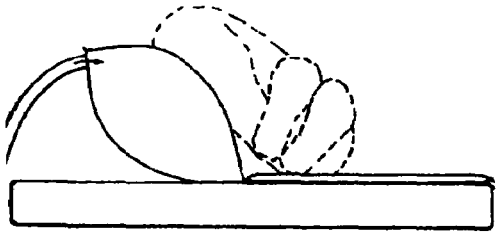
Fig. 1-B (Prior Art)
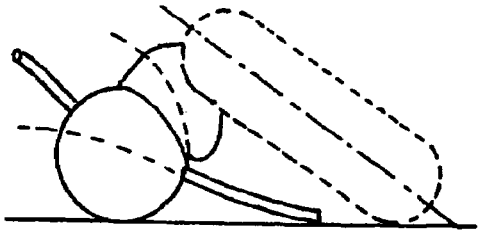
Fig. 1-C (Prior Art)
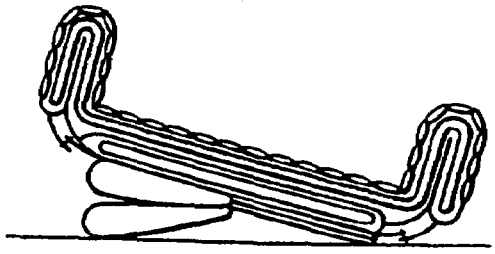
Fig. 1-D (Prior Art)
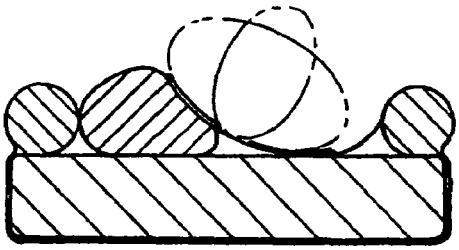
Fig. 1-E (Prior Art)
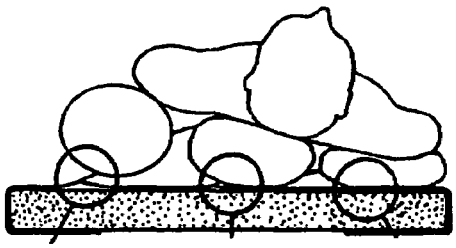
Fig. 1-F (Prior Art)
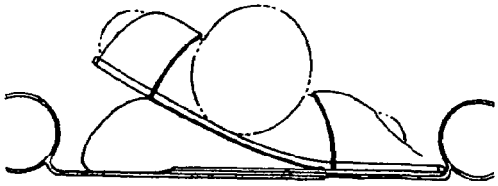
Fig. 1-G (Prior Art)
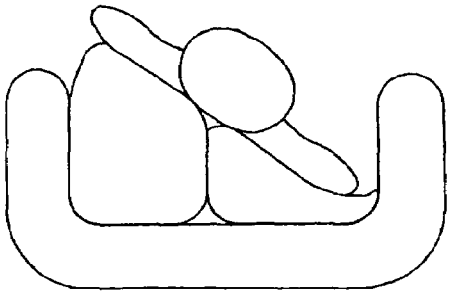
Fig. 1-H (Prior Art)

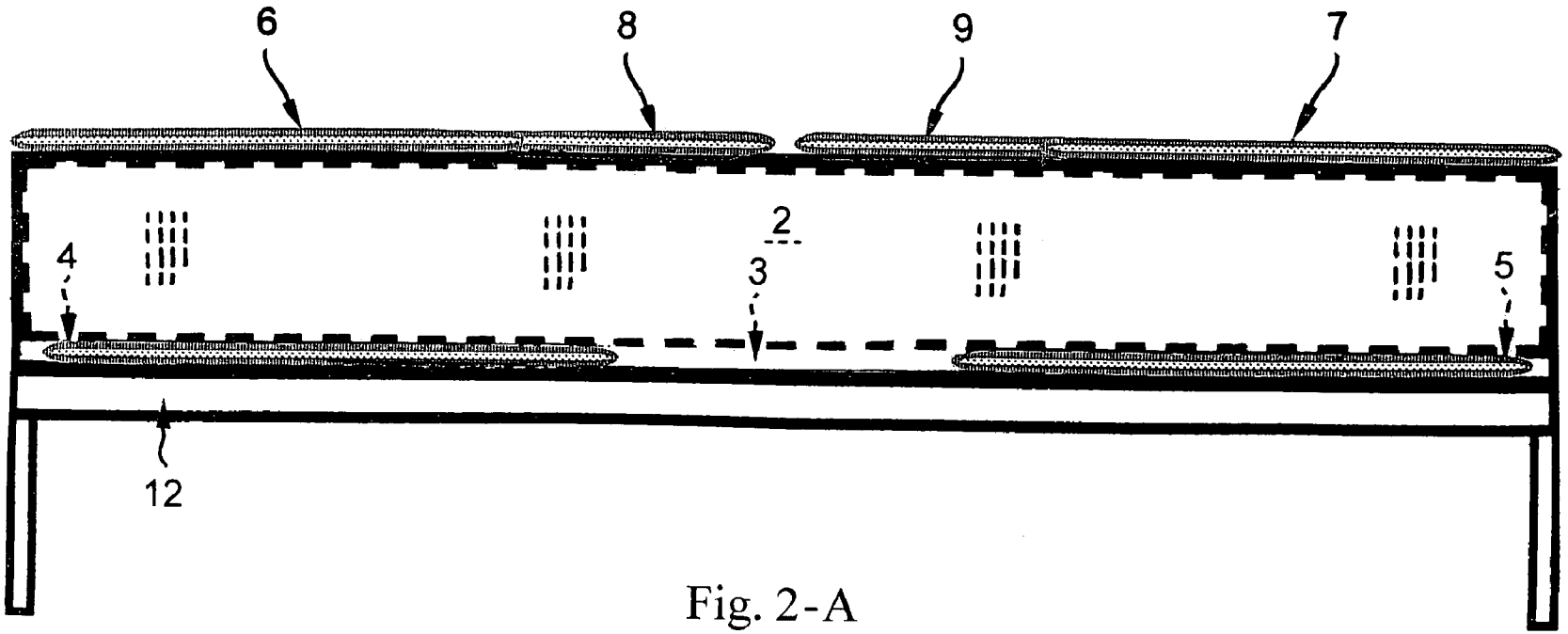
Fig. 2-A

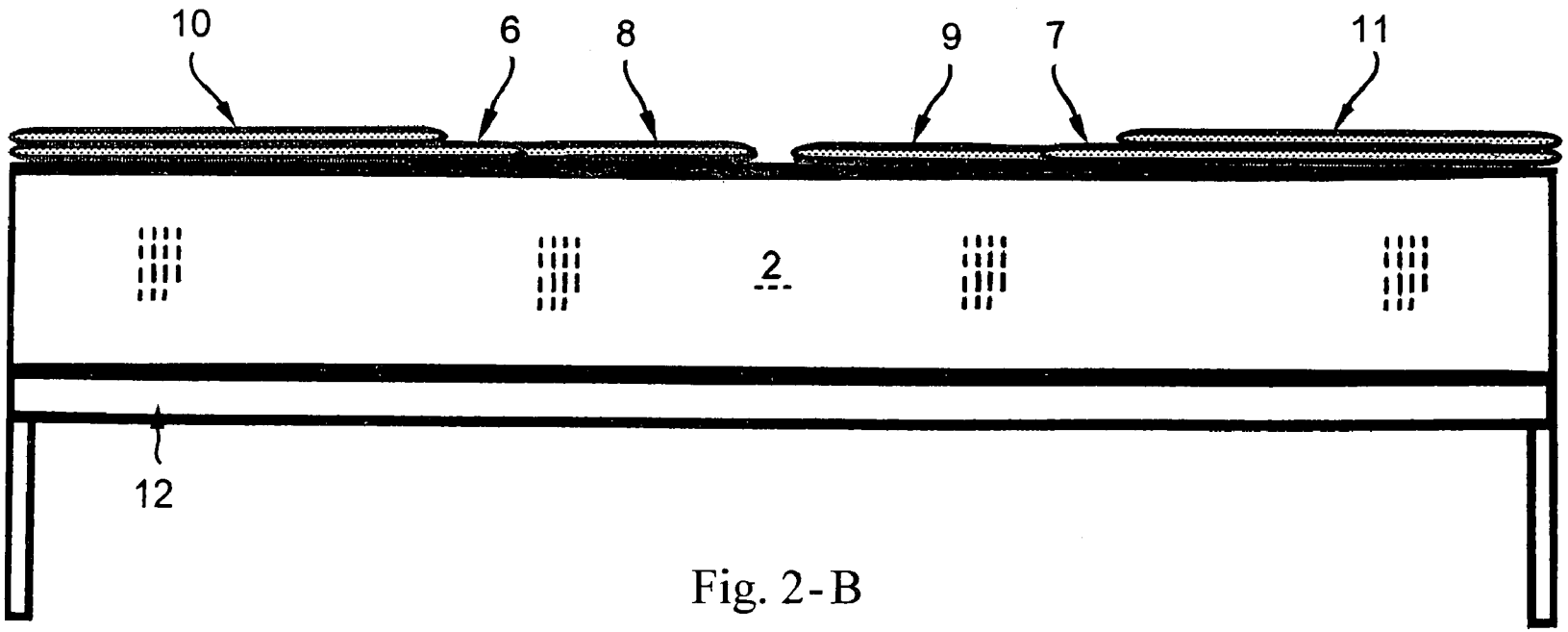
Fig. 2-B

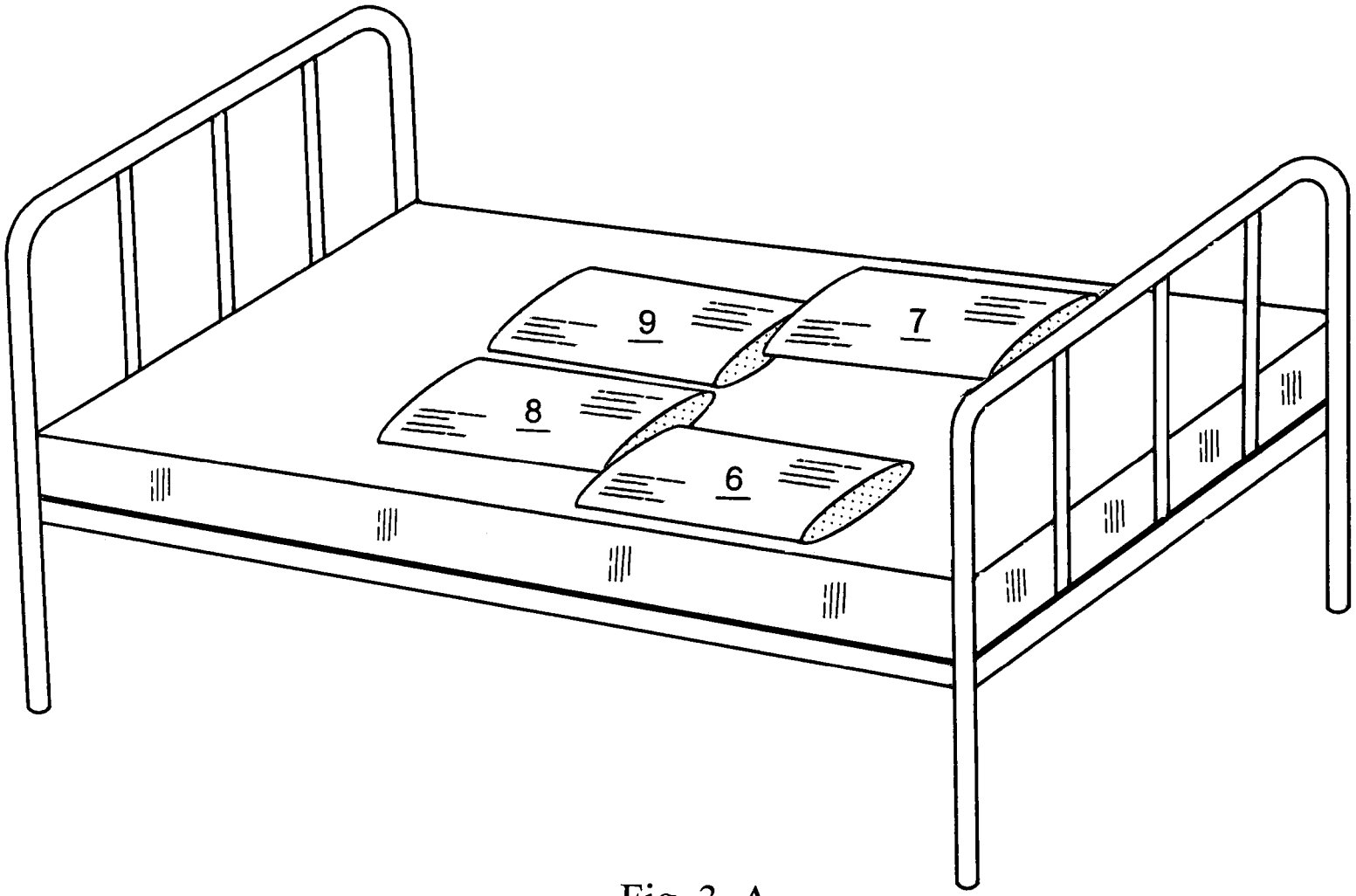
Fig. 3-A

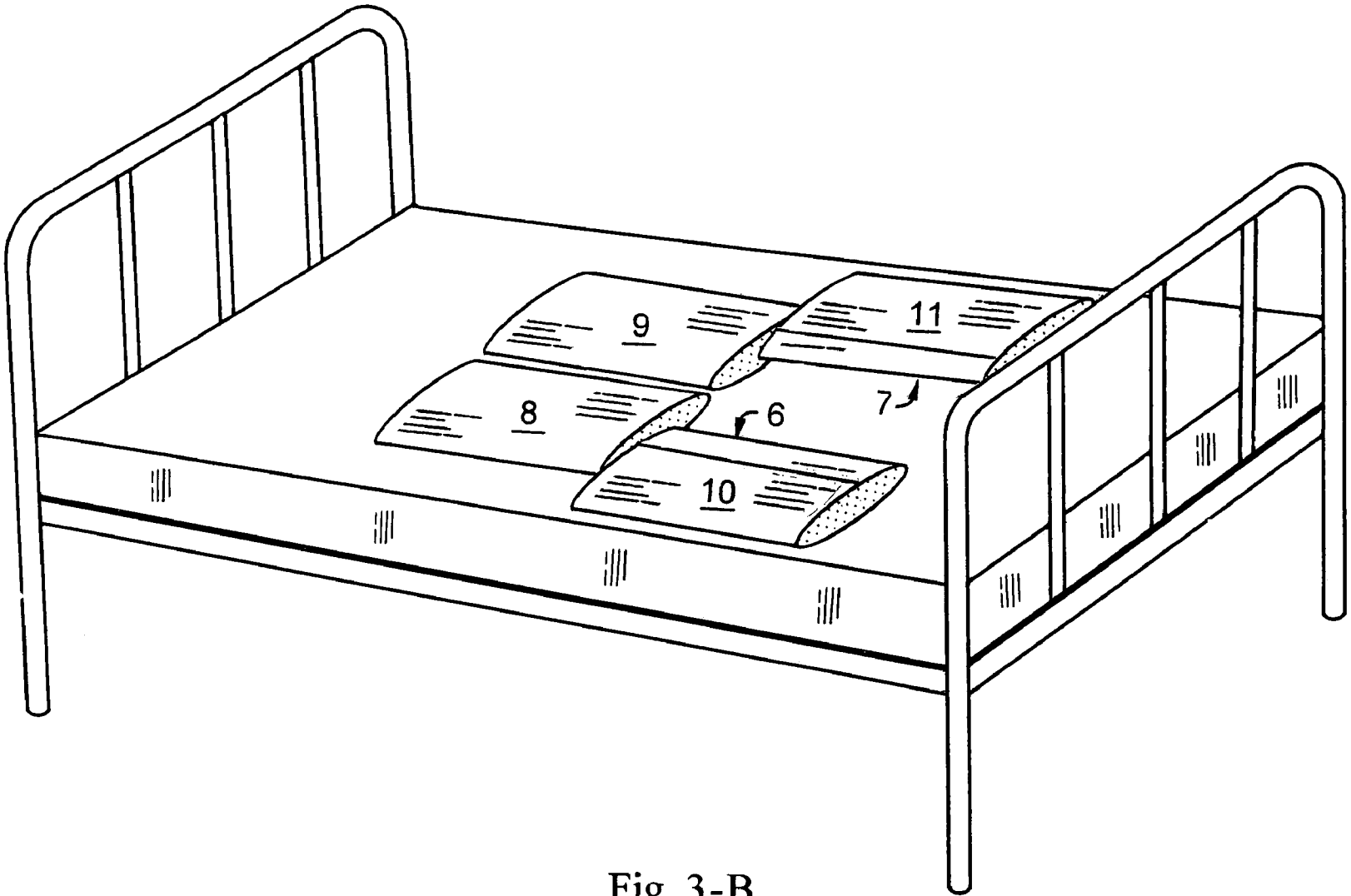
Fig. 3-B

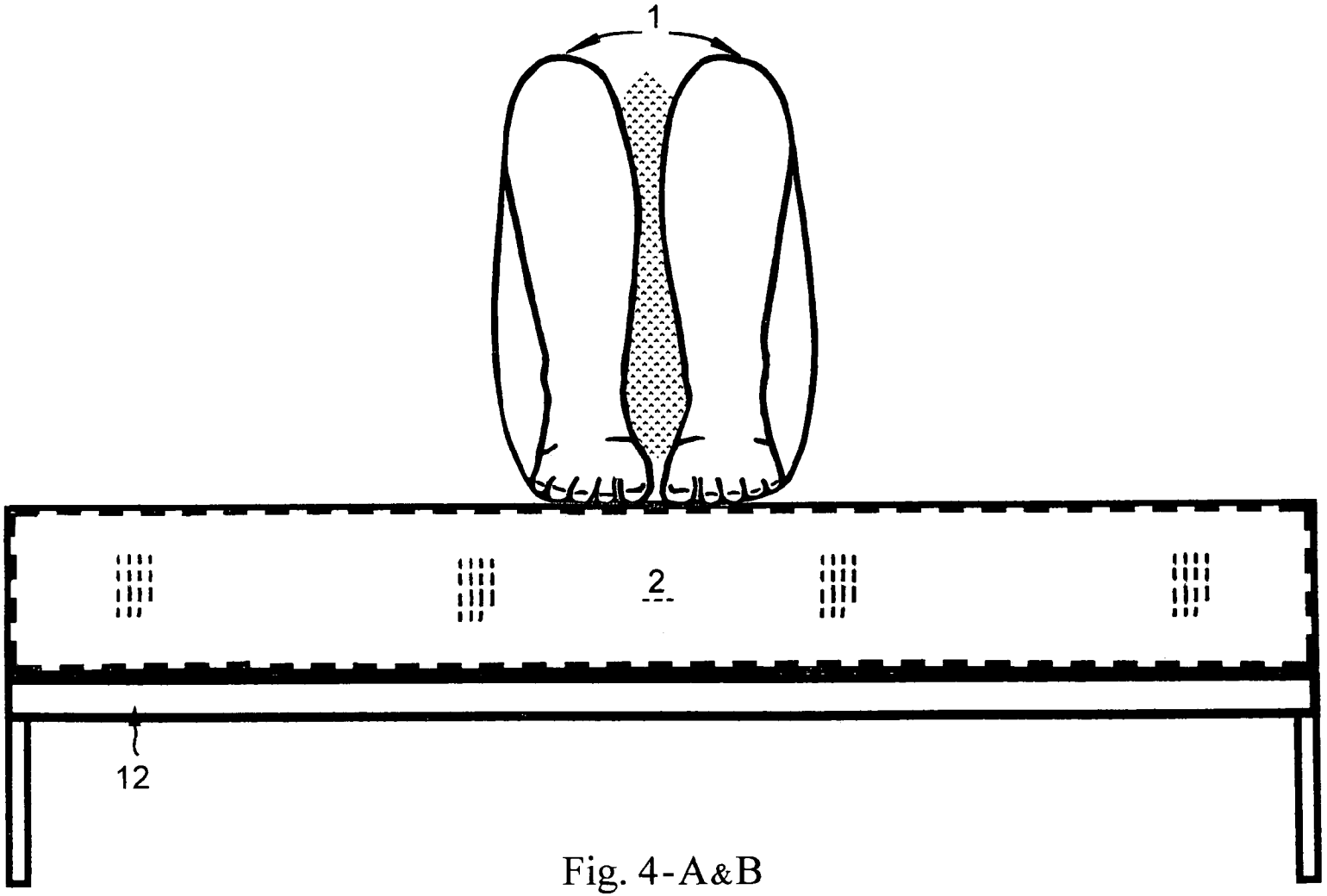
Fig. 4-A&B

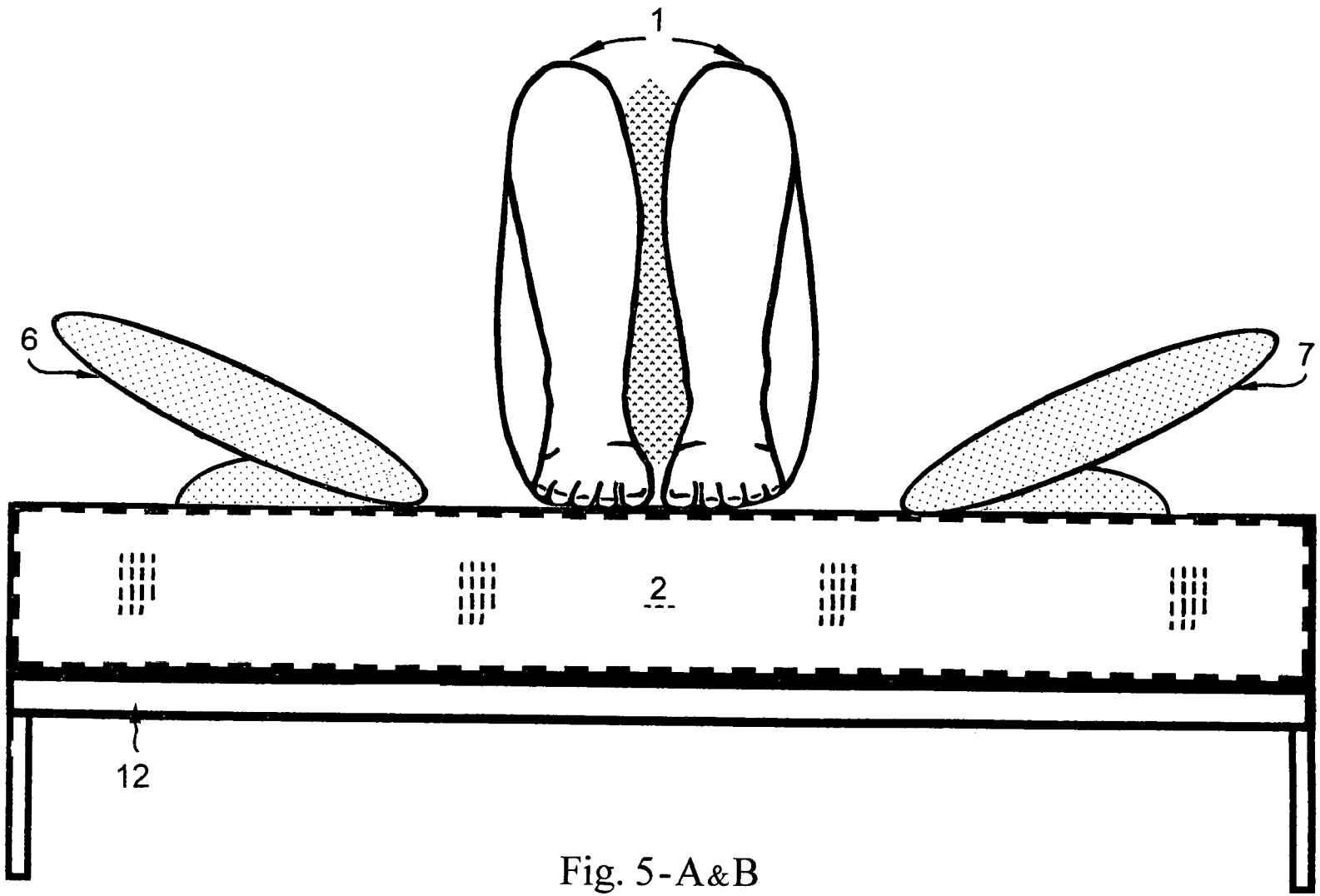
Fig. 5-A&B

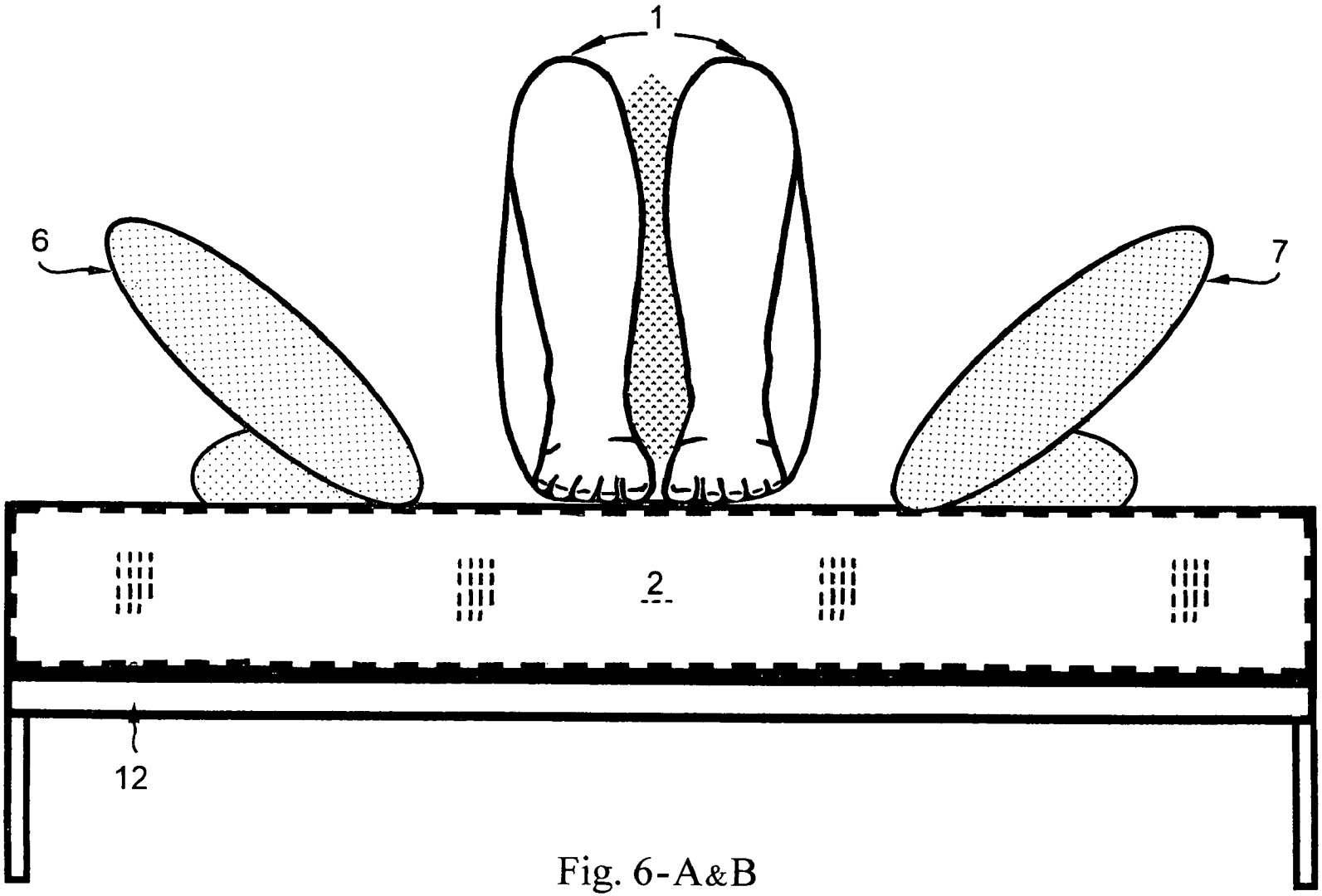
Fig. 6-A&B

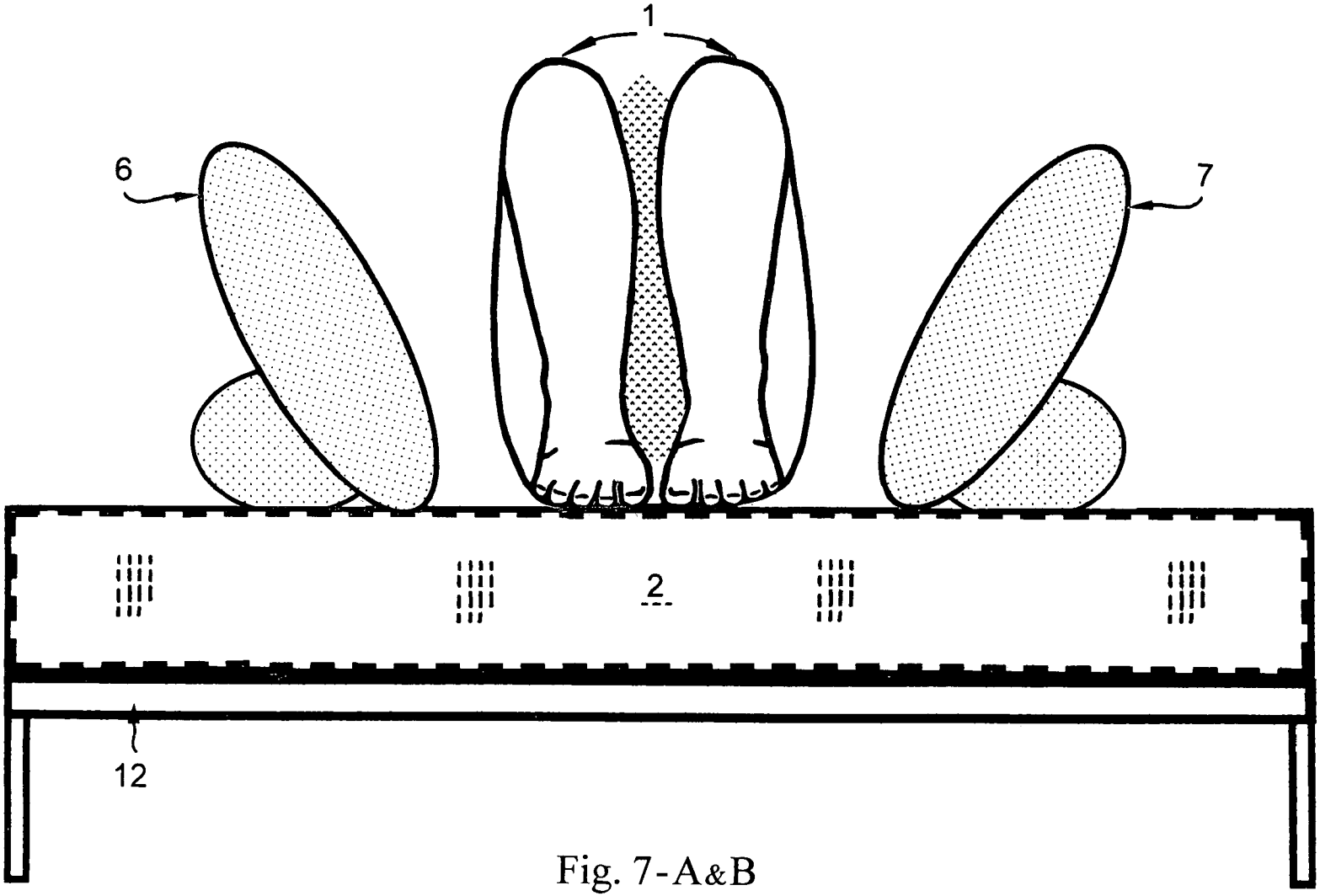
Fig. 7-A&B

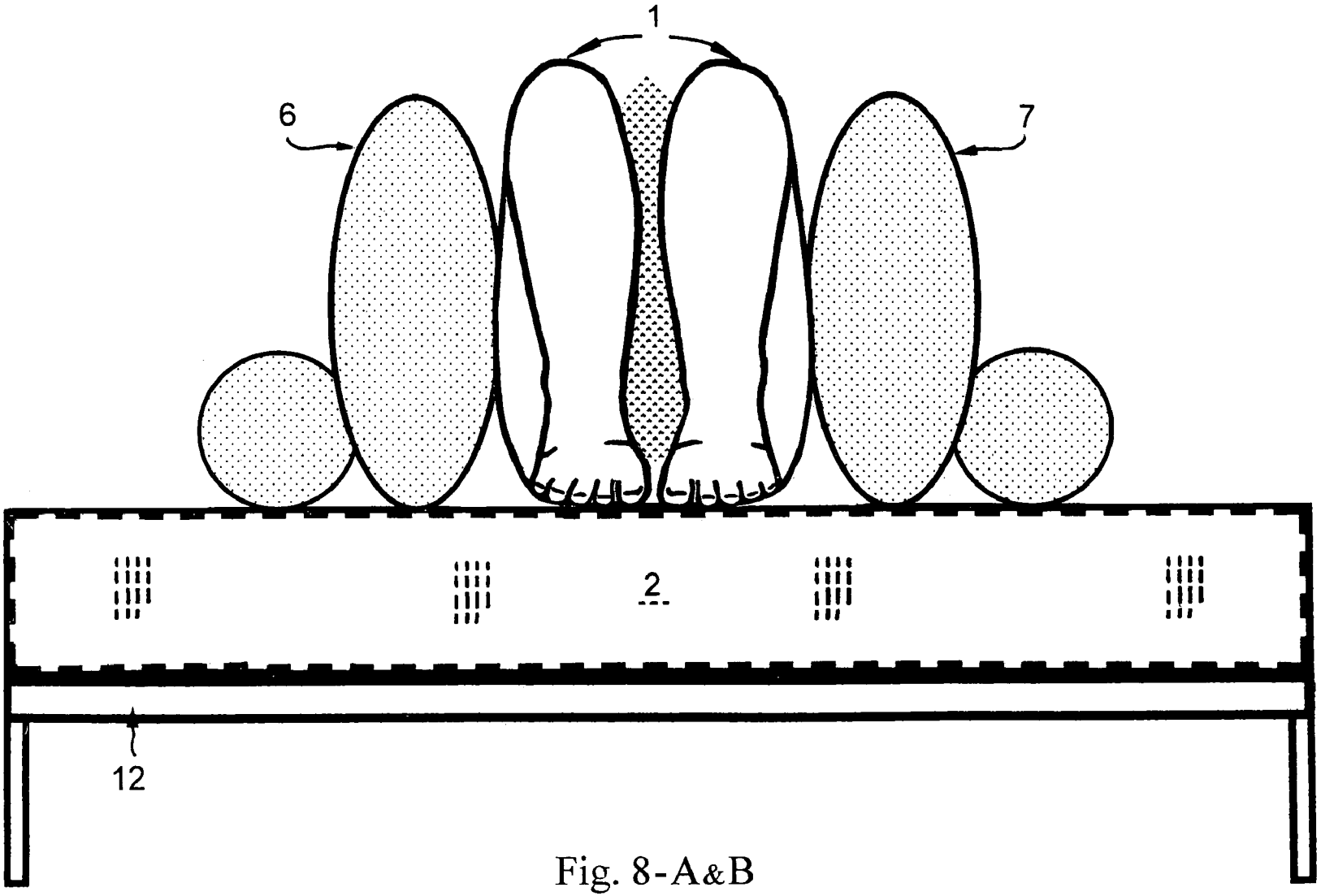
Fig. 8-A&B

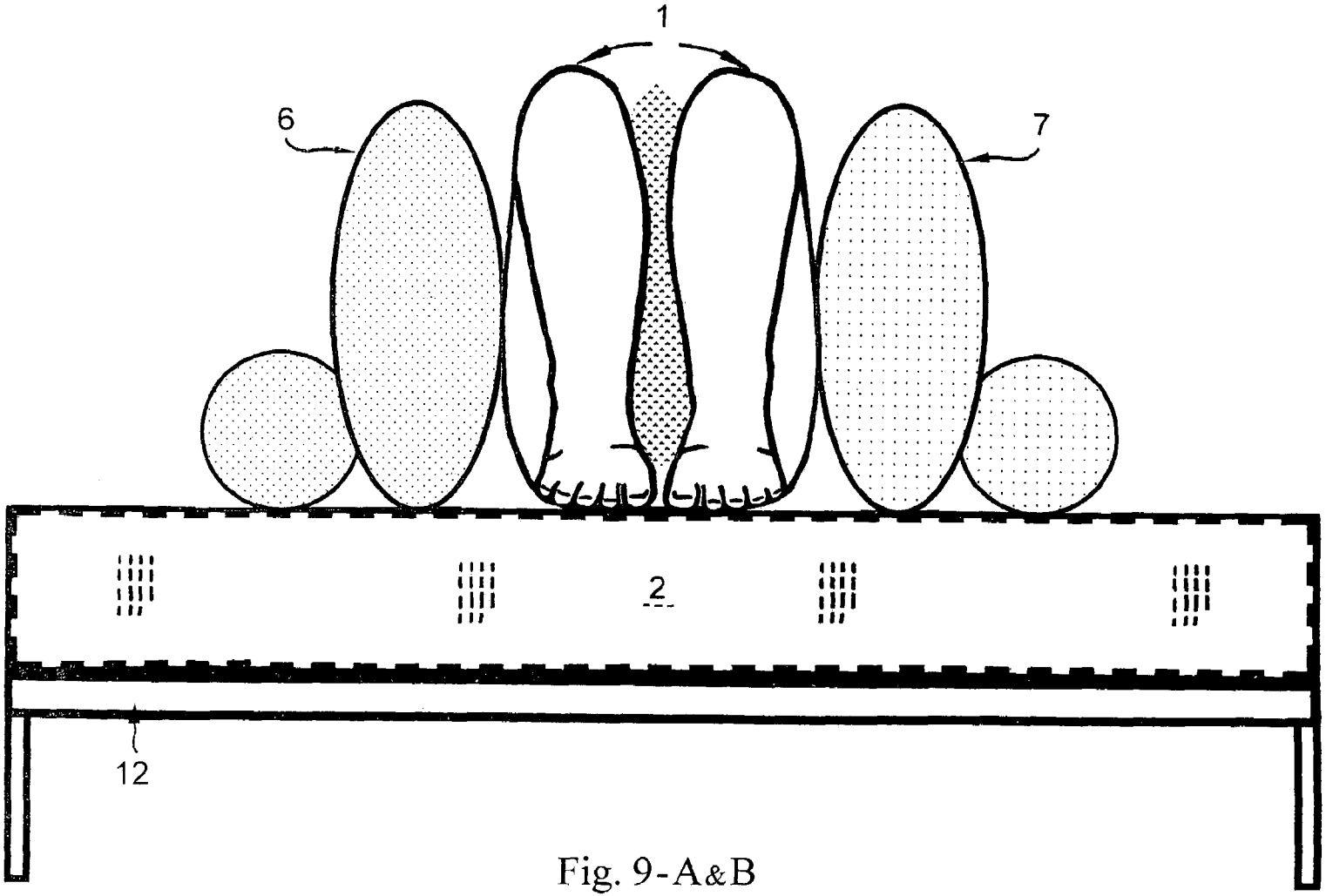
Fig. 9-A&B

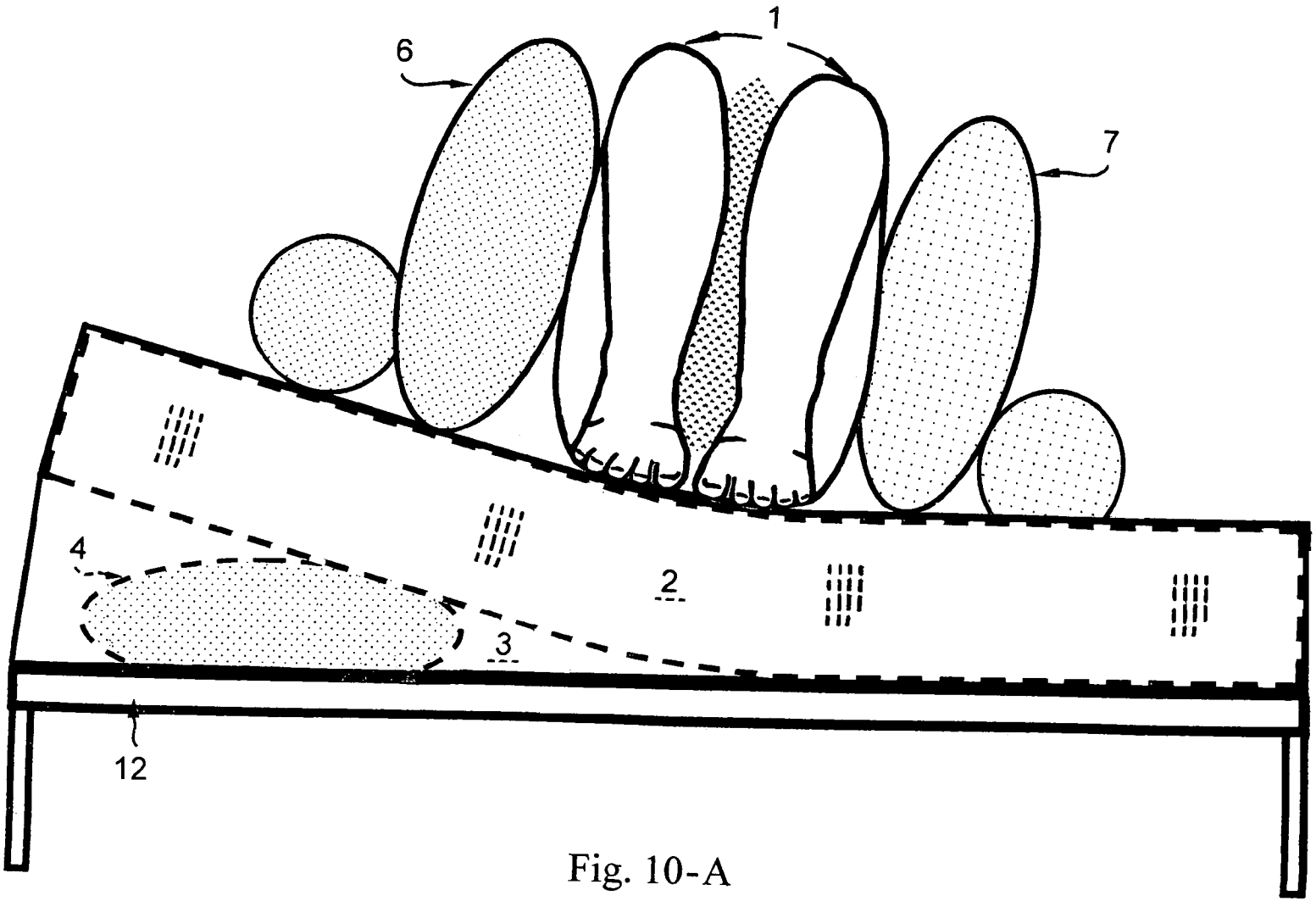
Fig. 10-A

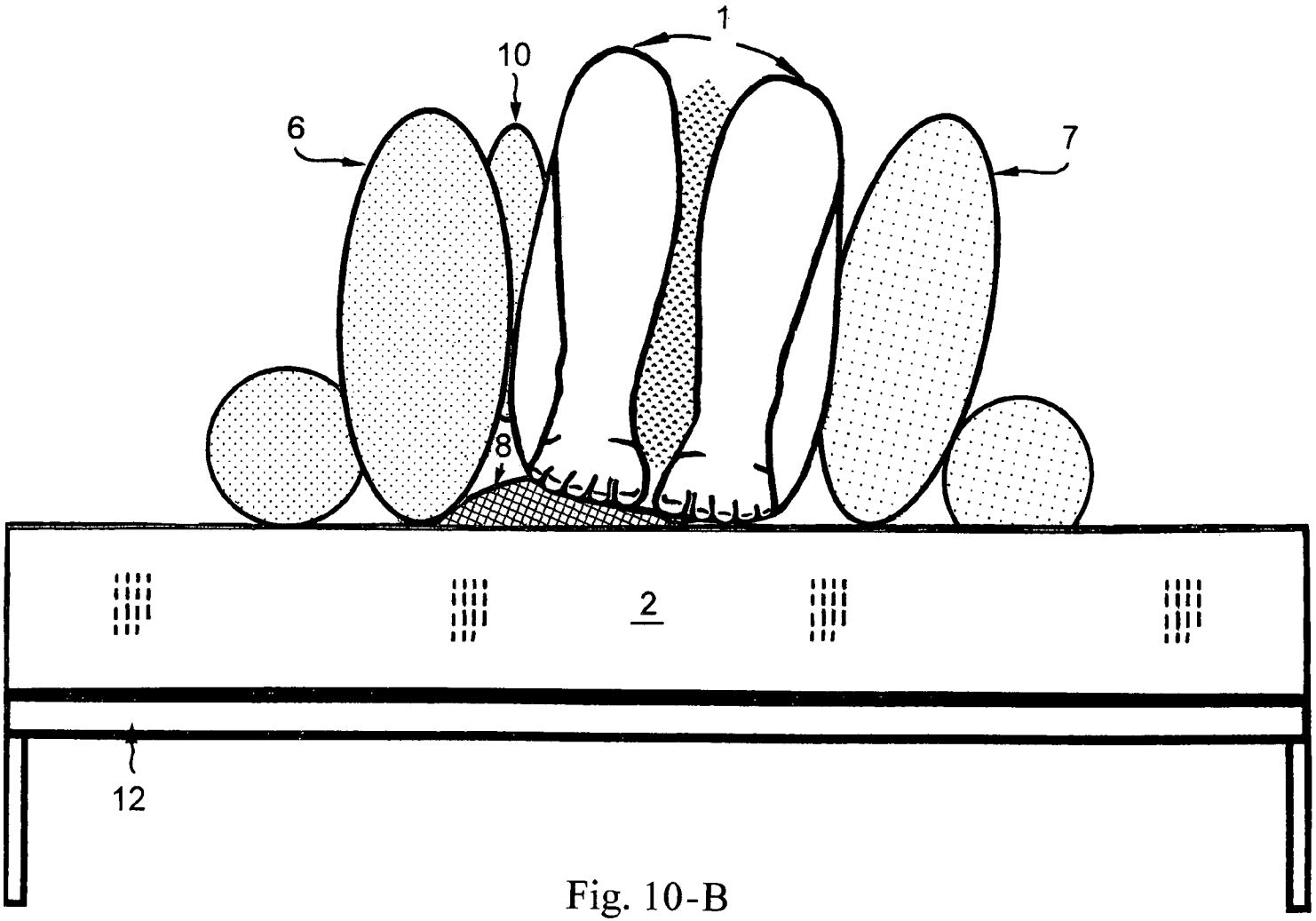
Fig. 10-B

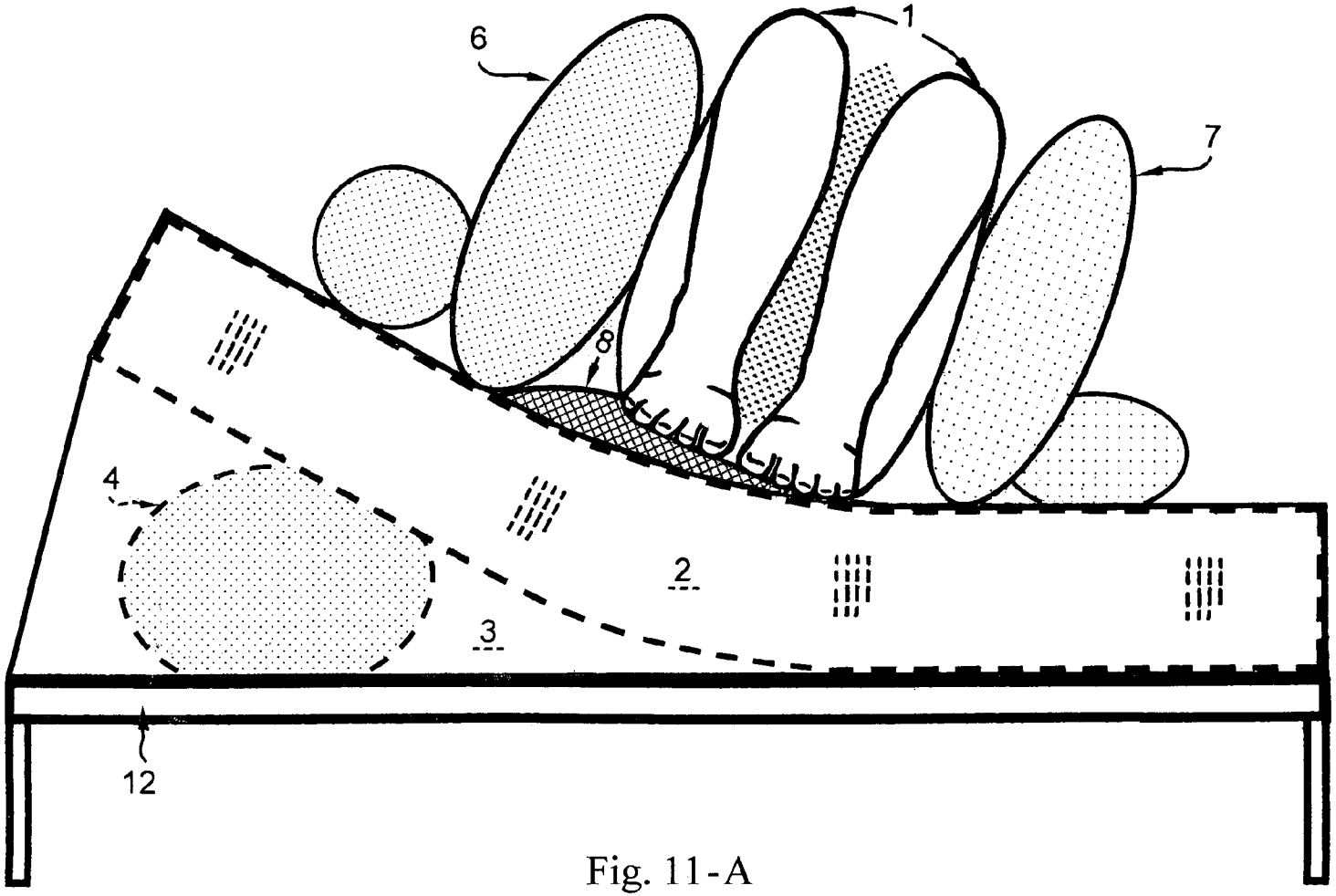
Fig. 11-A

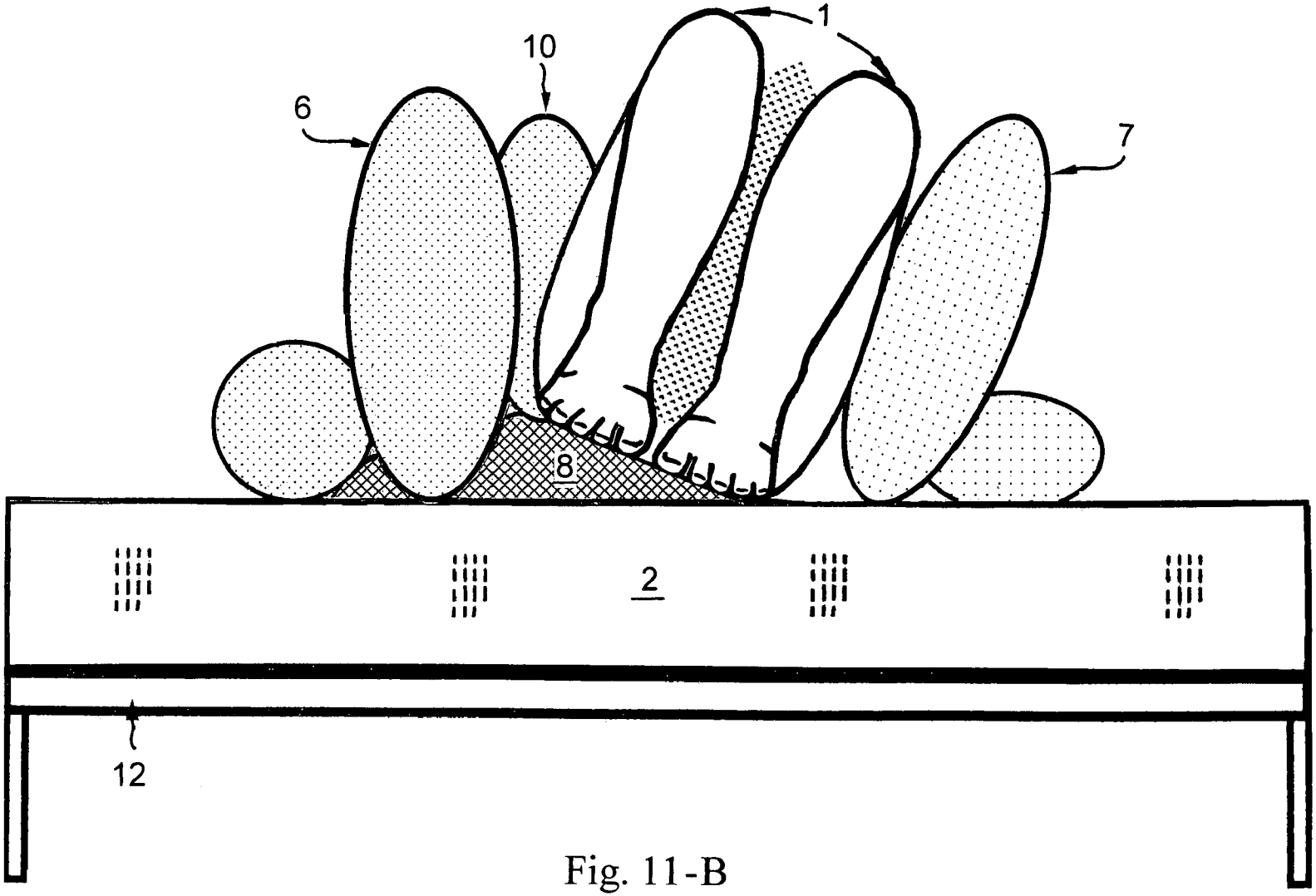
Fig. 11-B

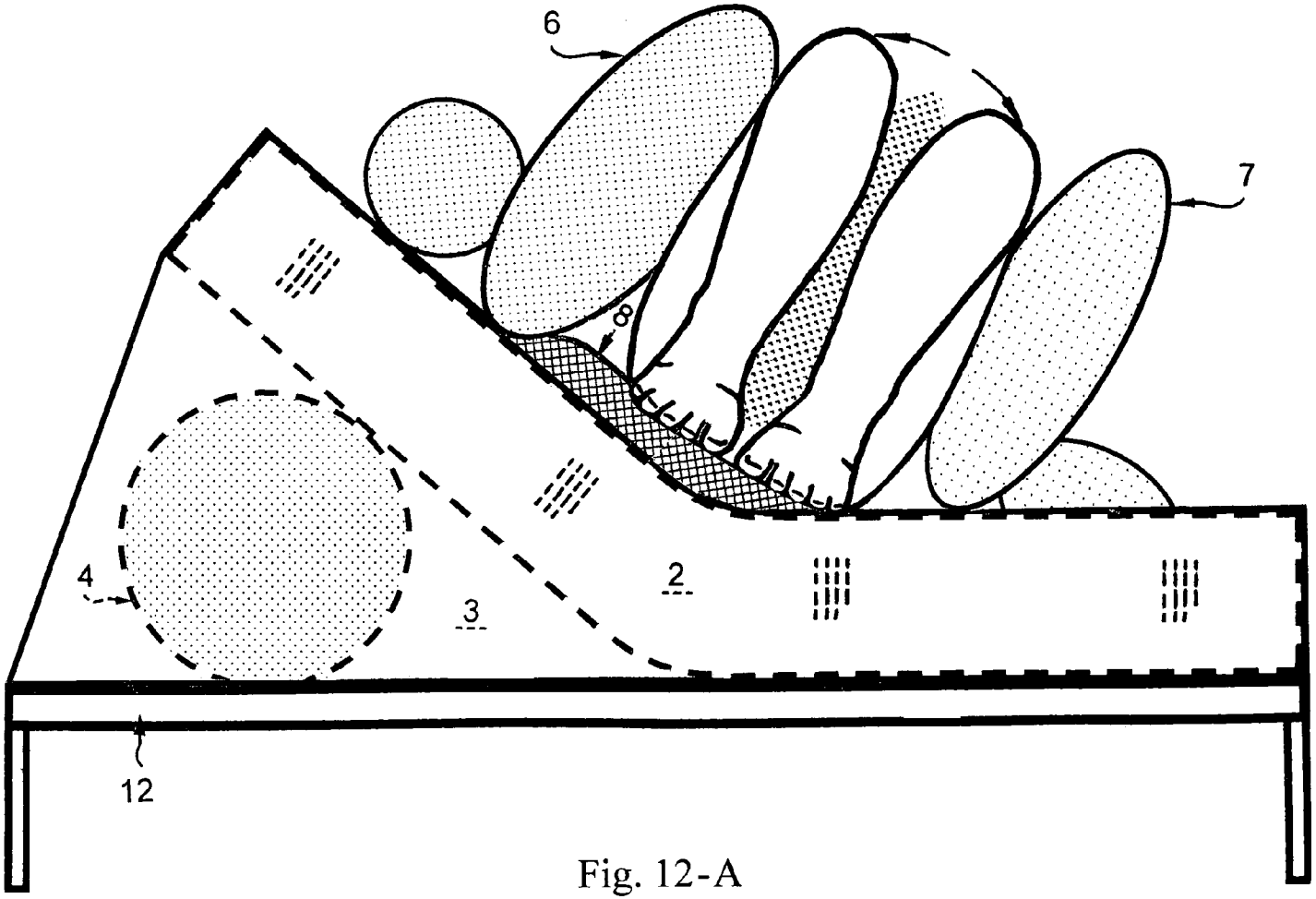
Fig. 12-A

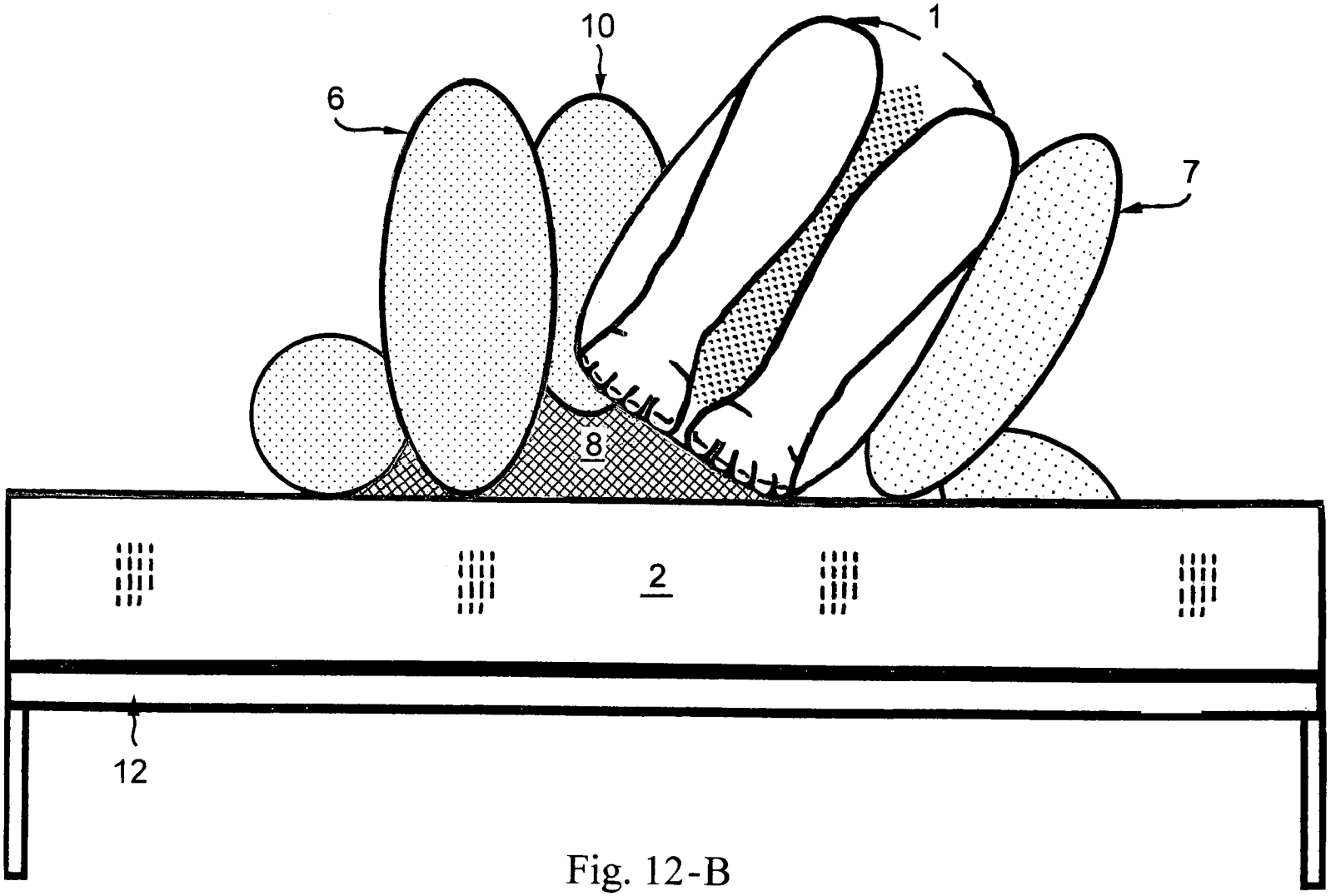
Fig. 12-B

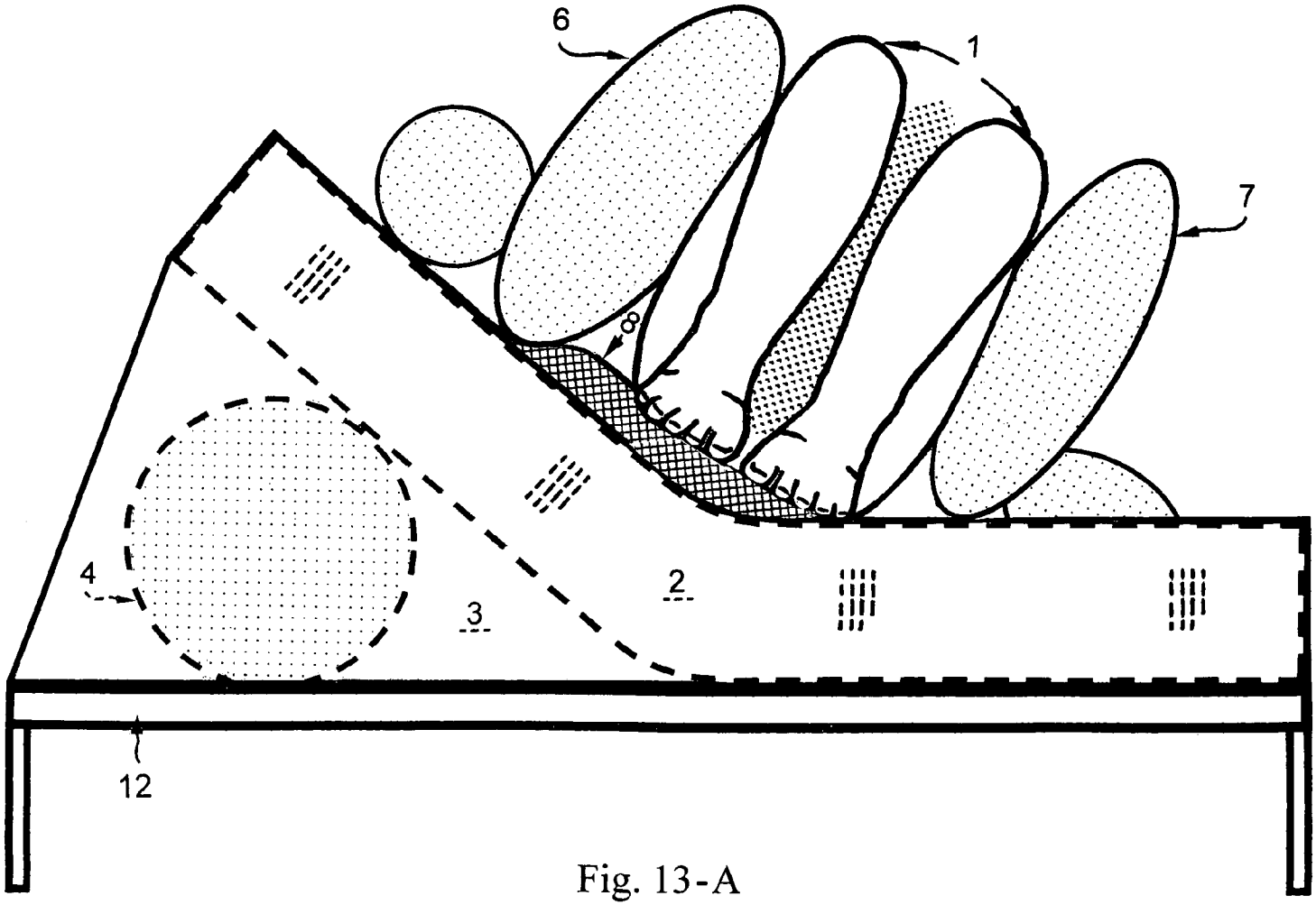
Fig. 13-A

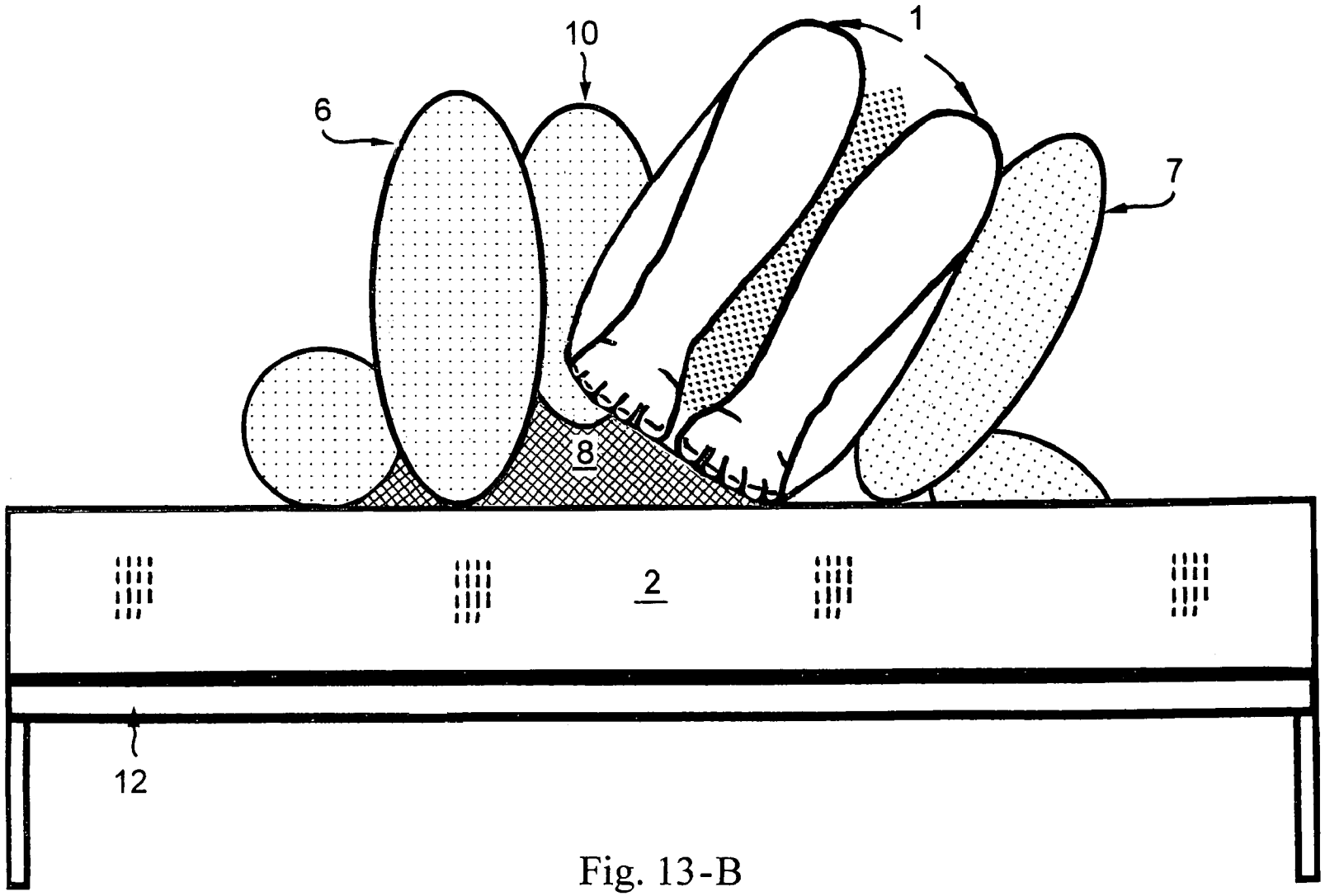
Fig. 13-B

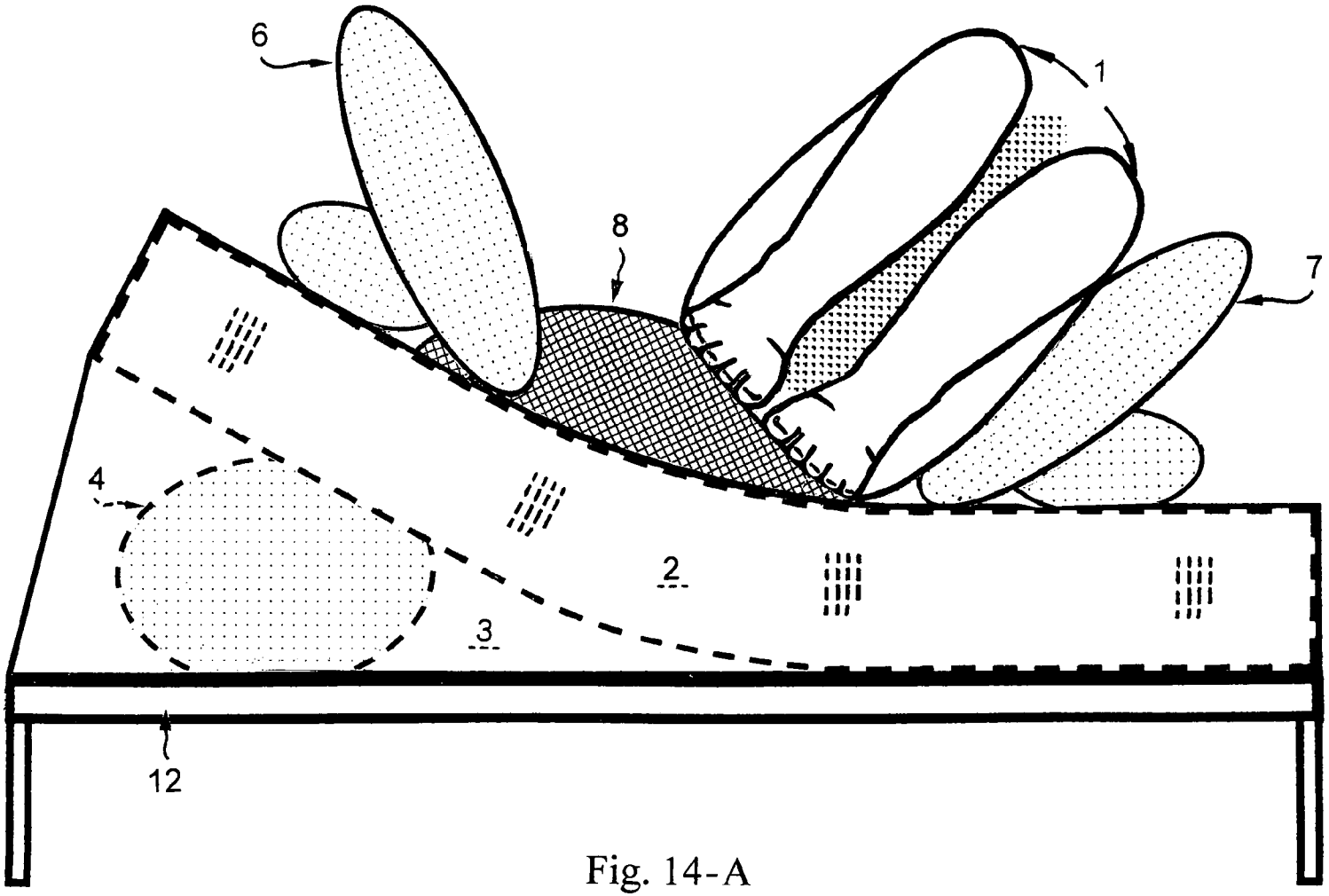
Fig. 14-A

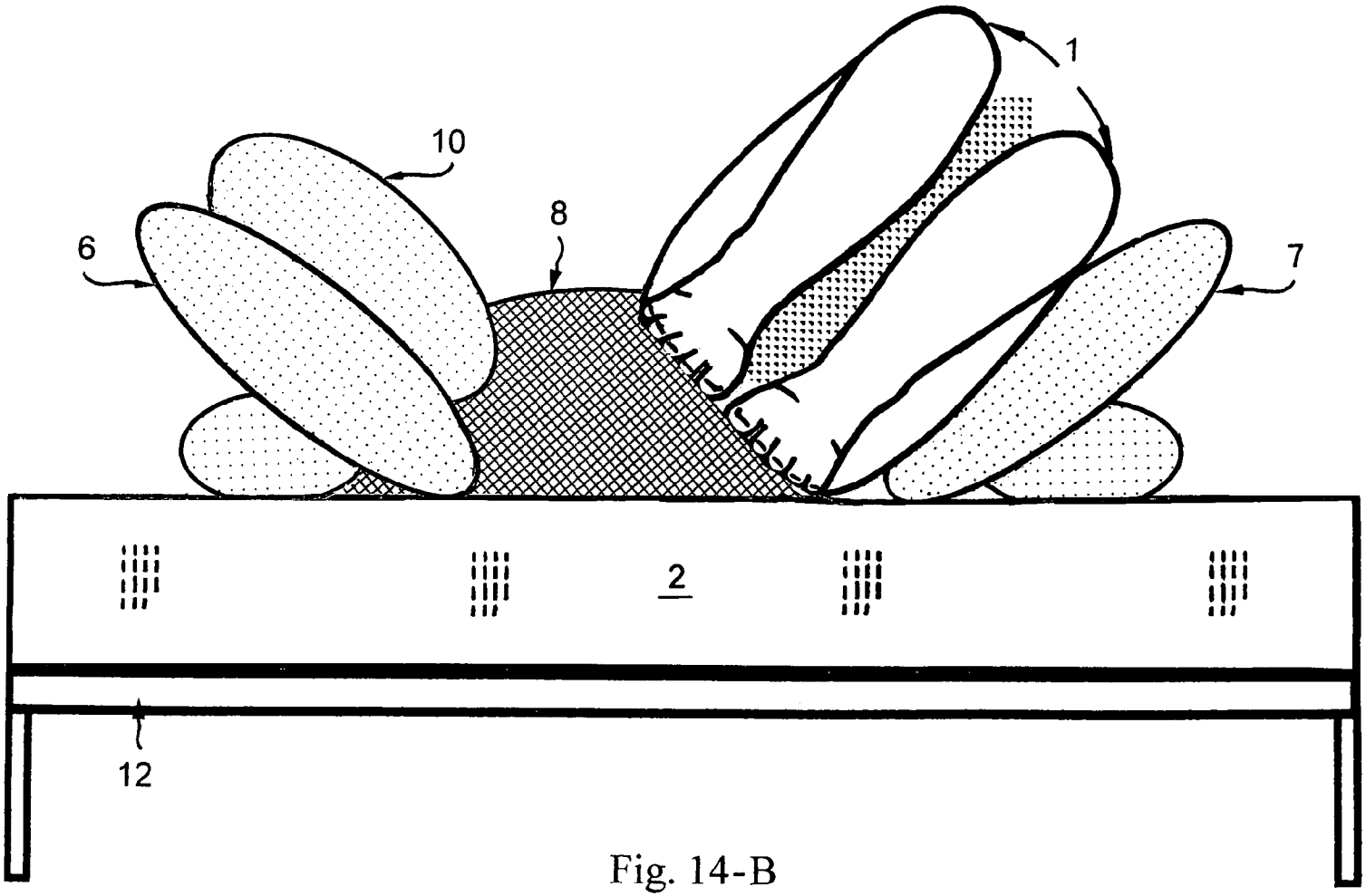
Fig. 14-B

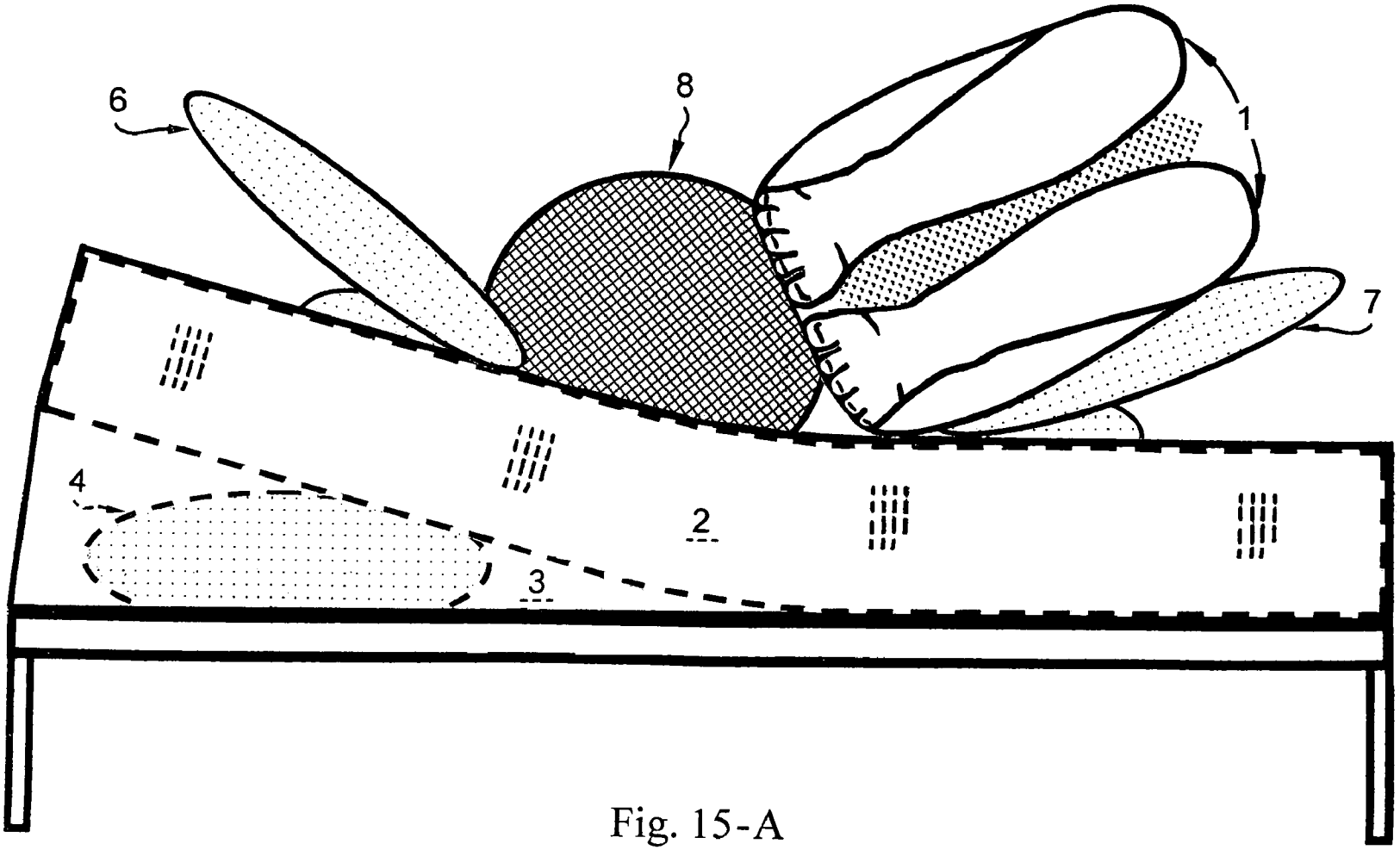
Fig. 15-A

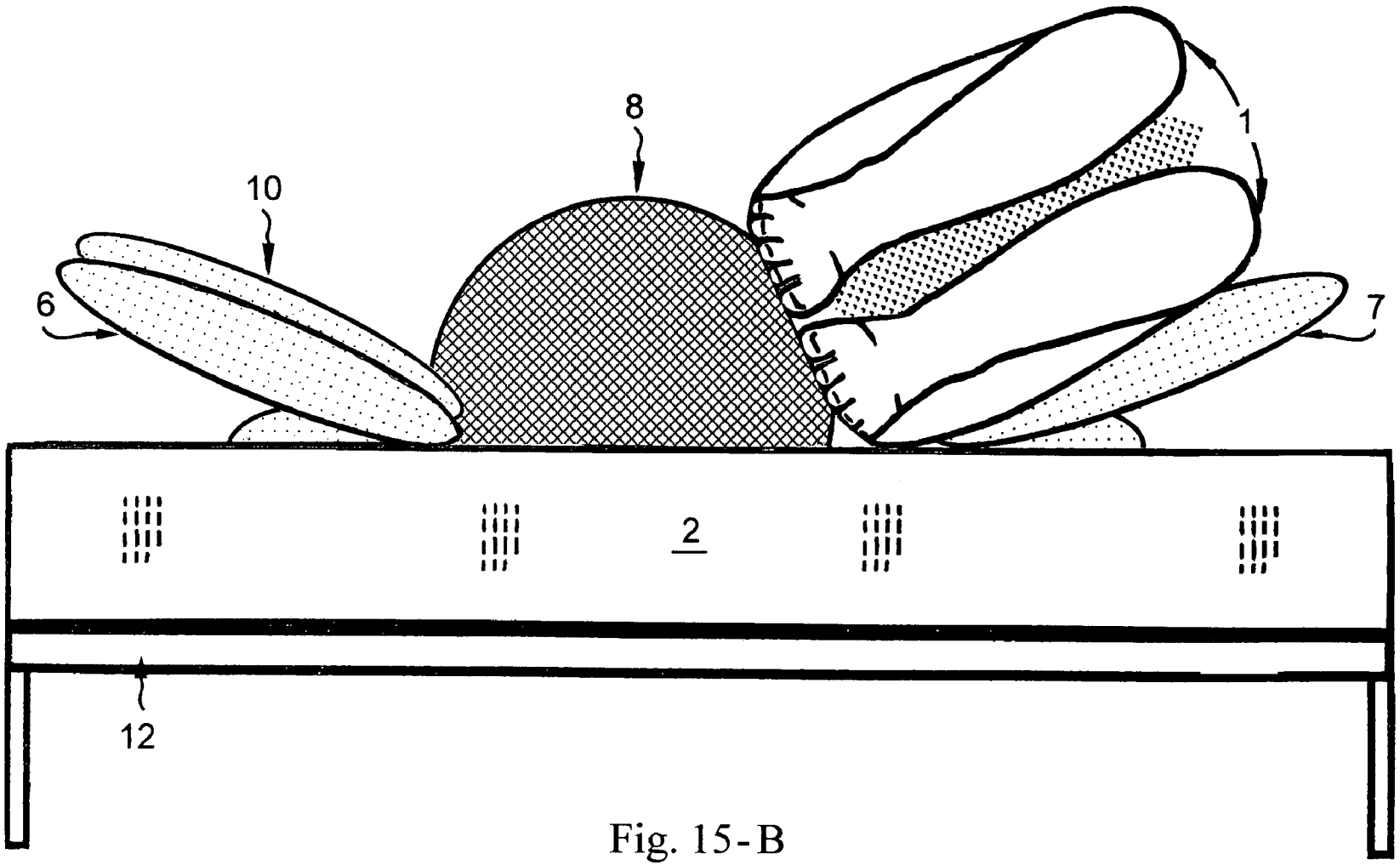
Fig. 15-B

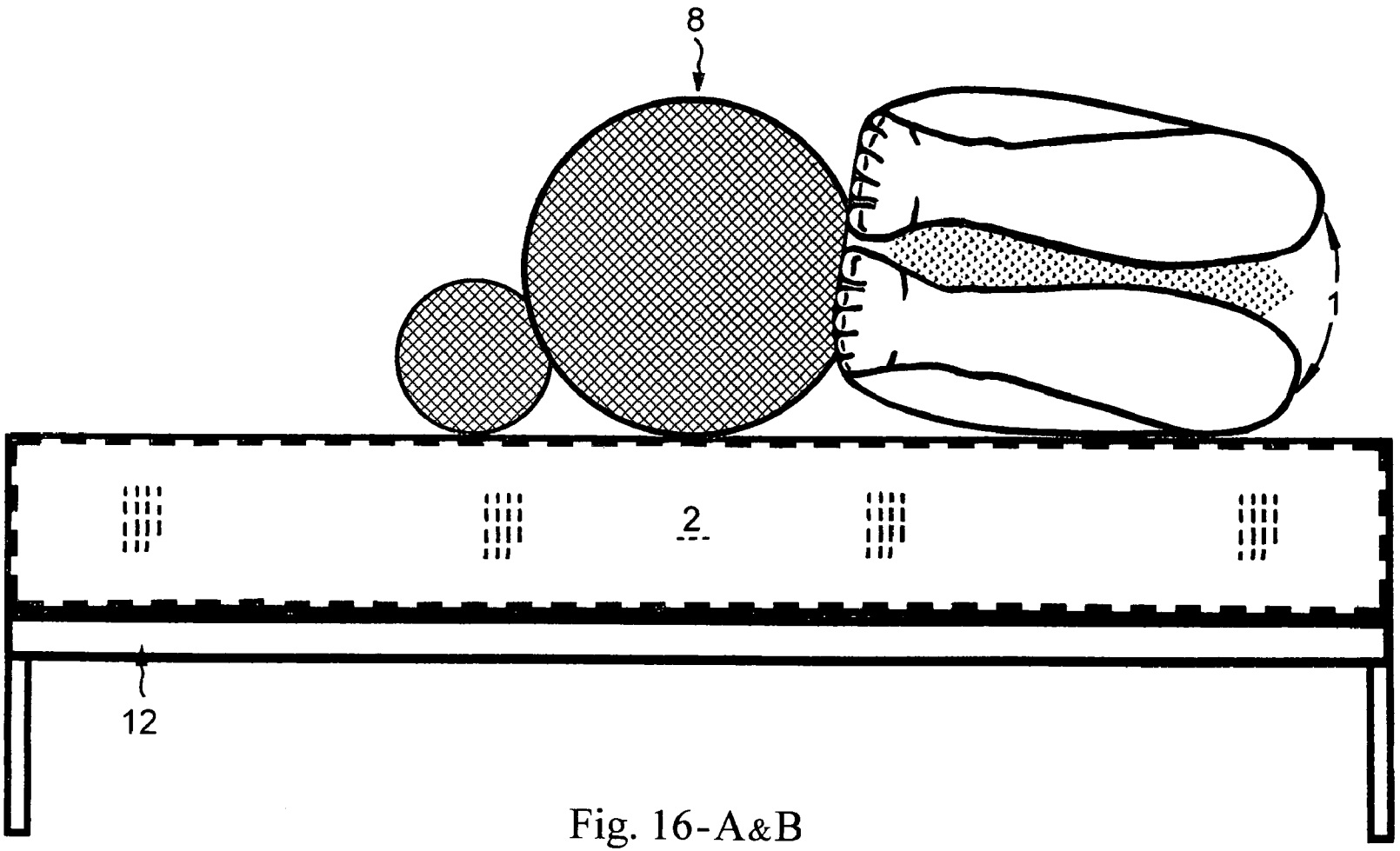
Fig. 16-A&B

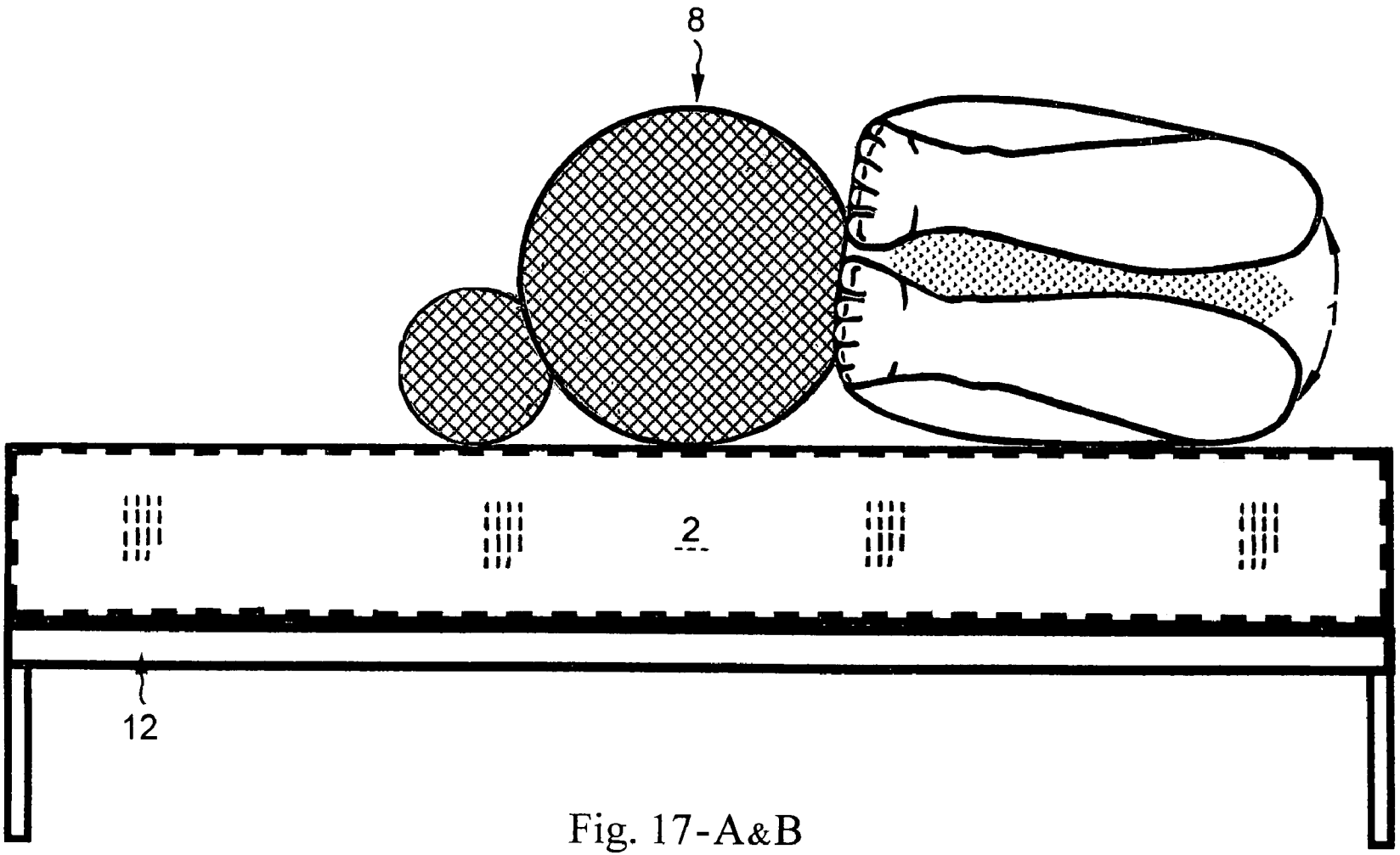
Fig. 17-A&B

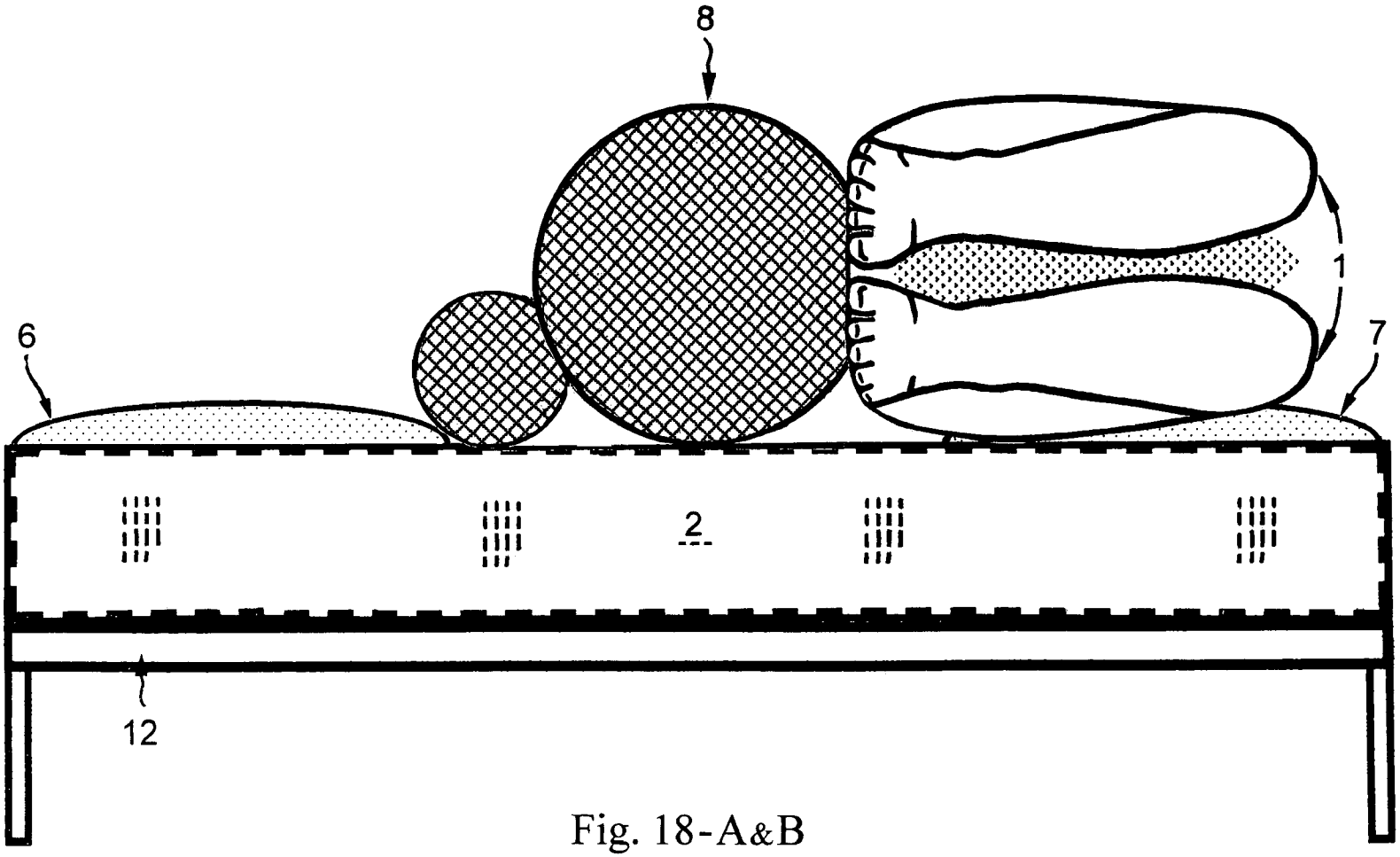
Fig. 18-A&B

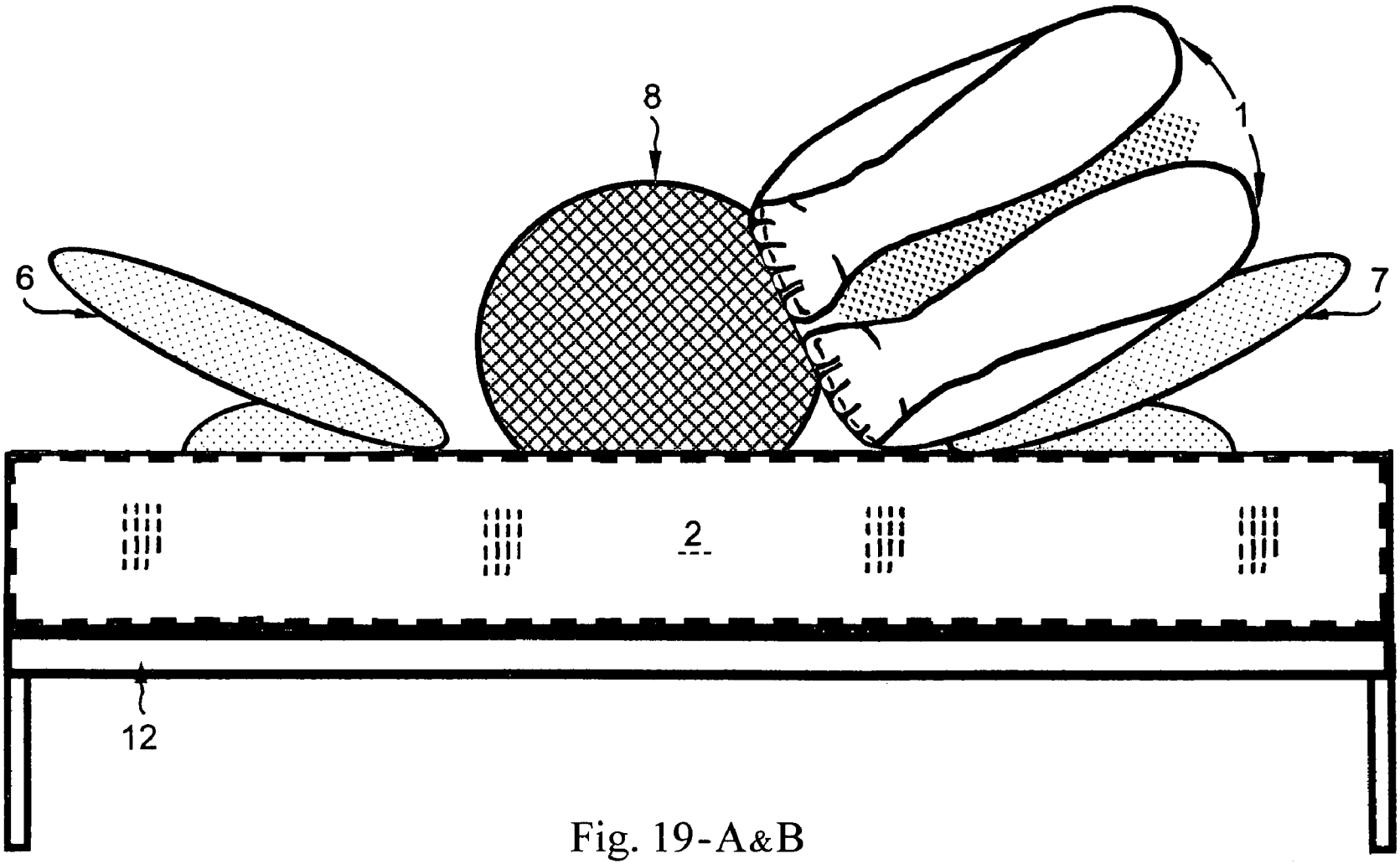
Fig. 19-A&B

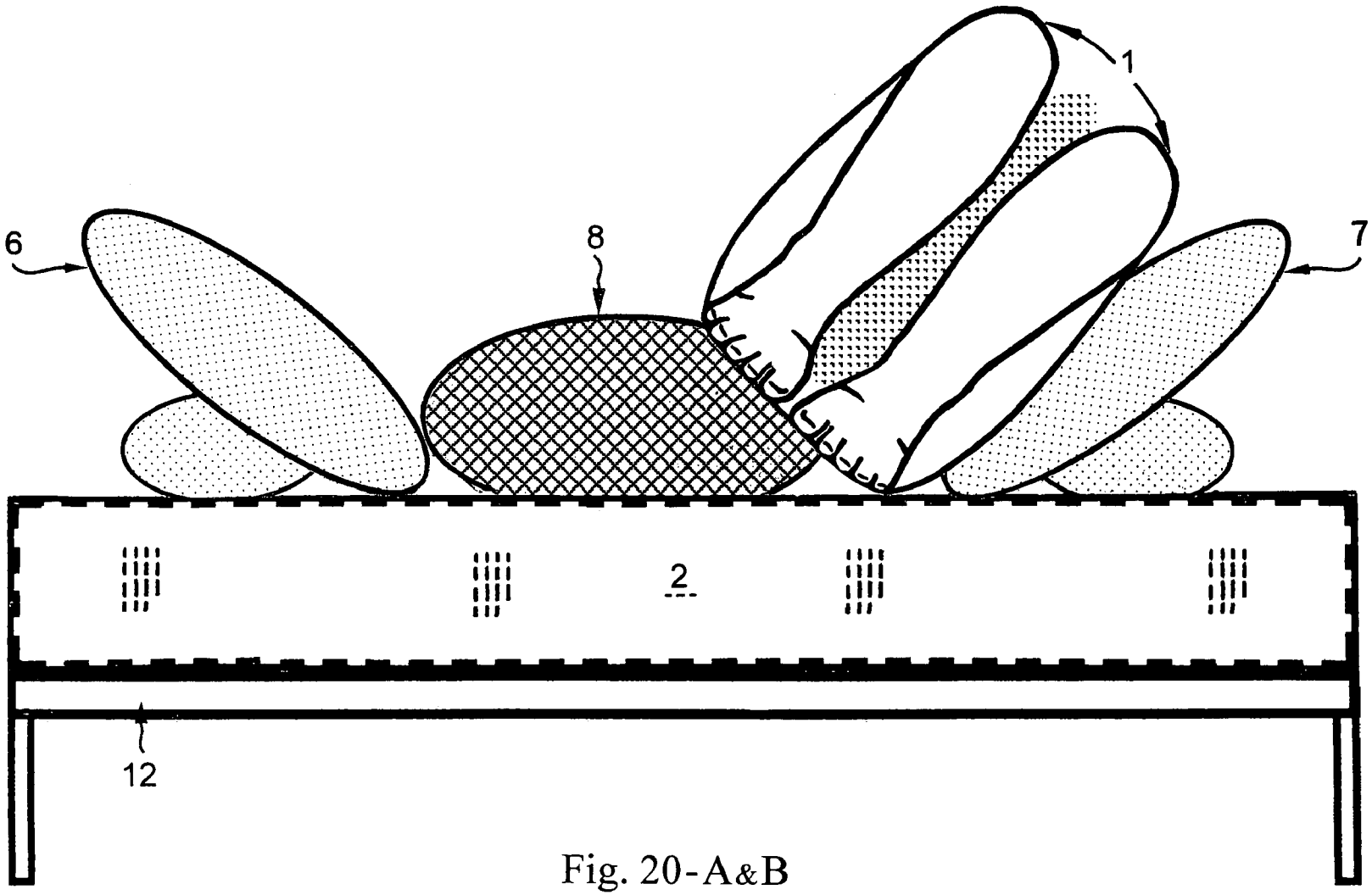
Fig. 20-A&B

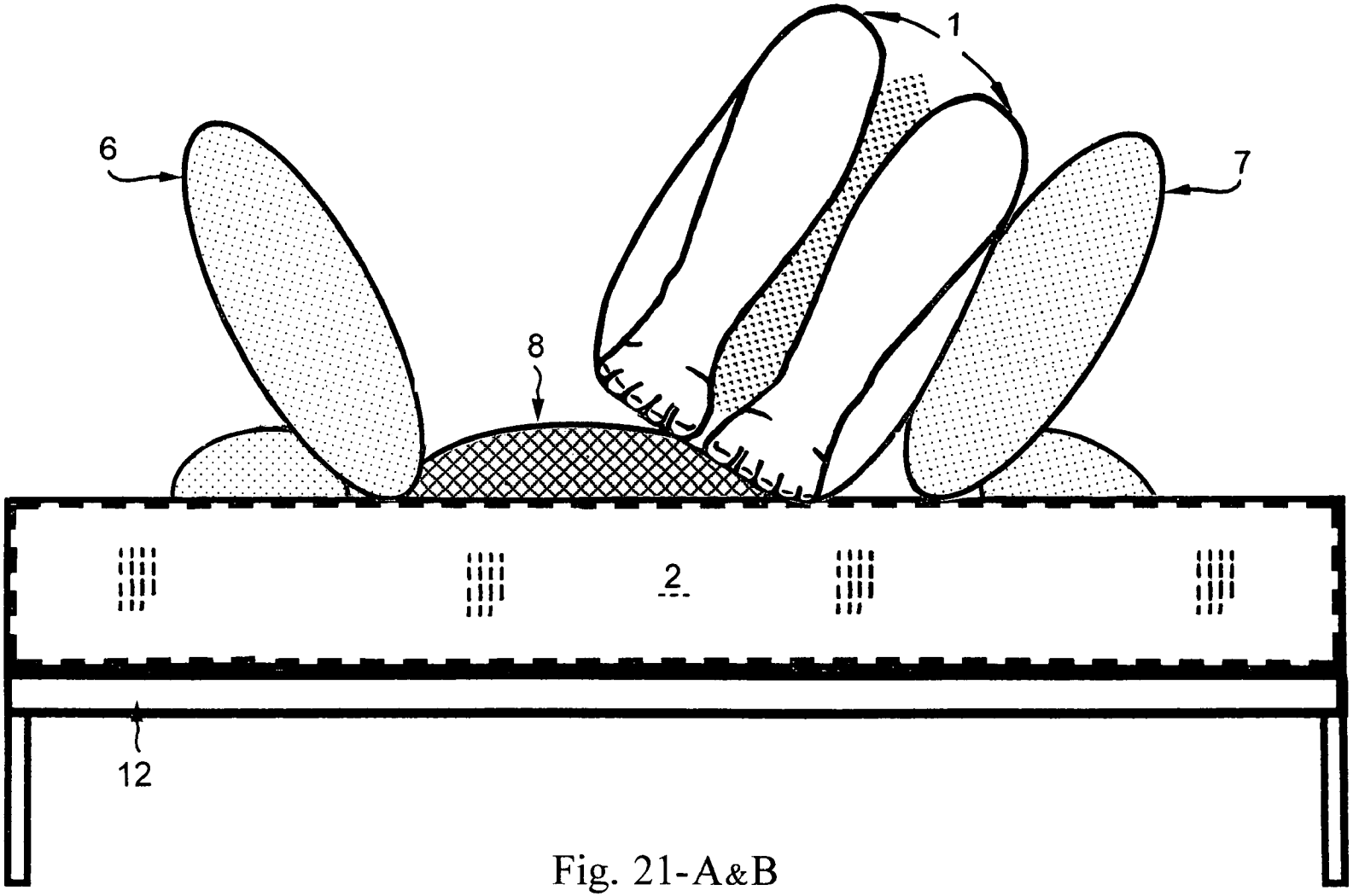
Fig. 21-A&B

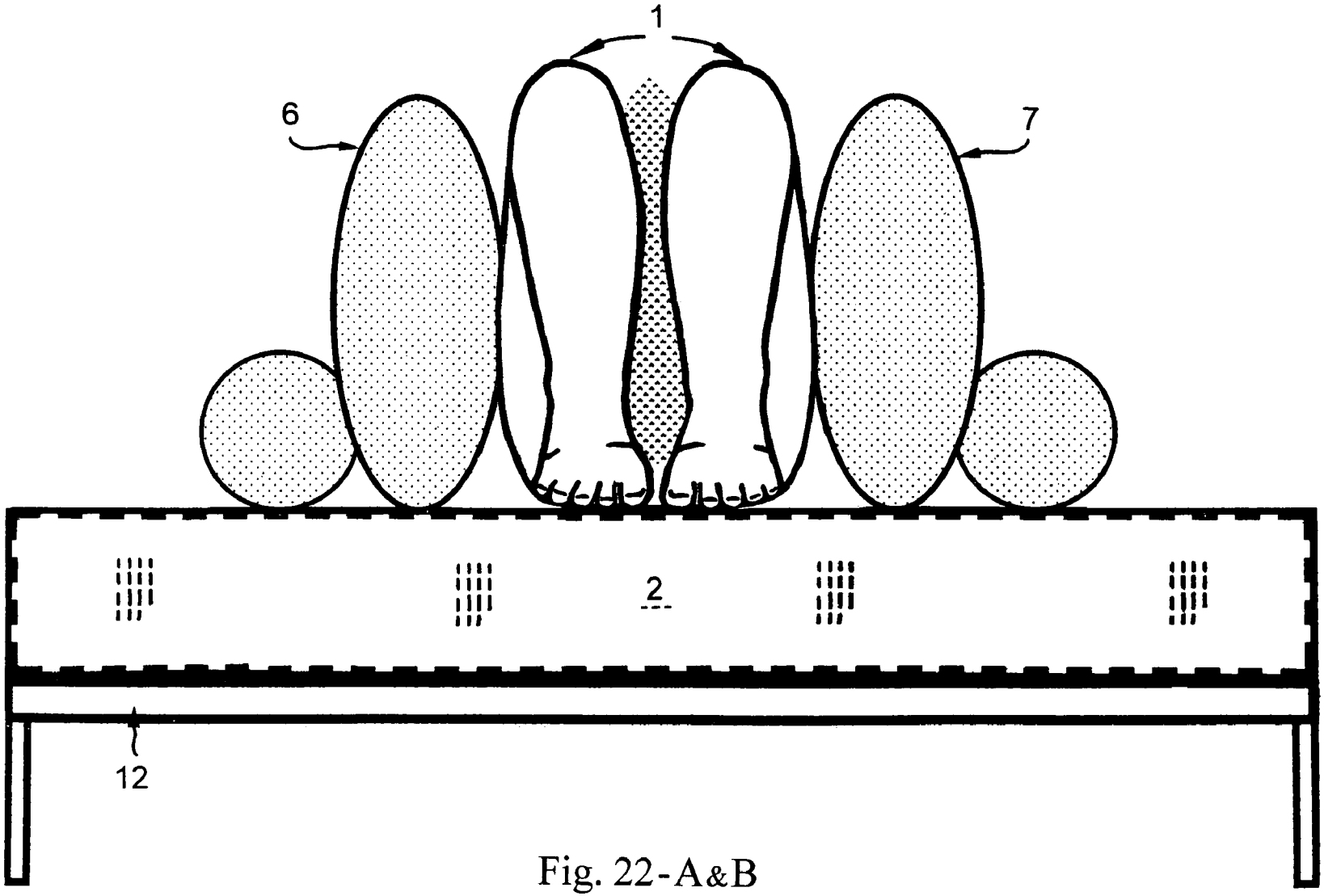
Fig. 22-A&B

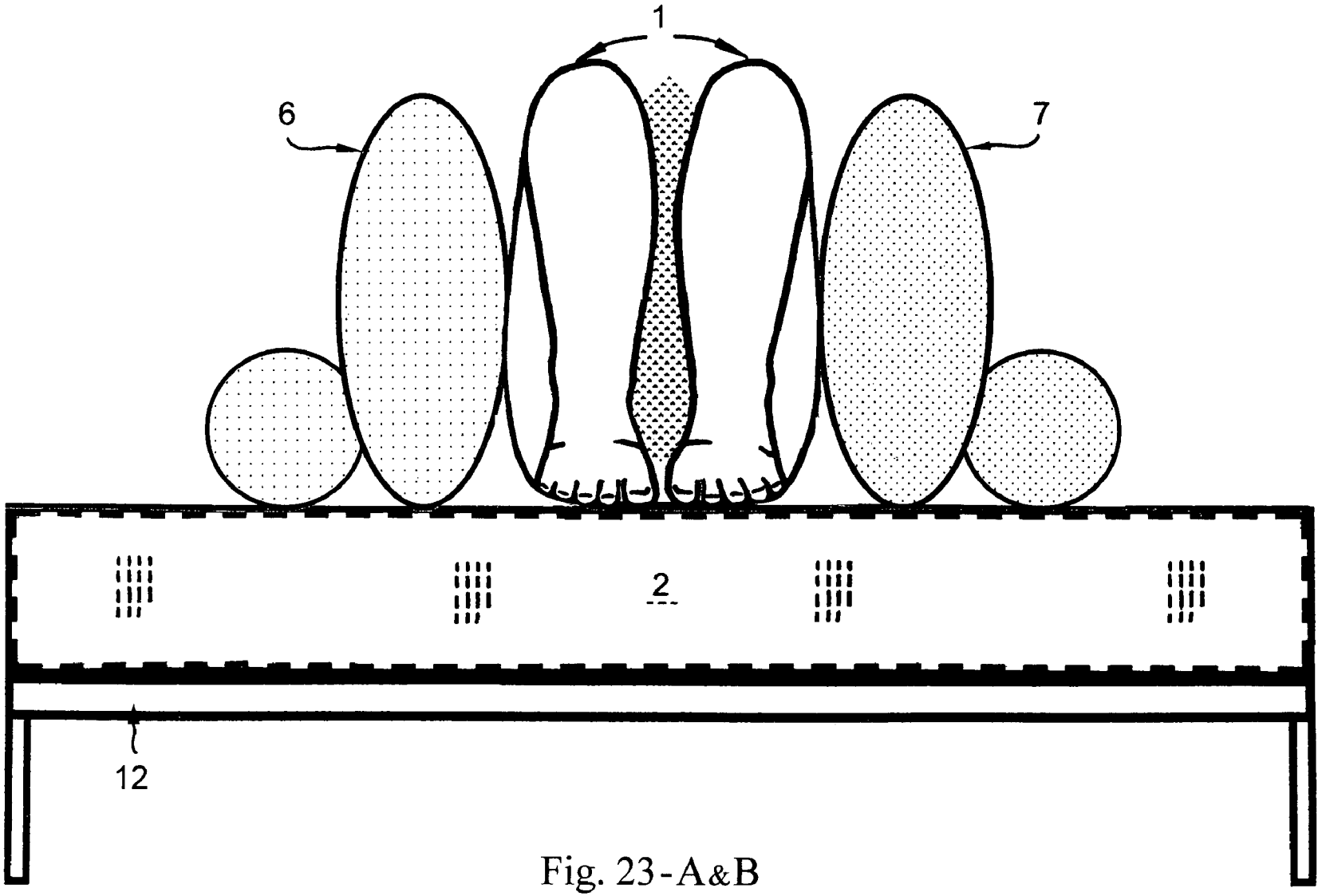
Fig. 23-A&B

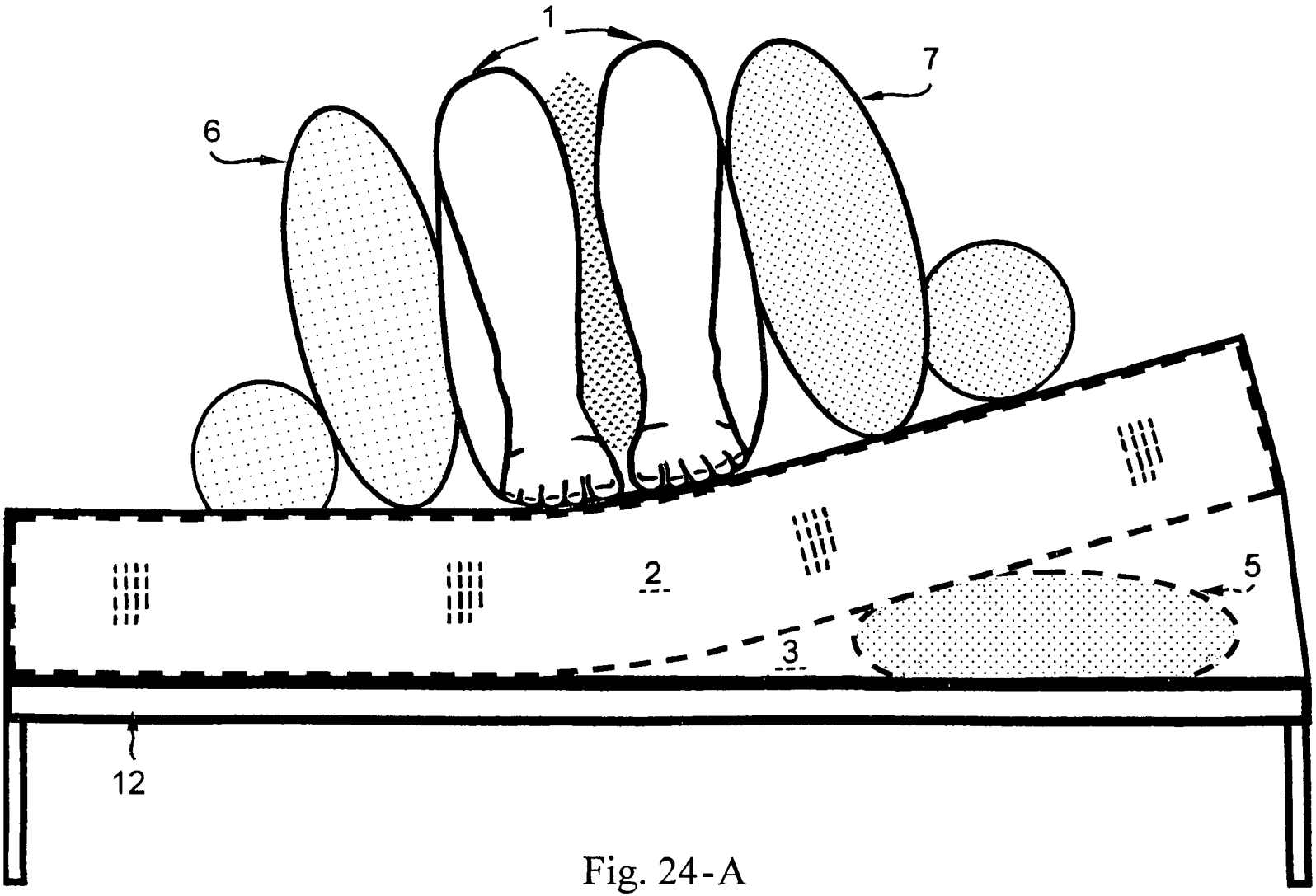
Fig. 24-A

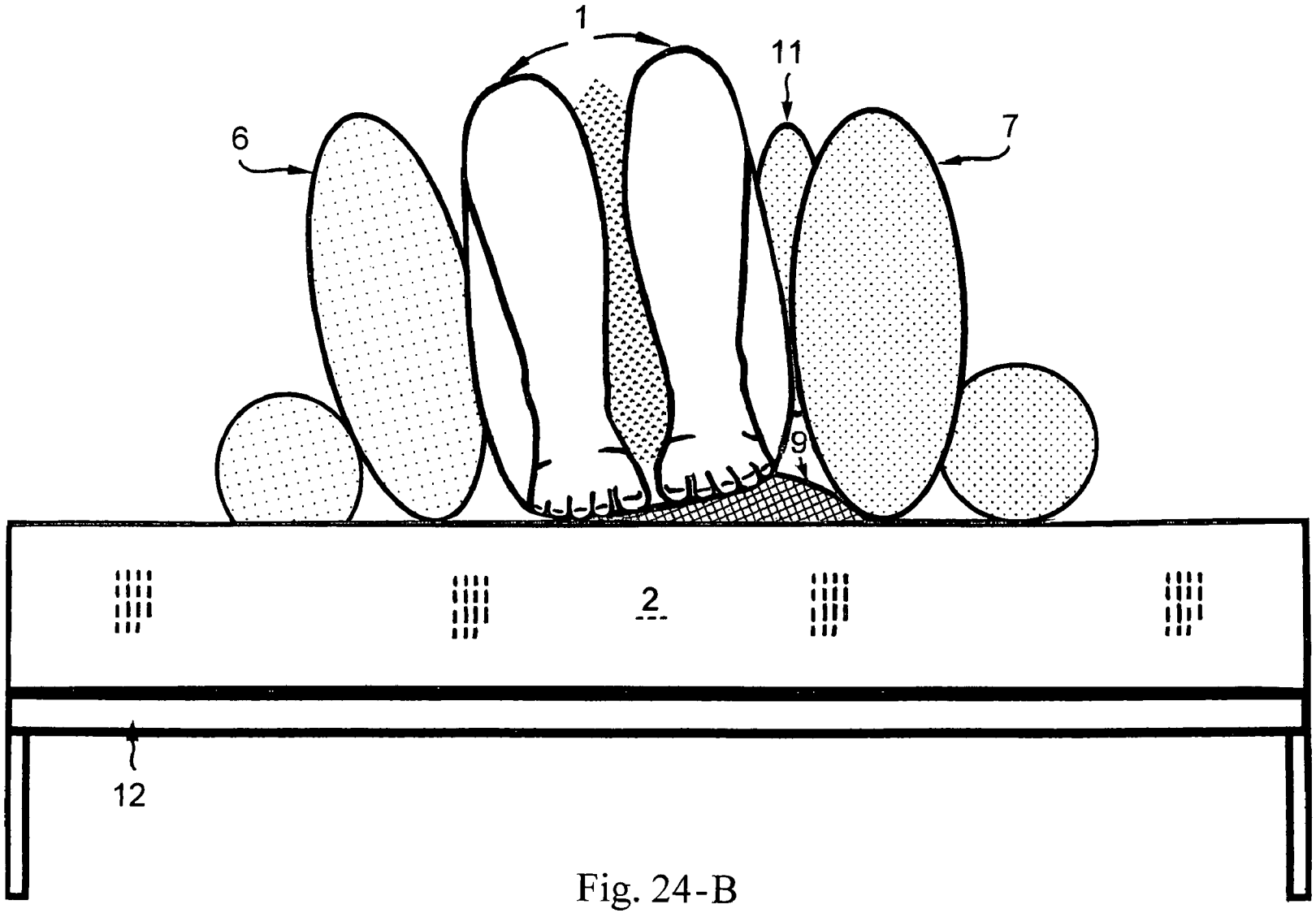
Fig. 24-B

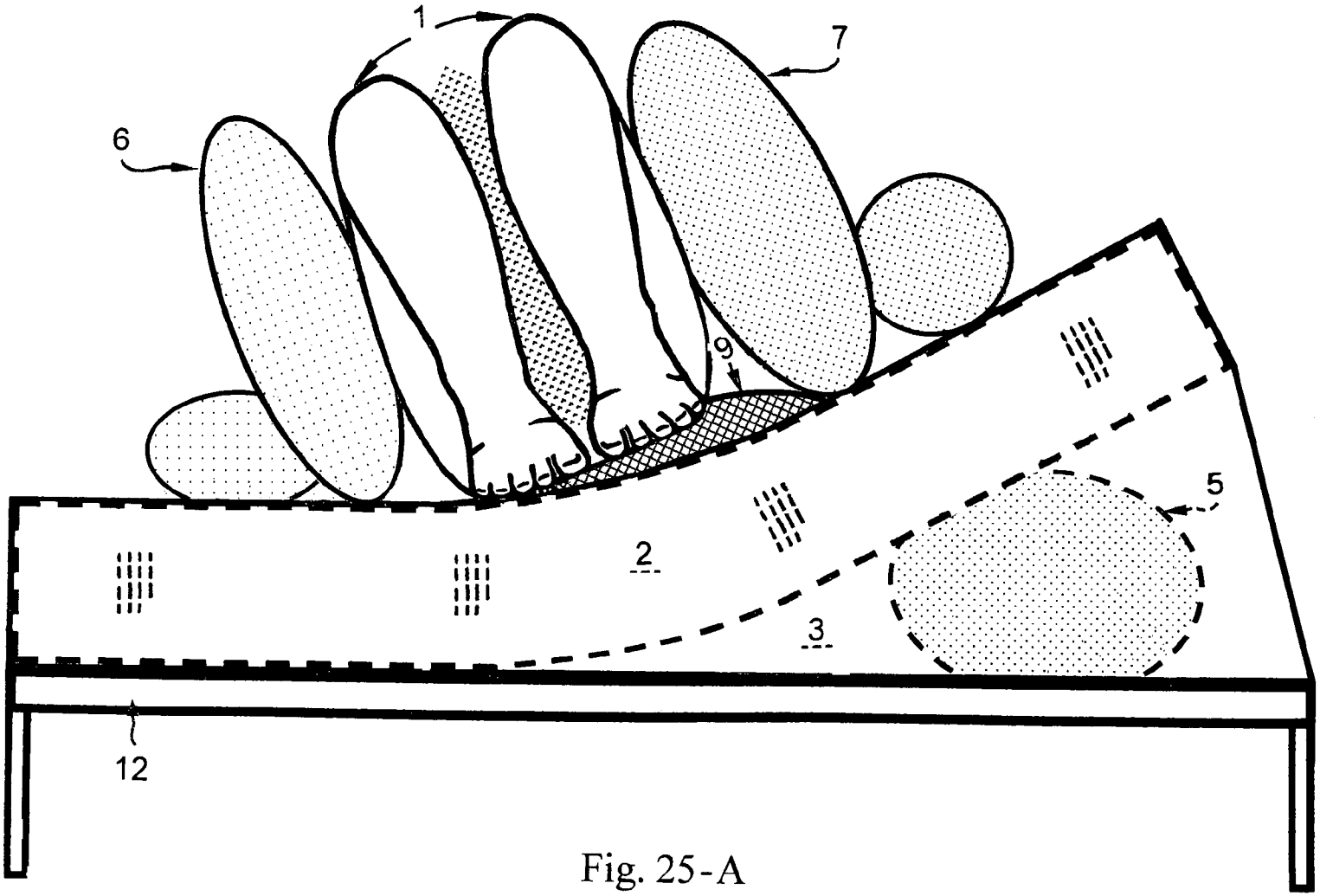
Fig. 25-A

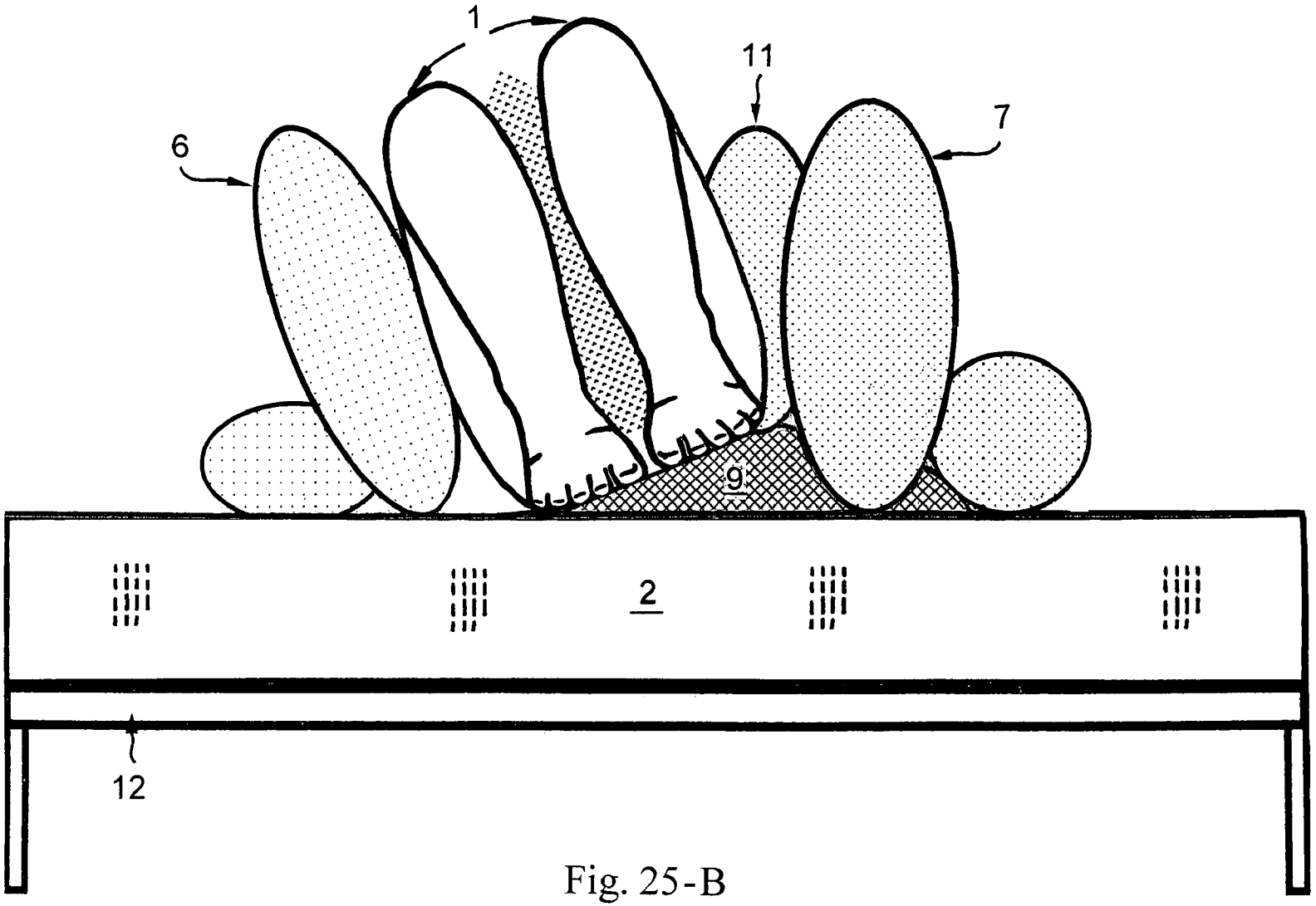
Fig. 25-B

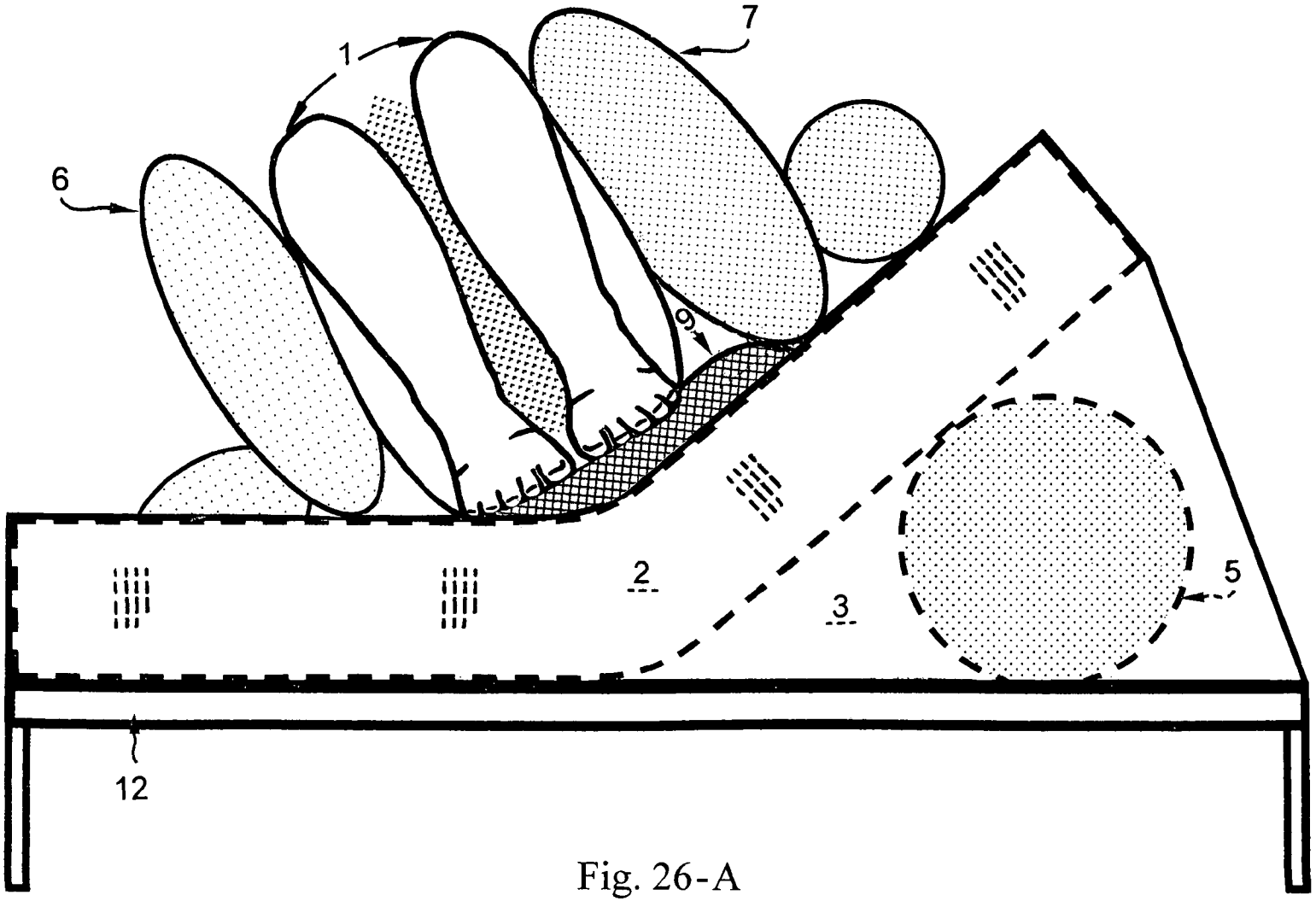
Fig. 26-A

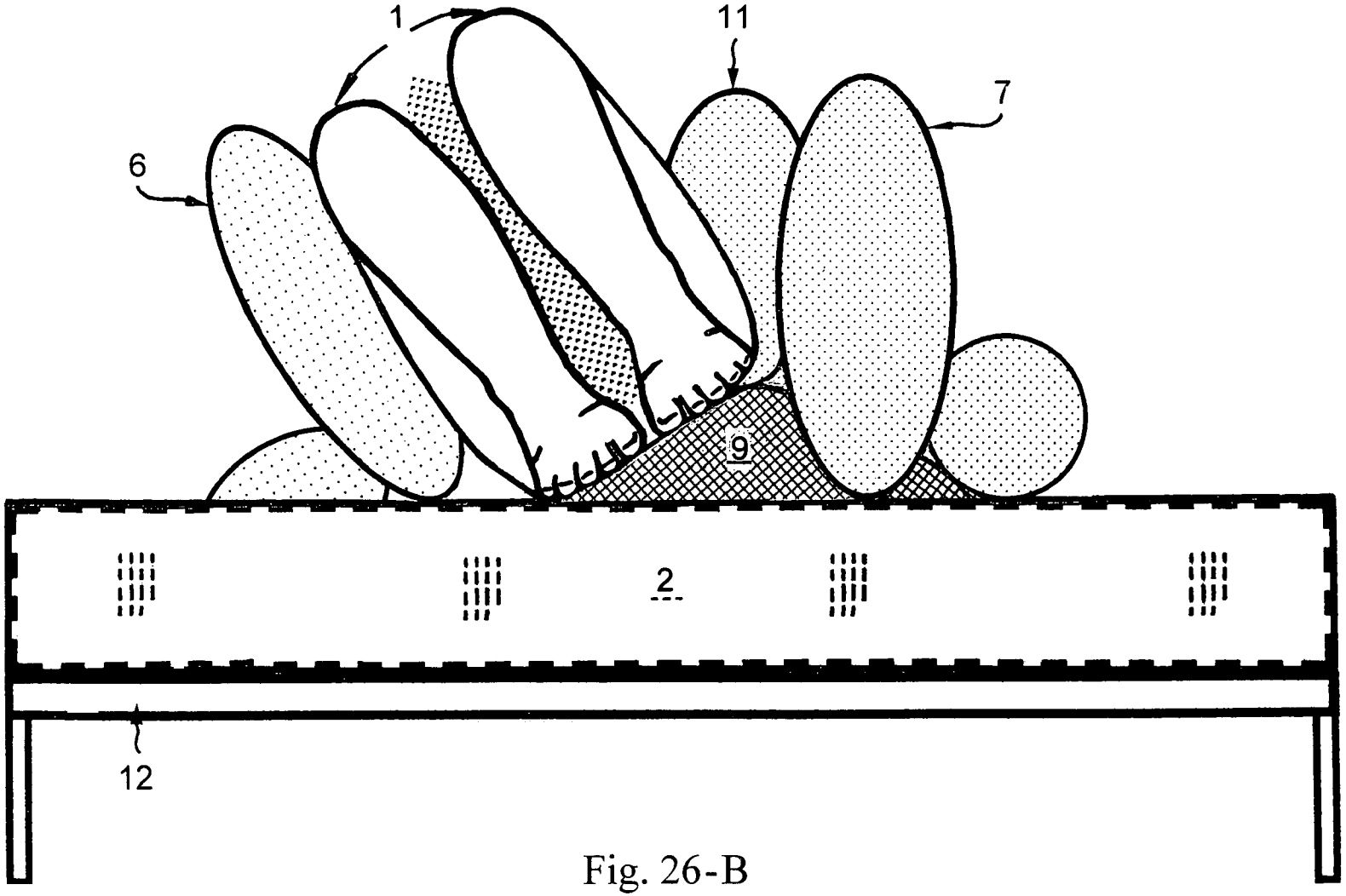
Fig. 26-B

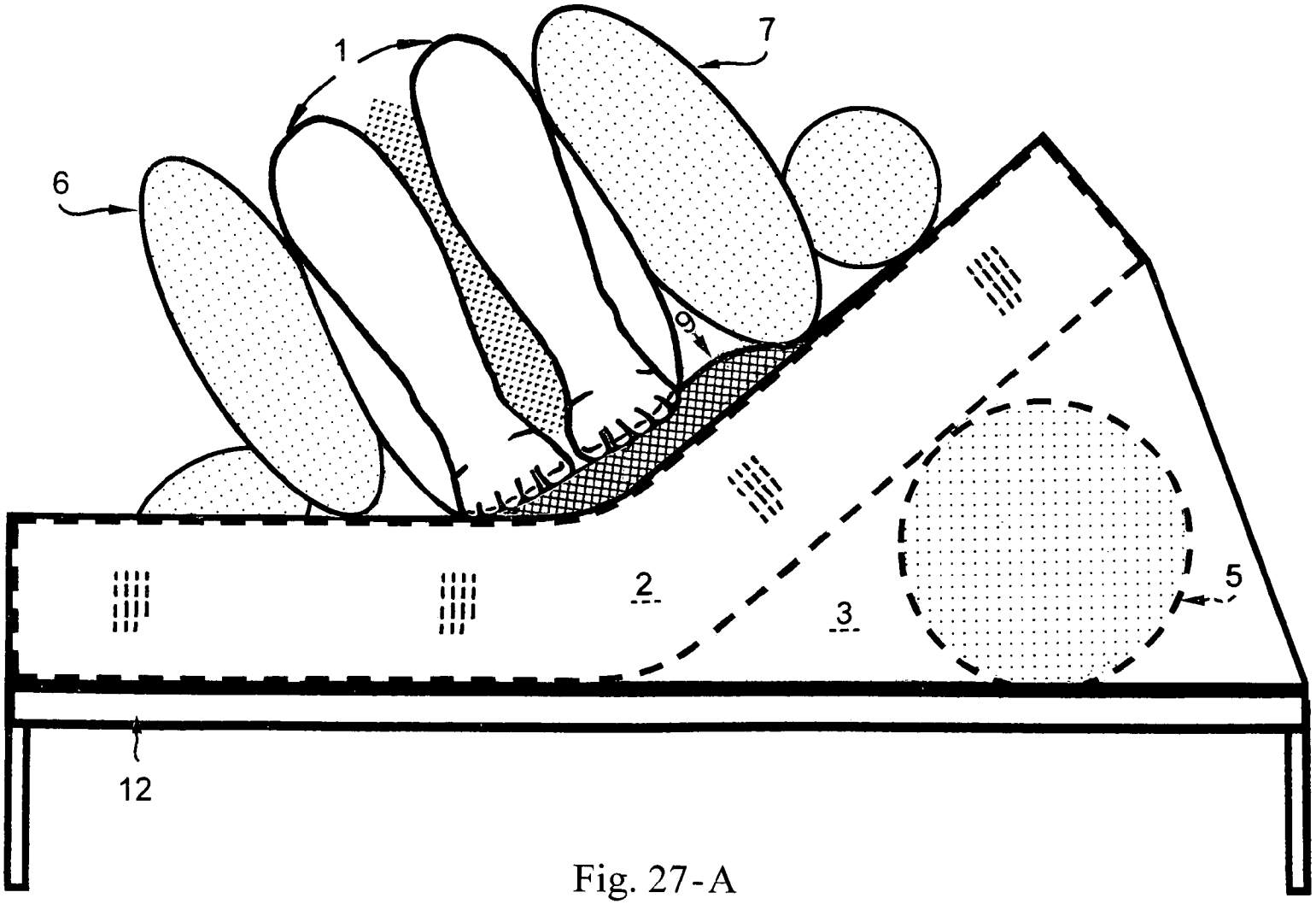
Fig. 27-A

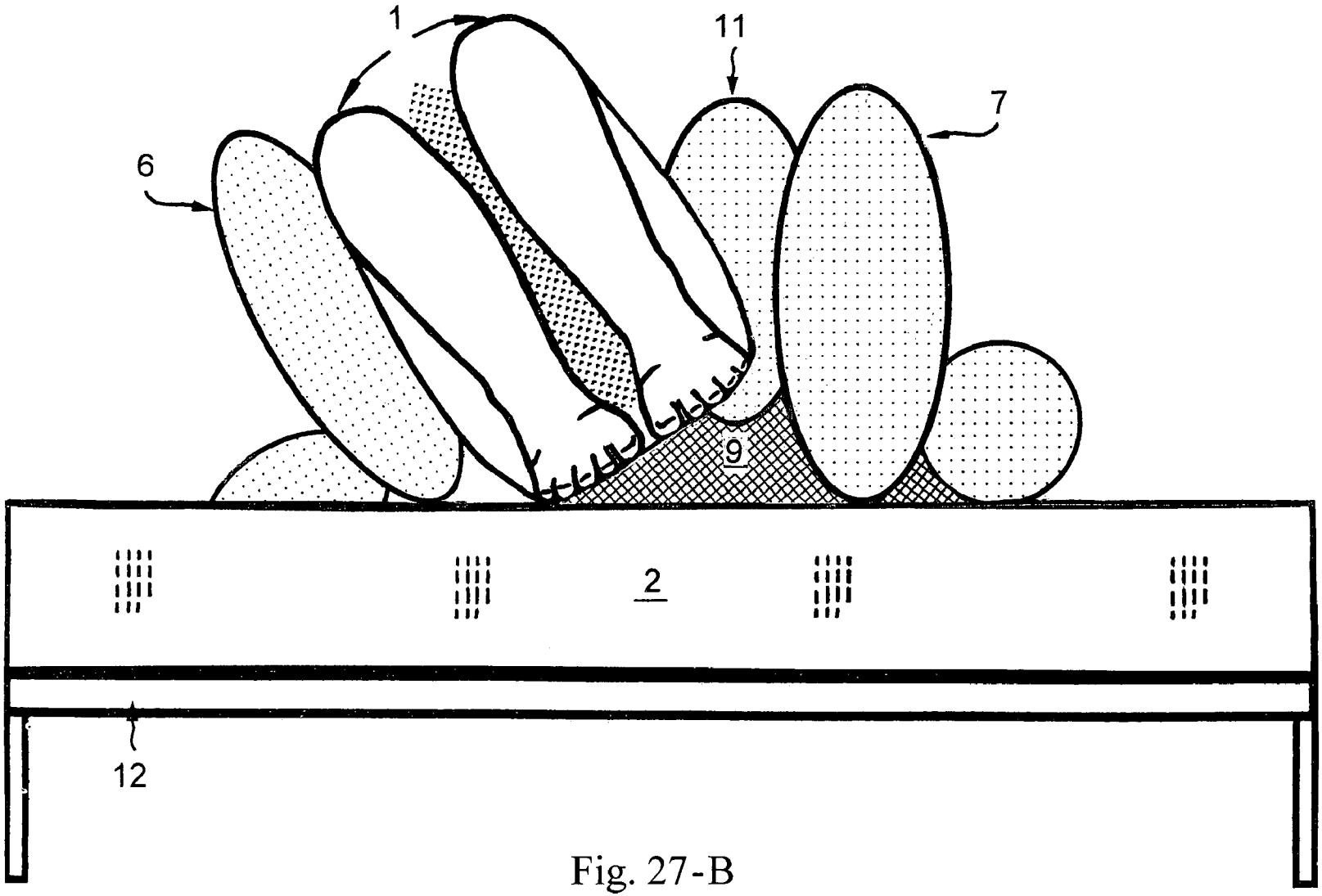
Fig. 27-B

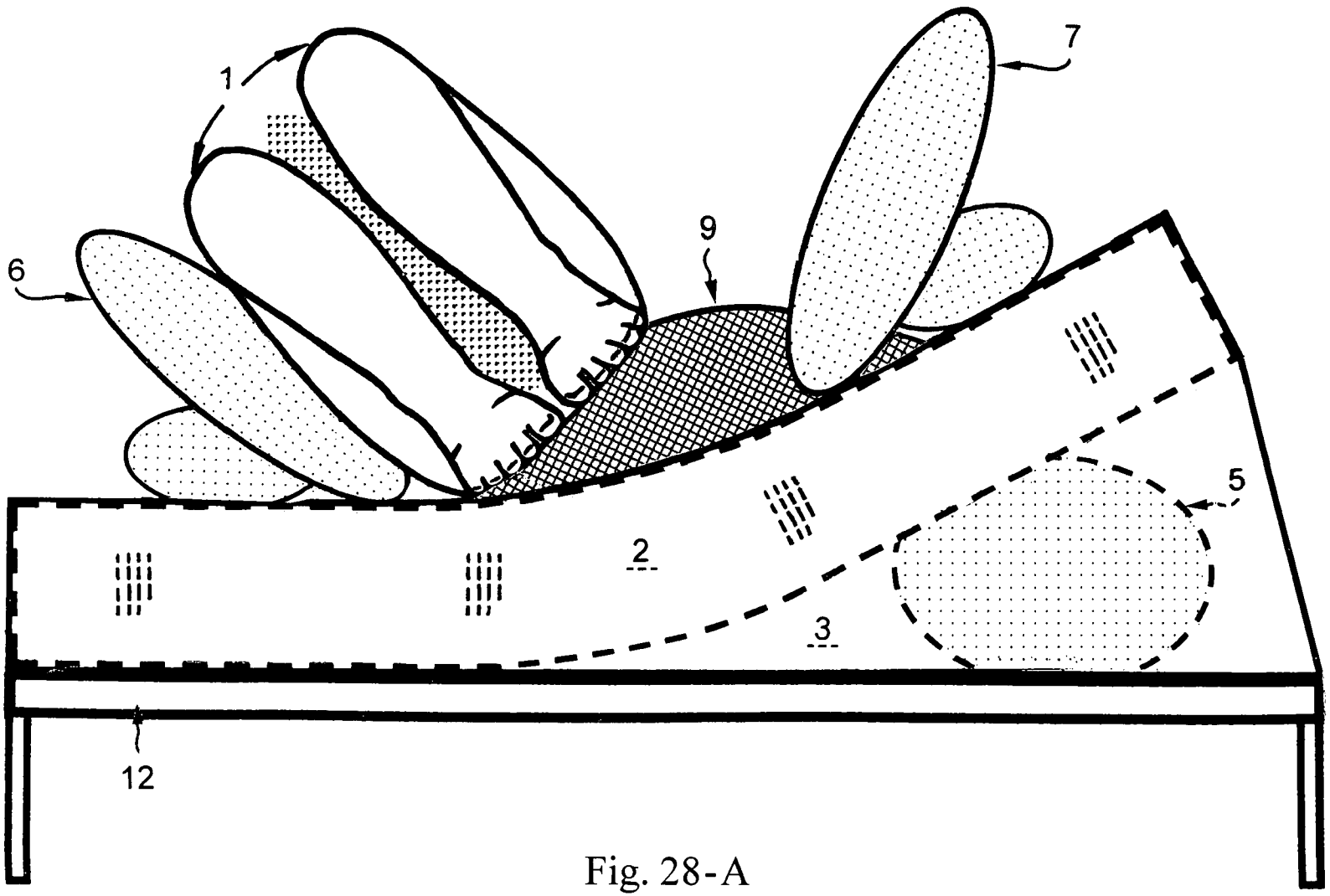
Fig. 28-A

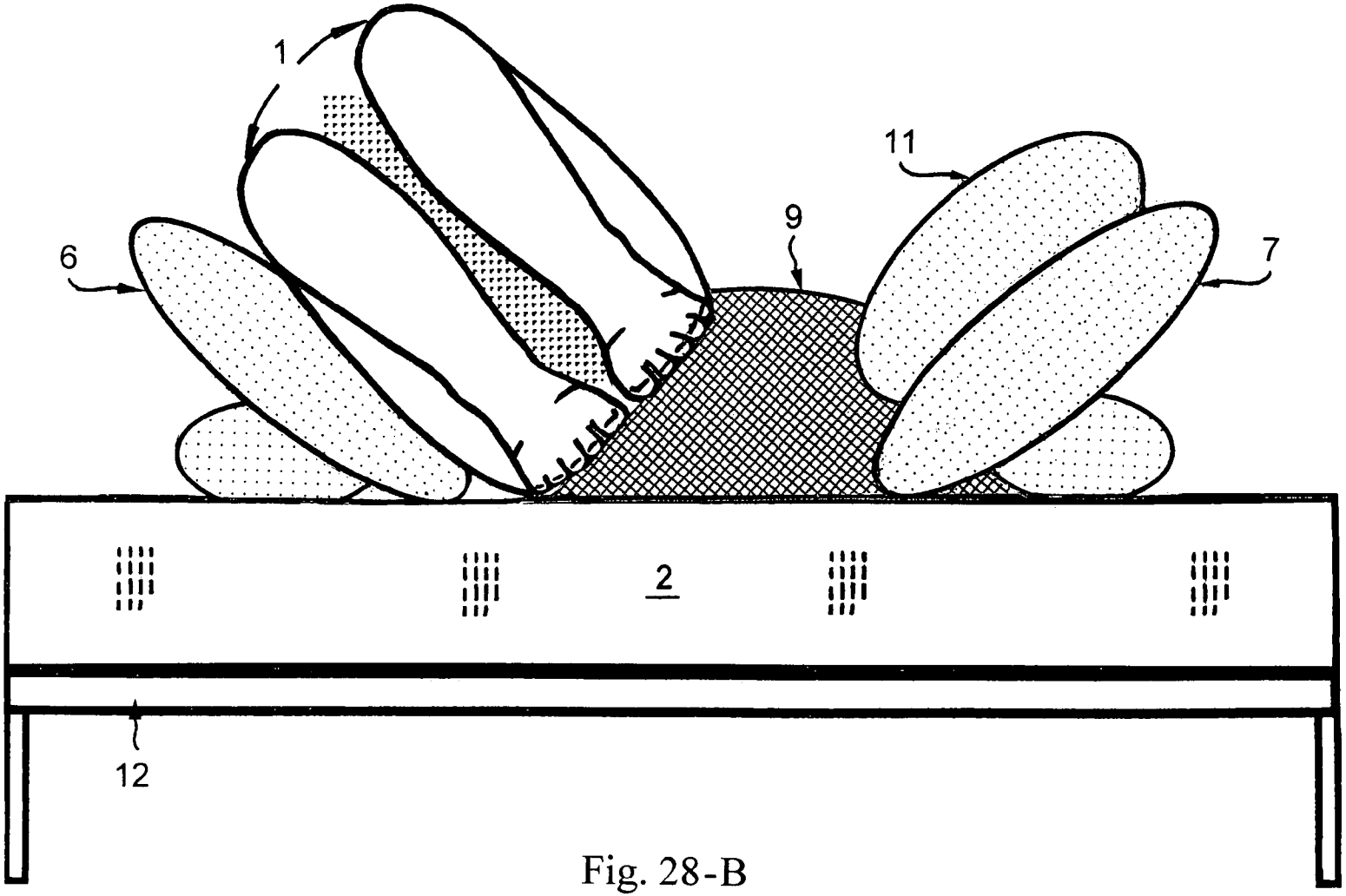
Fig. 28-B

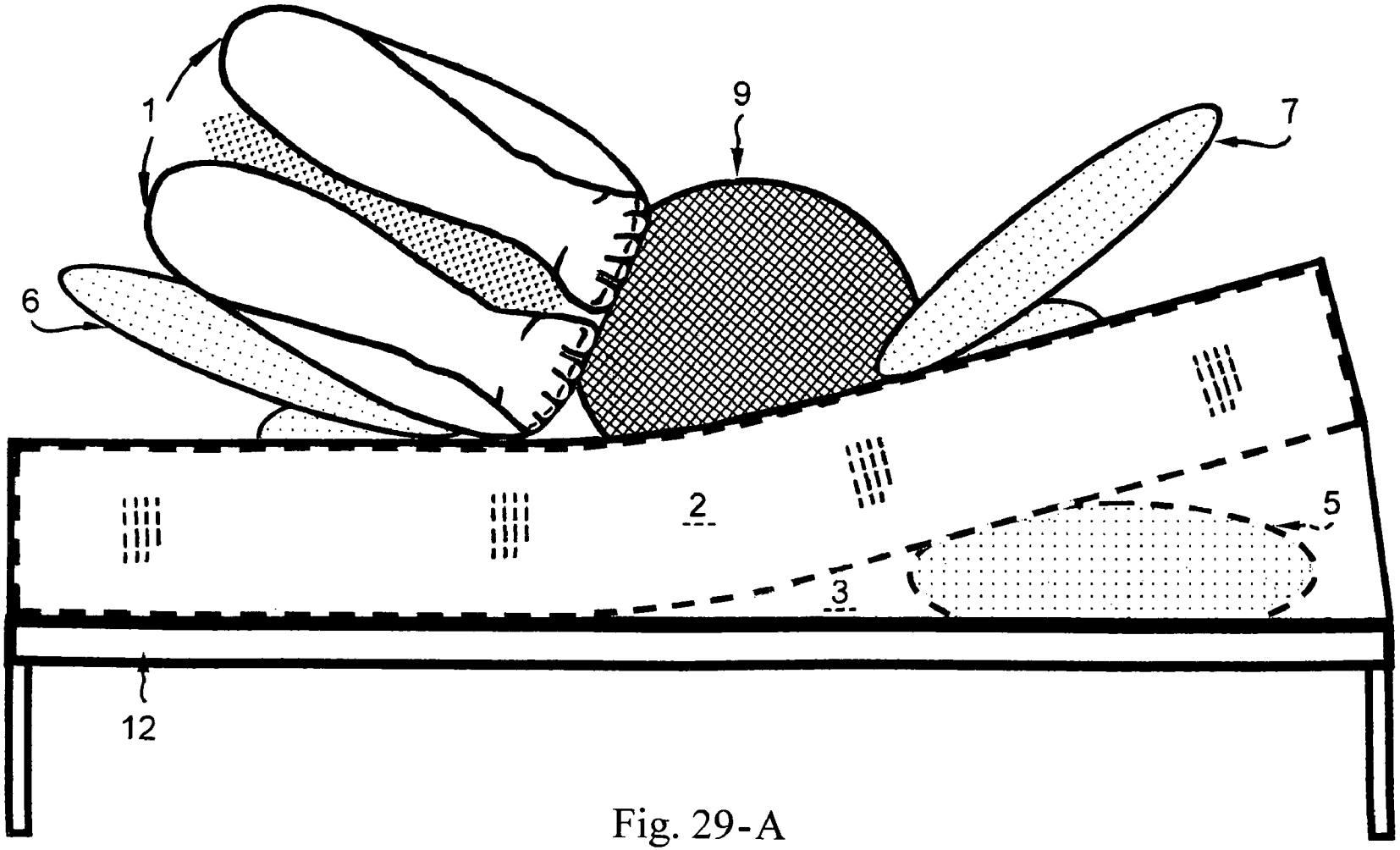
Fig. 29-A

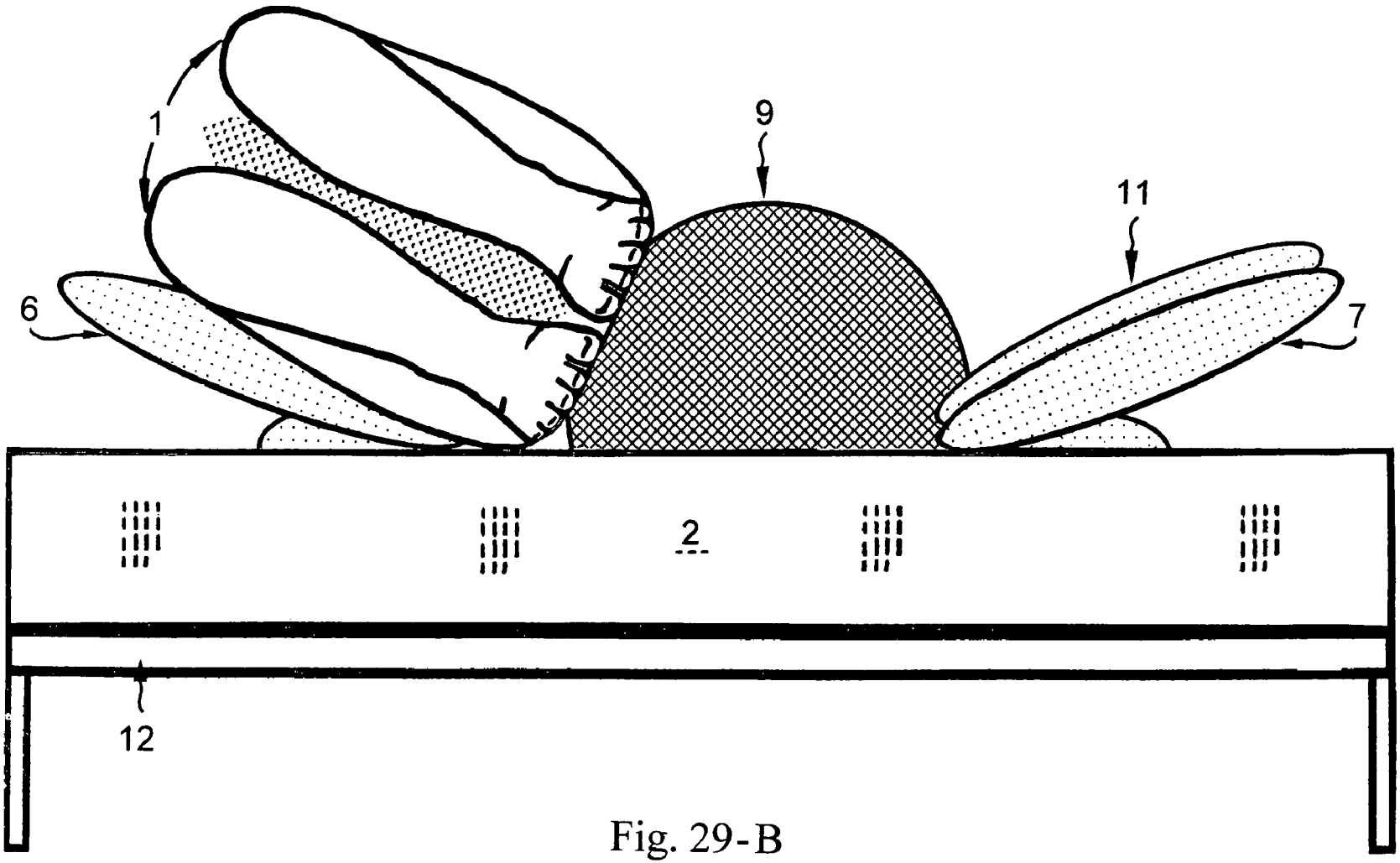
Fig. 29-B

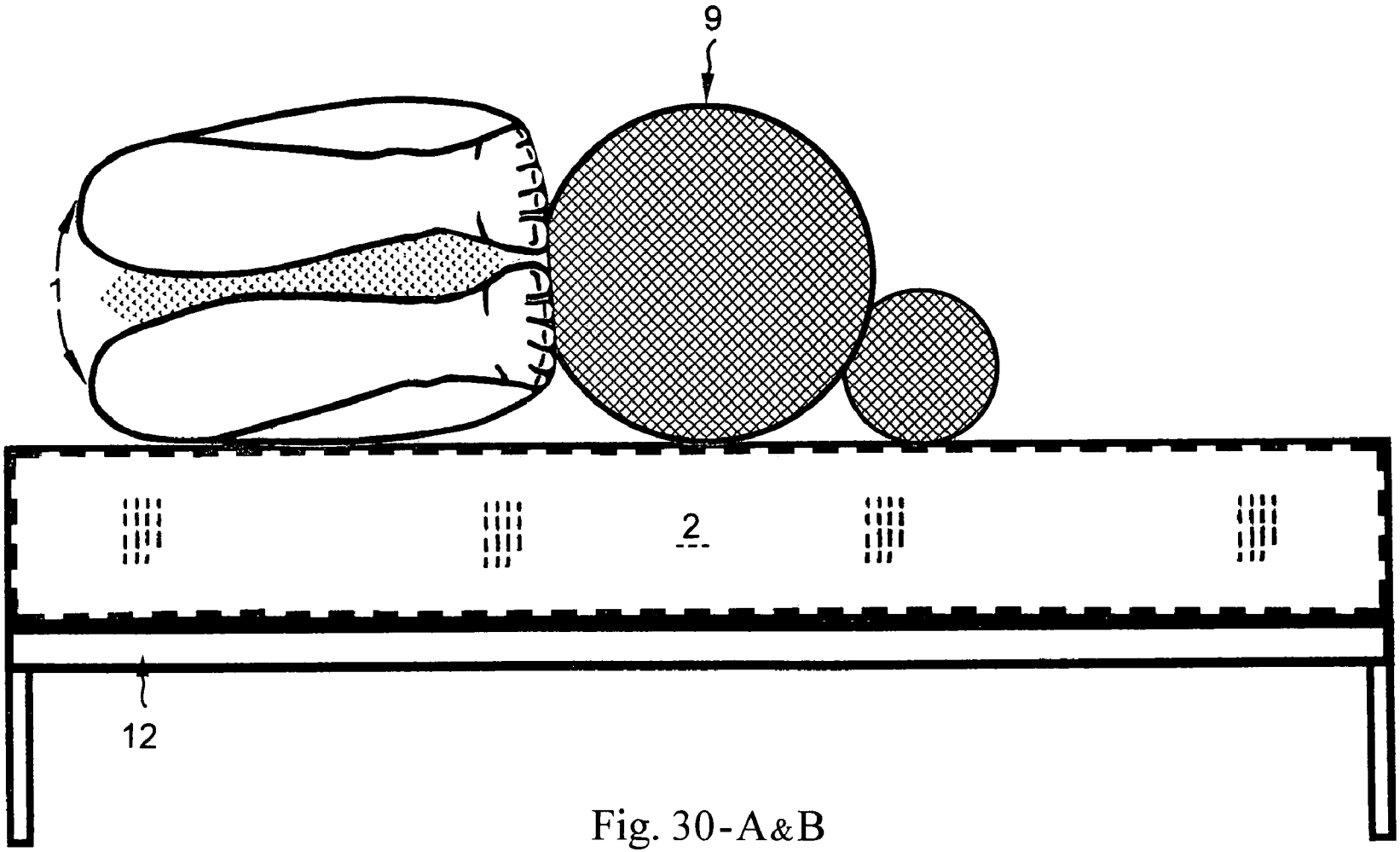
Fig. 30-A&B

AUTOMATIC PATIENT TURNER

This application is a continuation-in-part of application Ser. No. 11/075,259, filed on Mar. 8, 2005 now abandoned, which is a continuation-in-part of Ser. No. 10/165,703, filed on Jun. 8, 2002, now abandoned.

FIELD

The Automatic Patient Turner is a unique, innovative invention that is designed to prevent pressure sores as well as an accumulation of fluid in the lungs. It is a significant and major improvement on a conventional rotational air mattress that only has the ability to alternately and laterally tilt a patient to a maximum of a 45-degree incline without having to strap the patient to the mattress. Without having to strap the patient to the device, the Automatic Patient Turner can first laterally tilt an immobile, bedridden patient, and then continue to safely turn the patient laterally from one complete side to the other. It will turn the patient in a manner similar to the manual turning by a nurse or a caregiver. Between turns, the patient will lie on one side upon a flat surface with a pillow between the knees and legs, and an inflatable pillow supporting the back.

In the United States Manual of Patent Classifications, this invention falls under the following two class/subclasses: 5/615, "fluid inflatable bag adjusts position of support section," and 5/607, "tiltable along a longitudinal axis." The International Patent Classification is A61G 7/00, a "means for displacing patients or invalids."

BACKGROUND OF THE INVENTION

Pressure sores and the accumulation of fluid in the lungs have always been endemic among immobile patients. These problems develop when an immobile patient remains in the same position for prolonged periods of time. Aside from causing considerable pain to the patient, pressure sores are difficult and costly to treat. They can become infected and may even lead to the death of the patient.

There is consensus among wound care specialists that in most cases pressure sores are preventable if the immobile patient is repositioned or turned at least once every two hours. This is also the recommendation of both the (U.S.) National Pressure Ulcer Advisory Panel and the European Pressure Ulcer Advisory Board.

The manual turning of an immobile patient every two hours by a nurse or a caregiver is physically demanding and labor intensive. Recent studies have reported that at the current level of funding and staffing, many immobile patients in American long-term care nursing facilities often are left to remain in the same position for up to four hours. An ideal solution that would provide quality patient care at current staffing levels is to develop an automatic mechanical device for repositioning a patient that would be as effective in pressure sore prevention as the manual turning every two hours by a nurse or a caregiver.

In response to the need to find an automatic rotational device that would periodically reposition an immobile patient, eight patented inventions since 1970 have been selected and cited here. Each one can alternately tilt a patient on an incline from side to side by utilizing right and left elongated inflatables to laterally raise alternate longitudinal sides of the surface upon which the patient lies.

In FIG. 1-A through FIG. 1-H, a prior drawing from each of these eight patented inventions shows the angle of incline and method used in tilting a patient. The slope of the angles ranges from approximately 15 to 32 degrees. The following drawings of the eight prior inventions are listed in chronological order.

| | | | |
|---|---|---|---|
| FIG. 1-A | 3,717,885, | Feb. 27, 1973, | De Mare, "Clinical Manipulator." |
| FIG. 1-B | 3,775,781, | Dec. 4, 1973, | Bruno et al., "Patient Turning Apparatus." |
| FIG. 1-C | 3,895,403, | Jul. 22, 1975, | Davis, "Patient Orienting Device." |
| FIG. 1-D | 4,934,002, | Jun. 19, 1990, | Watanabe, "Tiltable Mat Assembly." |
| FIG. 1-E | 5,092,007, | Mar. 3, 1992, | Hasty, "Air Mattress Overlay for Lateral Patient Roll." |
| FIG. 1-F | 5,121,512, | Jun. 16, 1992, | Kaufmann, "Auxiliary Inflatable Device Serving Mattress." |
| FIG. 1-G | 6,154,900, | Dec. 5, 2000, | Shaw, "Patient Turning Apparatus." |
| FIG. 1-H | 6,253,402, | Jul. 3, 2001, | Lin, "Air Bed Structure Capable of Lying Thereon on Either of One's Sides." |

Currently, there are on the market a number of rotational air mattresses that can alternately tilt a patient to lie on an approximate 30-degree incline. In terms of repositioning, the alternate tilting of a patient is certainly more effective in reducing the incidence of pressure sores than having a patient lie continuously upon the flat, horizontal surface of a stationary, non-tilting mattress. In all of those eight rotational devices, and in all such devices on the market today, the patients alternately lie on an incline until tilted to the other side with their legs flat and in a straight position.

Even when a patient has been alternately tilted automatically, some wound care specialists recommend that the patient should still be turned manually. An optimum automatic repositioning device is one that would have immobile patients alternately turned from one complete side to the other in a manner similar to the manual turning by a nurse or caregiver where the patient, until turned to the opposite side, would lie on a flat mattress with a pillow between their bent knees and legs, and a pillow supporting the back. The present invention uses an innovative technology making it the only device that can automatically perform such periodic repositioning that would preclude the necessity of having the patient turned manually.

The turning process of the Automatic Patient Turner is slow and gentle, and it takes approximately three minutes. When a patient lies on his or her side, there is no pressure on the back, buttocks, or heels, three areas of the body where pressure sores are more likely to develop. There are two options relative to the turning cycle. One is to have the patient lie on one side for no more than one hour and then be turned to the other side. The other option is having the patient lie for no more than an hour on one side, no more than an hour on his or her back, and no more than an hour on the other side.

An automatic turn performed by the Automatic Patient Turner is, in some ways, even superior to manual turning because it is gentler, less intrusive, and less abrasive. The manual turning of a patient is intrusive, whereas the turning process of the Automatic Patient Turner is so slow and gentle that it will not wake the average sleeping patient. The patient will then have a full night of uninterrupted sleep, an important factor in the well being of the patient. Secondly, automatic turning is significantly less abrasive than manual turning because no sliding of the patient across the surface of the mattress is involved.

Since the present invention can gently turn a patient from one complete side to the other every hour in a manner similar to, and is some ways even better than, the manual turning by a nurse or caregiver, it would not be an overstatement to say that for immobile, bedridden patients, the Automatic Patient Turner shows great promise of being the ultimate in pressure sore prevention.

A BRIEF DESCRIPTION OF THE INVENTION

Since on rotational, patient-tilting mattresses, immobile patients lie along the center longitudinal axis of the mattress with their legs straight and in a flat position, such mattresses can only alternately tilt the patient rather than turning the patient from one complete side to the other. The salient feature of the Automatic Patient Turner that totally differentiates it from devices that can only tilt a patient, is having the bent knees of the patient serve as a lever arm in turning the patient from one complete side to the other. In preparing for the turning process, a nurse or caregiver is to raise and bend the knees of the patient to form the apex of an inverted V. It is this innovative and unique feature of the present invention that makes it technically possible to have the patient turned from a tilt position to one complete side.

The coordinated, patterned, and sequential inflation and deflation of three pairs of strategically-placed inflatables are necessary to turn a patient from a tilt position. Each pair has a right and left inflatable at a separate location. While the entire operation of turning a patient from one complete side to the other can be accomplished by the use of only one inflatable at each of the six locations, the term "at least one" will be used, especially in the claims section of this disclosure. However, to enhance clarity, in less formal sections of this disclosure, only one inflatable at each location may be mentioned.

A Pair of Knee Inflatables: Knee inflatables (6 and 7) are the first and most important pair of inflatables used in the turning process. On the top surface of a mattress (2) is attached at least one inflatable positioned on the outer side of the patient's bent right knee; henceforth referred to as a right knee inflatable (6). On the top surface of that same mattress (2) is attached at least one inflatable positioned on the outer side of the patient's bent left knee, and henceforth referred to as the left knee inflatable (7). When these knee inflatables (6 and 7) are fully inflated, they stand firmly in a perpendicular position relative to the mattress (2) in a horizontal position. Since the right knee inflatable (6) and the left knee inflatable (7) are positioned on opposite sides of the patient's bent knees (1), the full inflation of both knee inflatables (6 and 7) will raise the bent knees that are sandwiched between those inflatables to a perpendicular position. Since the length of a knee inflatable is parallel to the longitudinal side of the mattress, its length must be sufficient to accommodate patients of varying size.

To have the bent knees (1) that are sandwiched between the fully inflated knee inflatables (6 and 7) move in the direction of the turn, pressure must be exerted against the outer side of a fully inflated knee inflatable (6 or 7). At the same time, the knee inflatable (6 or 7) on the other side of the bent knees (1) must gradually deflate in order to vacate space so the bent knees (1) will be able to move in the direction of the turn when pressure is exerted against the fully inflated knee inflatable (6 or 7).

When the bent knees (1) have moved to the point where they are well beyond their original perpendicular position, the fully inflated inflatables that directly or indirectly pushed the bent knees (1) in the direction of the turn have fulfilled their function and begin to deflate. The bent knees (1) are now resting upon the opposite knee inflatable (6 or 7) that was already deflating in order to vacate space so the bent knee (1) could move in the direction of the turn. As that knee inflatable (6 or 7) continues to deflate, the bent knees (1) gradually descend due to the force of gravity. Acting as a lever arm, the bent knees (1) laterally pull the entire body of the patient completely to one side, where, until turned to the other side, the patient will lie on a flat mattress (2).

The sole function of a pair of knee inflatables (6 and 7) is to be of sufficient size to bring the bent knees (1) that are sandwiched between those inflatables to a perpendicular position. To move the patient in the direction of the turn from a perpendicular position, another pair of inflatables is necessary to directly or indirectly exert pressure upon the bent knees (1).

The right and left knee inflatables (6 and 7) cited in this section of the disclosure can be attached to either of the following two different types of mattresses: 1) a rotational, patient-tilting mattress and 2) a stationary non-patient-tilting mattress. While at least one pair of knee inflatables (6 and 7) is used in both embodiments, each of the two embodiments uses a different method to exert the pressure necessary to move the bent knees (1) in the direction of the turn The Pair of Inflatables Used in Embodiment A: In embodiment A, the patient lies upon a rotational, patient-titling mattress (2) where at least one elongated inflatable is placed beneath the right longitudinal side of the mattress (2) upon which the patient lies; henceforth, this inflatable is referred to as the right elongated inflatable (4). At least one elongated inflatable is placed beneath the left longitudinal side of the mattress (2) upon which the patient lies; henceforth, this inflatable is referred to as the left elongated inflatable (5).

Pressure upon the right or the left knee inflatable (6 or 7) in embodiment A is exerted directly by the raising of alternate longitudinal sides of the mattress (2), and indirectly by the alternate inflation of the elongated inflatable (4 or 5) beneath that longitudinal side. The gradual elevation of one longitudinal side of the mattress (2) will slowly exert pressure against the fully inflated knee inflatable (6 or 7) slated to remain inflated, moving the bent knees (1) beyond their perpendicular position, and leading to their descent in the direction of the turn.

There already exist on the market rotational devices that only tilt the patient. This is done by the raising of alternate longitudinal sides of the surface upon which the patient lies by using at least one elongated inflatable beneath each longitudinal side. Therefore, while the raising and lowering of alternate longitudinal sides of a mattress will be mentioned in claim 1 because they exert pressure upon the bent knees (1), claim 1 only applies to the attachment of knee inflatables (6 and 7) upon the top surface of a rotational mattress as a major improvement enabling it not only to alternately tilt, but to completely turn the patient.

The Pair of Inflatables Used in Embodiment B: In embodiment B, the patient lies upon a flat, non-patient-tilting mattress (2). At least one inflatable is attached to the mattress (2) and located adjacent to the patient-side of the right knee inflatable (6); henceforth, this inflatable is referred to as the right knee pressure-exerting inflatable (10). At least one inflatable is attached to the mattress (2) and located adjacent to the patient-side of the left knee inflatable (7); henceforth, this inflatable is referred to as the left knee pressure-exerting inflatable (11).

When one of the knee inflatables (6 or 7) is fully inflated and perpendicular relative to the flat, non-patient-tilting mattress (2), the actual turning process will begin by the inflation of a knee pressure-exerting inflatable (10 or 11) adjacent to an inflated knee inflatable (6 or 7) that is slated to remain inflated. As that knee pressure-exerting inflatable (10 or 11) continues to inflate, it will then increasingly exert pressure against the bent knees (1), moving them beyond their perpendicular position leading to their descent in the direction of the turn.

A pair of back-support inflatable pillows. The third pair of inflatables used in the turning process is designed to support the patient's back during and following the turning process. At least one inflatable is attached to the mattress (2) and located beneath the right side of the patient's back; henceforth, this inflatable is referred to as the right back-support inflatable (8). At least one inflatable is attached to the mattress (2) and located beneath the left side of the patient's back; henceforth, this inflatable is referred to as the left back-support inflatable (9). Since the length of a back-support inflatable is parallel to the longitudinal side of the mattress, its length must be sufficient to accommodate patients of varying size. As the bent knees (1) begin to move beyond their perpendicular position, the back-support inflatable (8 or 9) that is on the same longitudinal side of the mattress (2) as the fully inflated knee inflatable (6 or 7) will gradually inflate. That gradually inflating back-support inflatable (8 or 9) will slowly tilt the back of the patient in the direction of the turn. This will align the patient's back with the entire backside of the patient that is also moving in the direction of the turn. When fully inflated, that back-support inflatable (8 or 9) will lend support to the patient's back as long as the patient is fully turned to one side and continues to lie upon the flat mattress (2), until being turned to the other side.

THE NUMERALS USED IN THE DRAWINGS

For ready reference, a list of the numerals of the parts used in the disclosure, drawings, and claims is hereby provided. For each part listed, its function and role in the operation of the invention is delineated. Moreover, each part mentioned in this section will be followed by one of the following three notations: 1) E-A, a part used only in Embodiment A, 2) E-B, a part used only in Embodiment B, and 3) E-A & E-B, a part that is used in both embodiments.

It should be noted that each knee and back-support inflatable is a two-part inflatable comprising a main section and a pneumatically-attached companion inflatable that acts as a bolster. The purpose of a fully inflated companion bolster is to lend support to the main inflatable, ensuring that even when pressure is exerted upon the main section of the inflatable, it will remain in a perpendicular position.

The following is a numerical list of the parts mentioned and included in the disclosure, drawings and claims.

(1)—Bent knees of the patient [E-A & E-B]. The bent knees of the patient are shown at different angles during the turning process, indicating the changing position of the patient. The bent knees (1) act as a lever arm in the turning process.

(2)—The mattress upon which the patient lies [E-A & E-B]. In embodiment A, the patient lies upon a rotational, patient-tilting air mattress (2). In embodiment B, the patient lies upon a flat, stationary, non-patient-tilting mattress (2).

(3)—Chamber for the elongated inflatables [E-A]. Encased within the bottom of the rotational, patient-tilting air mattress is a chamber (3) that houses at least one right elongated inflatable (4) and at least one left elongated inflatable (5). Each elongated inflatable is placed beneath and along its respective longitudinal side of the rotational, patient-tilting air mattress (2).

(4)—Right elongated inflatables [E-A]. At least one right elongated inflatable (4) is located in the chamber (3) beneath the right longitudinal side of the rotational, patient-tilting air mattress (2). When a right elongated inflatable (4) is inflated, it raises the right longitudinal side of the rotational, patient-tilting air mattress (2).

(5)—Left elongated inflatable(s) [E-A]. At least one left elongated inflatable (5) is located in the chamber (3) beneath the left longitudinal side of the rotational, patient-tilting air mattress (2). When a left elongated inflatable (5) is inflated, it raises the left longitudinal side of the rotational, patient-tilting air mattress (2).

(6)—Right knee inflatable(s) each with a bolster [E-A & E-B]. At least one right knee inflatable (6) is attached to the top surface of the mattress (2) upon which the patient is lying, and it is located on the right side of the patient's bent knees (1). The inflation of at least one right knee inflatable (6) together with the inflation of at least one left knee inflatable (7), raise the bent knees (1), that are sandwiched between those inflatables (6 and 7), to a perpendicular position relative to the flat mattress (2).

(7)—Left knee inflatable(s) each with a bolster [E-A & E-B]. At least one left knee inflatable (7) is attached to the top surface of the mattress (2) upon which the patient is lying, and it is located on the left side of the patient's bent knees (1). The inflation of at least one left knee inflatable (7), together with the inflation of at least one right knee inflatable (6, raise the bent knees (1) that are sandwiched between those inflatables (6 and 7) to a perpendicular position relative to the flat mattress (2).

(8)—Right back-support inflatable(s) with a bolster [E-A & E-B]. At least one right back-support inflatable (8) is located beneath the right side of the patient's back and attached to the top surface of the mattress (2) upon which the patient is lying. When pressure is exerted upon at least one right knee inflatable (6), the patient is beginning to be turned to his or her left side. Then, at least one right back-support inflatable (8) will begin to inflate, pushing the right side of the patient's back in the direction of a turn to the left. This will ensure that the back is on the same alignment as the entire backside of the patient. Upon the completion of a turn to the left, at least one right back-support inflatable (8) continues to remain inflated to lend support to the patient's back while the patient is lying on his or her left side on a flat mattress (2). Approximately an hour later, when the patient is returning to the right side, the support given by the right back-support inflatable (8) will gradually diminish as it deflates, and the patient will then lie on his or her back until turned to his or her right-side.

(9)—Left back-support inflatable(s) each with a bolster [E-A & E-B]. At least one left back-support inflatable (9) is located beneath the left side of the patient's back and attached to the top surface of the mattress (2) upon which the patient is lying When pressure is exerted upon at least one left knee inflatable (7), the patient is beginning to be turned to his or her right side. Then, at least one left back-support inflatable (9) will begin to inflate, pushing the left side of the patient's back in the direction of a turn to the right. This will ensure that the back is on the same alignment as the entire backside of the patient. Upon the completion of a turn to the right, at least one left back-support inflatable (9) continues to remain inflated to lend support to the patient's back while the patient is lying on his or her right side on a flat mattress (2). Approximately an hour later, when the patient is returning to the left side, the support given by the left back-support inflatable (9) will gradually diminish as it deflates, and the patient will then lie on his or her back until turned to his or her left side.

(10)—Right knee pressure-exerting inflatable(s) [E-B]. At least one right knee pressure-exerting inflatable (10) is attached to the stationary, non patient-tilting mattress (2), and is located adjacent to the patient-side of the right knee inflatable (6). The function of the right pressure-exerting inflatable (10) is to exert pressure upon the bent knees (1) in order to move them to the left.

(11)—Left knee pressure-exerting inflatabel(s) [E-B]. At least one left knee pressure-exerting inflatable (11) is attached to the stationary, non patient-tilting mattress (2), and is located adjacent to the patient-side of the left knee inflatable (7). The function of the left pressure-exerting inflatable (11) is to exert pressure upon the bent knees (1) in order to move them to the right.

(12)—Bed or hospital bed [E-A & E-B]. In order to automatically turn a patient from one complete side to the other, the mattress needs to be wider than a standard hospital bed mattress. Therefore, a wider hospital bed or attachments to widen a standard size hospital bed will be necessary.

Not shown in any of the drawings is the tubing that connects the inflatables to the control box containing the equipment that operates the system. Among the major items in the control box are at least one microprocessor, a circuit board, and one or more compressors with pressure and vacuum ports, solenoid valves, pressure and vacuum switches, sensors, and an isolation transformer.

Also not shown in any of the drawings is the control panel. Among the items on the panel are the following switches: power, off/on, automatic turn, non-automatic turn, right turn, left turn, tilt right, tilt left, flat, reset, and monitor. Also on the panel are LEDs, an LCD or a similar display, and a beeper. The sound of a beeper and the blinking light in the reset push button are designed to alert the nurse or caregiver to read the message on the display. To acknowledge having read the message, the nurse or caregiver is to clear the message by pressing the blinking, lighted reset push button that will then terminate the blinking and the beeping.

LISTING OF THE DRAWINGS OF THE PRESENT INVENTION

FIG. 1-A through FIG. 1-H are prior art drawings. The remaining figures, from FIG. 2-A through FIGS. 30-A & B, refer to the present invention. Various patterns are used to differentiate the inflatables that appear in the drawings of the current invention. The elongated inflatables (4 and 5) located beneath each longitudinal side of the mattress (2), the knee inflatables (6 and 7) attached to the top surface of the mattress (2) and located on each side of the patient's bent knees (1), and the pressure-exerting inflatables (10 and 11) attached to the top surface of the rotational, patient-tilting mattress (2) and located adjacent to the patient side of the knee inflatables (6 and 7) all have a dot pattern. The back-support inflatables (8 and 9) that are attached to the top surface of the mattress (2) and located beneath each side of the patient's back have a criss-cross pattern.

The density of the dot pattern or criss-cross pattern indicates if an inflatable is in the process of inflation, or is fully inflated, or is in the process of deflation. A denser pattern denotes inflation, while a less dense pattern indicates that the inflatable is in the process of deflation.

All of the figures relative to the current invention, except for FIG. 3-A and FIG. 3-B, are foot-of-the-bed views of the mattress (2). The rotational, patient-tilting air mattress (2) has a waterproof covering that encases both the mattress itself (2) and the elongated inflatables (4 and 5). The outline of parts that are encased by the waterproof covering and, therefore, not visible are represented in the drawings by the use of broken lines.

Embodiment A drawings have the letter A following the figure number, and embodiment B drawings have the letter B following the figure number. Drawings that are essentially common to both embodiments have the letters A & B following the figure number. It should be pointed out that in those drawings, the air mattress used in embodiment A is an encased rotational, patient-tilting air mattress (2). Since the mattress itself (2) and the knee inflatables (6 and 7) are not visible because they are encased within the rotational mattress as a complete unit, they are depicted in the drawing by the use of broken lines. The mattress used in embodiment B is stationary and non-patient-tilting. Since that mattress is visible, it is depicted in the drawings with lines that are not broken. Rather than have separate drawings for each of the two embodiments where every other element is the same, the lines depicting the mattress shown in figure numbers followed by an A&B will be broken.

FIG. 2-A: A foot-of-the-bed view of the top surface of the rotational, patient-tilting mattress (2) showing the location of a pair of elongated inflatables (4 and 5), a pair of knee inflatables (6 and 7), and a pair of back-support inflatables (8 and 9). When deflated, an inflatable is thin, flat, and not very noticeable. In FIG. 2-A as well in FIG. 2-B, the thickness of the six deflated inflatables has been greatly exaggerated so that their location can be readily noted. In all of the other drawings, a fully deflated inflatable will not be seen.

FIG. 2-B: A foot-of-the-bed view of the top surface of the stationary, non patient-tilting mattress (2) showing the location of a pair of knee inflatables (6 and 7), a pair of pressure-exerting inflatables (10 and 11), and a pair of back-support inflatables (8 and 9).

FIG. 3-A: A right-side view of the rotational, patient-tilting mattress showing the location of the right and left knee inflatables (6 and 7), and the right and left back-support inflatables (8 and 9), all located and securely attached to the top surface of the rotational, patient-tilting mattress (2). The right and left knee inflatables (6 and 7) and the right and left back-support inflatables (8 and 9), shown in FIG. 3-A, are shown semi-inflated for illustration purposes. While both the right and left knee inflatables (6 and 7) are at times inflated and deflated simultaneously, the back-support inflatables (8 and 9) are prevented from ever being inflated at the same time.

FIG. 3-B: A right-side view of the stationary, non-patient-tilting mattress showing the location of the right and left knee inflatables (6 and 7), and the right and left back-support inflatables (8 and 9), all located and securely attached to the top surface of the mattress (2). The right and left knee inflatables (6 and 7) and the right and left back-support inflatables (8 and 9), shown in FIG. 3-B, are shown semi-inflated for illustration purposes.

FIGS. 4-A&B: A patient lying along the center longitudinal axis of the hospital bed with bent knees (1) in a perpendicular position.

FIGS. 5-A&B: The right and left knee inflatables (6 and 7) begin to inflate and are shown one-quarter inflated.

FIGS. 6-A&B: The right and left knee inflatables (6 and 7) are shown half inflated.

FIGS. 7-A & B: The right and left knee inflatables (6 and 7) are shown three-quarters inflated.

FIGS. 8-A&B: The right and left knee inflatables (6 and 7) are now fully inflated, showing the bent knees (1) sandwiched between them in a perpendicular position.

FIGS. 9-A&B: The right knee inflatable (6) is fully inflated, and the left knee inflatable (7) is now shown in the deflation mode.

FIG. 10-A: The right elongated inflatable (4) is one-third inflated, showing the bent knees (1) having moved to the left due to the pressure exerted by the fully inflated right knee inflatable (6) upon the bent knees (1).

FIG. 10-B: The right knee inflatable (6) is fully inflated and perpendicular, and the bent knees (1) have moved to the left due to the pressure exerted upon the bent knees (1) by the gradual inflation of the right pressure-exerting knee inflatable (10).

FIG. 11-A: The right elongated inflatable (4) is two-thirds inflated, showing the bent knees (1) having moved further to the left.

FIG. 11-B: The right knee inflatable (6) is fully inflated and perpendicular, and the bent knees (1) have moved even further to the left due to the increasing pressure exerted upon the bent knees (1) by the right pressure-exerting knee inflatable (10).

FIG. 12-A: The right elongated inflatable (4) is now fully inflated, showing the bent knees (1) having moved to the left, well beyond their initial perpendicular position.

FIG. 12-B: The right pressure-exerting inflatable (10) is now fully inflated, showing the bent knees (1) having moved to the left, well beyond their initial perpendicular position.

FIG. 13-A: The right elongated inflatable (4) and the right and left knee inflatables (6 and 7) are now in a deflation mode and ready to deflate having brought the bent knees (1) to the point where they can descend on their own due to the force of gravity.

FIG. 13-B: The fully inflated right pressure-exerting inflatable (10) has brought the bent knees (1) to the point where they can descend on their own due to the force of gravity, where it and the knee inflatables (6 and 7) are now in a deflation mode and ready to deflate.

FIG. 14-A: The left knee inflatable (7) continues to deflate, allowing the bent knees (1) to further descend while the gradually inflating right back-support inflatable (8) continues to push the patient's back further to the left.

FIG. 14-B: The left knee inflatable (7) continues to deflate, allowing the bent knees (1) to further descend while the gradually inflating right back-support inflatable (8) continues to push the patient's back further to the left.

FIG. 15-A: The left knee inflatable (7) is seen almost fully deflated, allowing the bent knees (1) to fully descend aided by the pressure exerted upon the patient's back due to the right back-support inflatable (8) approaching full inflation.

FIG. 15-B: The left knee inflatable (7) is seen almost fully deflated, allowing the bent knees (1) to fully descend aided by the pressure exerted upon the patient's back due to the right back-support inflatable (8) approaching full inflation.

FIGS. 16-A&B: The patient has been fully turned to the left lying upon a flat mattress (2) with the fully inflated right back-support inflatable 'pillow' (8) lending support to the patient's back.

FIGS. 17-A&B: The right back-support inflatable (8) is now shown in a deflation mode, in preparation for the patient being turned to the right.

FIGS. 18-A&B: The right and left knee inflatables (6 and 7) begin to inflate where the left knee inflatable (7) gradually raises the bent knees (1) of the patient as the right back-support inflatable (8) gradually deflates.

FIGS. 19-A&B: The right and left knee inflatables (6 and 7) are shown one-fourth inflated where the left knee inflatable (7) has further raised the bent knees (1) in the direction of being turned to the right as the gradually deflating right back-support inflatable (8) provides space for the turn to the right.

FIGS. 20-A&B: The right and left knee inflatables (6 and 7) are shown one-half inflated where the left knee inflatable (7) has raised the bent knees (1) half way from their initial horizontal position to being perpendicular due to the space provided by the deflating right back-support inflatable (8).

FIGS. 21-A&B: The right and left knee inflatables (6 and 7) are shown three-quarters inflated where the left knee inflatable (7) has raised the bent knees (1) close to being in a perpendicular position as the right back-support inflatable (8) is in the final stages of deflation.

FIGS. 22-A&B: The right and left knee inflatables (6 and 7) are now shown fully inflated, with the bent knees (1) sandwiched between them in a perpendicular position.

FIGS. 23-A&B: The left knee inflatable (7) is still fully inflated, and the right knee inflatable (6) is now shown in a deflation mode.

FIG. 24-A: The left elongated inflatable (5) is one-third inflated showing the bent knees (1) having moved to the right due to the pressure exerted upon the knees by the fully inflated left knee inflatable (7) upon the bent knees.

FIG. 24-B: The left knee inflatable (7) is fully inflated and perpendicular, and the bent knees (1) have moved to the right due to the pressure exerted upon the bent knees (1) by the gradually inflating left pressure-exerting knee inflatable (11).

FIG. 25-A: The left elongated inflatable (5) is two-thirds inflated, showing the bent knees (1) having moved further to the right.

FIG. 25-B: The left knee inflatable (7) is fully inflated and perpendicular, and the bent knees (1) have moved even further to the left due to the increasing pressure exerted upon the bent knees (1) by the left pressure-exerting knee inflatable (11).

FIG. 26-A: The left elongated inflatable (5) is now fully inflated showing the bent knees (1) having moved to the right, well beyond their initial perpendicular position FIG. 26-B: The left pressure-exerting inflatable (11) is now fully inflated showing the bent knees (1) having moved to the right well beyond their initial perpendicular position.

FIG. 27-A: The left elongated inflatable (5) and the right and left knee inflatables (6 and 7) are now in the deflation mode and ready to deflate having brought the bent knees (1) to the point where they can descend on their own due to the force of gravity.

FIG. 27-B: The fully inflated left pressure-exerting inflatable (11) has brought the bent knees (1) to the point where they can descend on their own due to the force of gravity, where it and the knee inflatables (6 and 7) are now in a deflation mode and ready to deflate.

FIG. 28-A: The right knee inflatable (6) continues to deflate, allowing the bent knees (1) to further descend while the gradually inflating left back-support inflatable (9) continues to push the patient's back further to the right.

FIG. 28-B: The right knee inflatable (6) continues to deflate, allowing the bent knees (1) to further descend while the gradually inflating left back-support inflatable (9) continues to push the patient's back further to the right.

FIG. 29-A: The right knee inflatable (6) is seen almost fully deflated, allowing the bent knees (1) to fully descend aided by the pressure exerted upon the patient's back due to the left back-support inflatable (9) approaching full inflation.

FIG. 29-B: The right knee inflatable (6) is seen almost fully deflated, allowing the bent knees (1) to fully descend aided by the pressure exerted upon the patient's back due to the left back-support inflatable (9) approaching full inflation.

FIGS. 30-A&B: The patient has been fully turned to the right lying upon a flat mattress (2) with the fully inflated left back-support inflatable 'pillow' (9) lending support to the patient's back.

DETAILED DESCRIPTION OF THE INVENTION

Each stage of the turning process, beginning with FIGS. 5-A&B, is represented by a static figure showing the end of that stage. A discussion of each subsequent figure will point out what changes took place following the previous figure. The discussion will include not only the changes in the inflation and deflation of the various inflatables, but also the effect those changes have in moving the bent knees (1) of the patient, and hence the patient, in the direction of the turn. The turning process involves several phases, each of which will be discussed in chronological order.

Preparing the patient for the automatic turn mode. Other than the periodic monitoring of the patient, the assistance of a nurse or caregiver is necessary only with the commencing and terminating of the automatic turning mode. Prior to the start of the turning process, the patient must be placed along the longitudinal center of the mattress (2). The arms of the patient are to be folded and placed upon the chest. To illustrate and demonstrate the turning process, a patient will now be turned to the left. The nurse or caregiver must press the automatic turn push button, and then the left turn push button; both are on the control panel.

The bent knees are to be sandwiched between a pair of knee inflatables. When the automatic turn and left turn push buttons are pressed, the right knee and left knee inflatables (6 and 7) gradually begin to inflate. The nurse or caregiver must now raise and bend the knees of the patient to form the apex of an inverted V and place a pillow between the knees and legs; see FIGS. 4-A&B. The bent knees (1) are to be held in a perpendicular position by the nurse or caregiver until the right and left knee inflatables (6 and 7) are fully inflated. The nurse or caregiver should remain and monitor the initial turn. Once that initial turn has been successfully completed, the nurse or caregiver may leave, but should return hourly to monitor the patient. The inflation of the two knee inflatables (6 and 7) is shown in FIGS. 5-A&B through FIGS. 7-A&B at various stages of inflation: one-quarter, one-half, and then three-quarters inflated, respectively.

When, in FIGS. 8-A&B, the two encased knee inflatables (6 and 7) are fully inflated, it is no longer necessary for the nurse or caregiver to hold the bent knees (1) of the patient in place because the bent knees (1) are now 'locked in place' in a perpendicular position by being sandwiched between the two fully inflated knee inflatables (6 and 7).

Preparing the bent knees to move left from being perpendicular—Embodiment A&B. In preparing the bent knees (1) to move left from being in a perpendicular position, the right knee inflatable (6) remains fully inflated while the left knee inflatable (7) changes from an inflation to a deflation mode; see FIGS. 9-A&B.

Moving the bent knees to the left from being perpendicular—Embodiment A. It should be pointed out that the use of the terms 'right' and 'left' are from the perspective of the patient lying in bed as well as the direction of the movement of the patient during the turning process, but not from the perspective of the viewer at the foot of the bed. The bent knees (1) gradually move to the left as the right longitudinal side of the rotational, patient-tilting mattress (2) begins to rise slowly due to the gradual inflation of the right elongated inflatable (4) located beneath the right longitudinal side of the mattress (2). In FIG. 10-A, the right longitudinal side of the mattress is on an approximate 25° incline when the right elongated inflatable (4) is one-third inflated. As the right longitudinal side of the rotational mattress (2) gradually rises, the fully inflated right knee inflatable (6) exerts pressure on the bent knees (1) that are sandwiched between the knee inflatables (6 and 7). The left knee inflatable (7) continues to deflate making room for the bent knees to move to the left. Though not visible in the figure, the right back-support inflatable (8) also begins to inflate.

Moving the bent knees to the left from being perpendicular—Embodiment B. The bent knees (1) move to the left as the right pressure-exerting inflatable (10) gradually inflates, exerting pressure upon the bent knees (1). In FIG. 10-B, the right pressure-exerting inflatable (10) is one-third inflated. The left knee inflatable (7) continues to deflate making room for the bent knees to move to the left. The right back-support inflatable (8) is seen in the early stages of inflation.

Moving the bent knees further to the left—Embodiment A. As the right elongated inflatable (4) continues to inflate, it causes the right longitudinal side of the rotational, patient-tilting mattress (2) to be on an even greater incline. The greater the incline, the more pressure is exerted on the knee inflatables (6 and 7), moving them further to the left. Since the bent knees are sandwiched between the two knee inflatables (6 and 7), they not only move further to the left, but they also begin to descend in the direction of the turn as the left knee inflatable (7) deflates. The inflation of the right back-support inflatable (8) is now visible. Its purpose is to ensure that while the patient is being turned to the left, the back of the patient is on the same incline as the bent knees (1). In FIG. 11-A, the right elongated inflatable (4) is two-thirds inflated.

Moving the bent knees further to the left—Embodiment B. As the right pressure-exerting inflatable (10) continues to inflate, it causes the knee inflatables (6 and 7) to move even further to the left. Since the bent knees (1) are sandwiched between the two knee inflatables (6 and 7), they not only move further to the left, but they also descend in the direction of the turn as the left knee inflatable (7) deflates. The right back-support inflatable (8) continues to inflate. Its purpose is to ensure that while the patient is being turned to the left, the back of the patient is on the same incline as the bent knees (1). In FIG. 11-B, the right pressure-exerting inflatable (10) is two-thirds inflated.

The slope of the right side of the rotational mattress has reached its maximum incline—Embodiment A. When the right elongated inflatable (4) is fully inflated, the slope of the right longitudinal side of the rotational mattress (2) has reached its maximum incline. The fully inflated right knee inflatable (6) has pushed the bent knees (1) well beyond their initial perpendicular position where the inflation of the right back-support inflatable (8) is coordinated so the back of the patient and the bent knees (1) are aligned; see FIG. 12-A.

The right pressure-exerting inflatable (10) is now fully inflated.—Embodiment B. When the right pressure-exerting inflatable (10) is fully inflated, it has pushed the bent knees well beyond their initial perpendicular position while the inflation of the right back-support inflatable (8) is coordinated so the back of the patient and the bent knees (1) are aligned; see FIG. 12-B.

The right elongated inflatable (4) and the right knee inflatable (6) have fulfilled their function of moving the bent knees (1) well beyond their initial perpendicular position. Therefore, both the right elongated inflatable (4) and the right knee inflatable (6) are ready to deflate; see FIG. 13-A.

The right pressure-exerting inflatable (10) has fulfilled its function of having moved the bent knees (1) well beyond their initial perpendicular position. Therefore, both the right knee inflatable (6) and the right pressure-exerting inflatable (10) are in the deflation mode and ready to deflate; see FIG. 13-B.

The bent knees are in the process of fully descending—Embodiment A. The gradual inflation of the right back-support inflatable (8) continues to push the back of the patient as well as the entire body of the patient even further to the left. This is to ensure that the back will remain on the same degree of incline as the bent knees (1) that are descending due to the deflation of the left knee inflatable (7) and the force of gravity. During the descent, the entire body of the patient is pulled to the left; see FIG. 14-A.

The bent knees are in the process of fully descending—Embodiment B. The gradual inflation of the right back-support inflatable (8) continues to push the patient's back as well as the entire body of the patient even further to left. This is to ensure that the patient's back will remain on the same degree of incline as the bent knees (1) that are descending due to the deflation of the left knee inflatable (7) and the force of gravity. During the descent, the entire body of the patient is pulled to the left; see FIG. 14-B.

In FIG. 15-A, as the left knee inflatable (7) approaches total deflation, the bent knees (1) are in the final stages of descending. Consequently, the entire body of the patient is in the final stages of being turned to the patient's left side. The right back-support inflatable (8), approaching full inflation, will then serve as a 'pillow' lending support to the back.

In FIG. 15-B, as the left knee inflatable (7) approaches total deflation, the bent knees (1) are in the final stages of descending. Consequently, the entire body of the patient is in the final stages of being turned to the patient's left side. The right back-support inflatable (8), approaching full inflation, will then serve as a 'pillow' lending support to the back.

The patient has been fully turned to the left side—Embodiments A&B. Relative to embodiment A, the complete deflation of the right elongated inflatable (4) has returned the right longitudinal side of the rotational mattress (2) to its original horizontal position. Furthermore, with the deflation of the knee inflatables (6 and 7), the patient is now lying on his or her left side upon a horizontal mattress (2) with a pillow between the bent knees (1) and legs, and the fully inflated right back-support inflatable (8) serving as a 'pillow' lending support to the patient's back.

Relative to embodiment B, with the complete deflation of the right pressure-exerting inflatable (10), and the knee inflatables (6 and 7), the patient is lying on his or her left side upon a flat mattress (2) with a pillow between the bent knees (1) and legs, and the fully inflated right back-support inflatable (8) serving as a 'pillow' lending support to the patient's back; see FIGS. 16-A&B. The patient has now been turned in a manner similar to the manual turning by a nurse or caregiver.

Returning the bent knees to a perpendicular position—Embodiments A&B. After approximately one hour, it is time for the patient to be automatically turned to the right with the bent knees (1) being raised from a horizontal to a perpendicular position. This is accomplished by coordinating the deflation of the right back-support inflatable (8) with the inflation of both the right and left knee inflatables (6 and 7). In FIGS. 17-A&B, the right back-support inflatable (8) is in the deflation mode and now ready to deflate.

Shown in FIGS. 18-A&B to FIGS. 22-A&B is the process of raising the bent knees (1) from a horizontal to a perpendicular position by the coordinated deflation of the right back-support inflatable (8) with the inflation of the right and left knee inflatables (6 and 7). It is really only the left knee inflatable (7) that actually raises the bent knees (1). The coordination of these two pneumatic processes shown in FIGS. 18-A&B to FIGS. 22-A&B by the gradual deflation of the right back-support inflatable (8) and five stages in the inflation of the right and left knee inflatables (6 and 7) in the following order: slightly inflated, one-fourth inflated, half inflated, three-quarters inflated, and then fully inflated. When fully inflated, the bent knees (1) are 'locked in place,' sandwiched between the two knee inflatables (6 and 7).

Preparing the bent knees to move right from being perpendicular—A&B. In preparing the bent knee (1) to move right from being in a perpendicular position, the left knee inflatable (7) remains fully inflated while the right knee inflatable (6) changes from an inflation to a deflation mode; see FIGS. 23-A&B.

Moving the bent knees to the right from being perpendicular—Embodiment A. The bent knees (1) gradually move to the right as the left longitudinal side of the rotational, patient-tilting mattress (2) begins to rise slowly due to the gradual inflation of the left elongated inflatable (5) located beneath the left longitudinal side of the mattress (2). In FIG. 24-A, the left longitudinal side of the mattress is on an approximate 25 degree incline when the left elongated inflatable (5) is one-third inflated. As the left longitudinal side of the rotational mattress (2) gradually rises, the fully inflated encased left knee inflatable (7) exerts pressure on the bent knees (1) that are sandwiched between the knee inflatables (6 and 7). The right knee inflatable (6) continues to deflate, making room for the bent knees to move to the right. Though not visible in the figure, the left back-support inflatable (9) also begins to inflate.

Moving the bent knees to the right from being perpendicular—Embodiment B. The bent knees (1) move to the right as the left pressure-exerting inflatable (11) gradually inflates, exerting pressure upon the bent knees (1). In FIG. 24-B, the left pressure-exerting inflatable (11) is one-third inflated. The right knee inflatable (6) continues to deflate, making room for the bent knees to move to the right. The left back-support inflatable (9) is seen in the early stages of inflation.

Moving the bent knees further to the right—Embodiment A. As the left elongated inflatable (5) continues to inflate, it causes the left longitudinal side of the rotational, patient-tilting mattress (2) to be on an even greater incline. The greater the incline, the more pressure is exerted on the knee inflatables (6 and 7) moving them further to the right Since the bent knees (1) are sandwiched between the two knee inflatables (6 and 7), they not only move further to the right, but they also descend in the direction of the turn as the right knee inflatable (6) deflates. The inflation of the left back-support inflatable (9) is now visible. Its purpose is to ensure that while the patient is being turned to the right, the back of the patient is on the same incline as the bent knees (1). In FIG. 25-A, the left elongated inflatable (5) is two-thirds inflated.

Moving the bent knees further to the right—Embodiment B. As the left pressure-exerting inflatable (11) continues to inflate, it causes the knee inflatables (6 and 7) to move even further to the right. Since the bent knees (1) are sandwiched between the two knee inflatables (6 and 7), they not only move further to the right, but they also descend in the direction of the turn as the right knee inflatable (6) deflates. The left back-support inflatable (9) continues to inflate. Its purpose is to ensure that while the patient is being turned to the right, the back of the patient is on the same incline as the bent knees (1). In FIG. 25-B, the left pressure-exerting inflatable (11) is two-thirds inflated.

The slope of the left side of the rotational mattress has reached its maximum incline—Embodiment A. When the left elongated inflatable (5) is fully inflated, the slope of the left longitudinal side of the rotational mattress (2) has reached its maximum incline. The fully inflated left knee inflatable (7) has pushed the bent knees (1) well beyond their initial perpendicular position where the inflation of the left back-support inflatable (9) is coordinated so the back of the patient and the bent knees (1) are aligned; see FIG. 26-A.

The left pressure-exerting inflatable (11) is now fully inflated—Embodiment B. When the left pressure-exerting inflatable (11) is fully inflated, it has pushed the bent knees well beyond their initial perpendicular position while the inflation of the left back-support inflatable (9) is coordinated so the back of the patient and the bent knees (1) are aligned; see FIG. 26-B.

The left elongated inflatable (5) and the left knee inflatable (7) have fulfilled their function of have moved the bent knees (1) well beyond their initial perpendicular position. Therefore, both the left elongated inflatable (5) and the left knee inflatable (7) are in the deflation mode and ready to deflate; see FIG. 27-A.

The left pressure-exerting inflatable (11) has fulfilled its function of having moved the bent knees (1) well beyond their initial perpendicular position. Therefore, both the left knee inflatable (7) and the left pressure-exerting inflatable (11) are in the deflation mode and ready to deflate; see FIG. 27-B.

The bent knees are in the process of fully descending—Embodiment A. The gradual inflation of the left back-support inflatable (9) continues to push the back of the patient as well as the entire body of the patient even further to the patient's right. This is to ensure that the patient's back will remain on the same degree of incline as the bent knees (1) that are descending due to the deflation of the to the right; see FIG. 28-A.

The bent knees are in the process of fully descending—Embodiment B. The left back-support inflatable (9), approaching full inflation, continues to push the patient's back, as well as the entire body of the patient, even further to the right. This is to ensure that the patient's back will remain on the same degree of incline as the bent knees (1) that are descending due to the deflation of the right knee inflatable (6) and the force of gravity. During the descent, the entire body of the patient is pulled to the right; see FIG. 28-B.

In FIG. 29-A, as the right knee inflatable (6) approaches total deflation, the bent knees (1) are in the final stages of descending. Consequently, the entire body of the patient is in the final stages of being turned to the patient's right side. The left back-support inflatable (9), approaching full inflation, will then serve as a 'pillow' lending support to the back.

In FIG. 29-B, as the right knee inflatable (6) approaches total deflation, the bent knees (1) are in the final stages of descending. Consequently, the entire body of the patient is in the final stages of being turned to the patient's right side. The left back-support inflatable (9), approaching full inflation, will then serve as a 'pillow' lending support to the back.

The patient has been fully turned to the right side—Embodiments A&B. Relative to embodiment A, the complete deflation of the left elongated inflatable (5) has returned the left longitudinal side of the rotational mattress (2) to its original horizontal position. Furthermore, with the deflation of the knee inflatables (6 and 7), the patient is now lying on his or her right side upon a horizontal mattress (2) with a pillow between the bent knees (1) and legs, and the fully inflated left back-support inflatable (9) serving as a 'pillow,' lending support to the patient's back.

Relative to embodiment B, with the complete deflation of the left pressure-exerting inflatable (11) and the knee inflatables (6 and 7), the patient is lying on his or her right side upon a flat mattress (2) with a pillow between the bent knees (1) and legs, and the fully inflated left back-support inflatable (9) serving as a 'pillow' lending support to the patient's back; see FIGS. 30-A&B. The patient has now been turned in a manner similar to the manual turning by a nurse or caregiver.

After lying on his or her right side for approximately an hour, the patient will then be automatically turned to the left. To accommodate the comfort level of patients of various sizes, the pressure in the back-support inflatable 'pillows' (8 and 9) can be adjusted. The automatic turning cycle will continue hourly until the nurse or caregiver presses the push button marked flat. To complete the entire turning cycle, it would be necessary to include an additional phase: 'Preparing the bent knees to move left from a horizontal to a perpendicular position.' The initial stage of the turning process begins with the patient's bent knees already placed in a perpendicular position. Consequently, there are no drawings showing the patient being turned from lying on the right side to the position where the bent knees (1) are in a perpendicular position. These drawings are not shown; however, they are mirror images of FIGS. 18-A&B to FIGS. 22-A&B.

Terminating automatic turning: To terminate automatic turning, the nurse or caregiver has to press push button marked flat on the control panel. All inflated elongated inflatables (4 and 5) and all inflated back-support inflatables (8 and 9) will then deflate. However, the knee inflatables (6 and 7) are to remain either inflated or brought to full inflation. At the conclusion of these operations, the patient will lie on his or her back with the bent knees (1) sandwiched between the two fully inflated knee inflatables (6 and 7) in a perpendicular position.

Once the preceding operations are completed, the light in the reset push button will blink, alerting the nurse or caregiver to read the message on the display with a reminder to lower the bent knees (1) of the patient. To ensure that this responsibility is performed, the nurse or caregiver is to acknowledge the message by pressing the reset push button and then lowering the bent knees (1) of the patient to a flat position. After two minutes, the light in the reset push button will blink a second time. This is to verify that the nurse or caregiver did not leave the area without having lowered the patient's bent knees. Pushing the reset push button a second time will then terminate the blinking. If the reset push button is not pressed a second time within a three-minute period, beeping will alert the nurse or caregiver with a warning message to lower the patient's knees. Should the patient remain lying in a flat position for more than one hour, the light in the reset push button will blink, and a message on the display will alert the nurse or caregiver that it is time to turn the patient. If the reset push button is not pressed with ten minutes, the beeper will sound.

Additional Features

Tilting the patient: At times, patient care will require that the patient lie on an incline. In addition to automatic turning, there is the option of tilting the patient to a maximum of a 30-degree angle by first pressing the non-automatic push button and then either the right tilt or left tilt push button. It will also be possible to increase or decrease the slope of the incline. Should the patient remain on an incline for more than one hour, the sound of the beeper and the light in the reset push button will blink, alerting the nurse or caregiver to read the message on the display that it is time to turn the patient.

The non-automatic turn mode: When tubes or wires are attached to the body of the patient, the automatic mode must not be used; otherwise, there is the possibility that the tubes or wires may get tangled. In the event tubes or wires are attached to the body of the patient, it is still possible, if not advisable, to turn the patient using the non-automatic mode. In the non-automatic mode, the patient can only be turned once each time the nurse or caregiver presses the non-automatic turn push button and then either the right turn or left turn push button. The nurse or caregiver must be present to monitor each turn and to adjust the tubing or wires in the event they get tangled. Especially in the non-automatic mode, the turning of a patient with wires or tubing attached to the patient's body is a very serious responsibility on the part of the nurse or caregiver. To ensure that the nurse or caregiver does not leave the area before the turn is completed, there will be a single beep and the light in the reset push button will blink after the turn has been completed. The nurse or caregiver will then have one minute to press the reset push button. It is then the responsibility of the nurse or caregiver to make any necessary adjustments.

The Unique Advantages of the Automatic Patient Turner

At the time this application is being submitted, no device has been patented or put on the market that will laterally turn an immobile patient automatically, and periodically along the longitudinal axis of a bed from one side to the other in a manner similar to and in some ways even superior to the manual turning by a nurse or caregiver. It is highly unlikely that a high-risk patient who is gently turned hourly from one complete side to the other will ever develop a pressure sore. Automatic turning is significantly less abrasive and less intrusive than manual turning. The turn is slow, smooth, and so gentle that it will not even wake most sleeping patients, allowing for a full night of uninterrupted sleep.

It is tragic that millions of immobile patients worldwide are currently suffering from pressure sores since they are preventable if a patient is turned every two hours. This invention is not intended for the treatment of pressure sores once they develop. It is, however, the ultimate in pressure sore prevention. The Automatic Patient Turner can prevent the development of pressure sores in the highest risk category of patients. They are the millions of patients worldwide who are paralyzed stroke victims, spinal cord injury patients, and the very large numbers of elderly patients who are in the latter stages of dementia or Alzheimer's disease.

Aside from the humane aspects of this invention in preventing the development of pressure sores, the prevalence of pressure sores has an economic dimension that is immense. All of the estimates of the annual cost of treating pressure sores are in the billions of dollars. This is an unnecessary expenditure by the patient or the patient's family, insurance companies, health maintenance organizations, and especially government social service agencies. Since most of the patients with pressure sores are disabled, elderly, and of low income, a significant share of the cost of treatment is borne by government social service agencies. The one-time cost of providing an automatic patient turner to each immobile patient as an entitlement is insignificant compared to the tremendous cost arising from not solving the problem of pressure sores once and for all.

There would also be a great saving in reducing the work load and staff hours of those who are responsible for turning an immobile patient every two hours at a long-term care nursing facility. Two staff members are often required to turn patients every two hours. Especially at night when patients are asleep, automatic patient turning could necessitate having only one staff person make the rounds every hour just to monitor patients. To document that patients are being monitored hourly, the person making the rounds is to press the monitor button on the control panel of each patient.

An automatic patient turning device will now make it feasible for a family to care for an immobile loved one at home. The burden of having to manually turn a patient is a major factor discouraging patient home care, especially when the number of caregivers at home is limited. The cost of patient home care is significantly less than the cost at a nursing facility. There would be a tremendous saving to families and again to government social service agencies that pay the cost of long-term patient care at nursing facilities. Finally, a patient's mental health would be enhanced if he or she could remain at home among family. A device that would allow patient care at home rather than at a nursing facility is currently the policy of government social service agencies that pay for the care of a patient at a long-term care nursing facility.

Safety Features

In the area of ergonomics, automatic patient turning will greatly decrease the probability of a nurse or caregiver developing back problems resulting from the periodic manual turning of heavy, immobile patients. This problem is a serious, unnecessary, and avoidable work-related hazard leading to pain and the loss of work time, including some employees being placed on disability. Again, there is an additional economic dimension to this problem in terms of workers' compensation and the high insurance rates paid by hospitals and nursing facilities. The automatic turning of a patient is also in accord with the current government policy of using various mechanical devices in the moving and lifting of a patient, thereby precluding the nursing staff from having to perform those functions manually.

The care of an immobile patient is a grave responsibility on the part of the nursing staff or caregiver. It is for this reason that a warning system has been installed that will alert a nurse or caregiver whenever a patient remains in one position for more than one hour. To maximize accountability, a method of monitoring has also been incorporated into the system that can document the quality of patient care in areas that demand the assistance of a nurse or caregiver.

To detect any malfunction in the system itself, sensors are incorporated. A diagnostic test, designed to verify that all of the parts are in working order, will be performed each time the patient turner is turned on. Any failure in the system will sound a warning buzzer, and the light in the reset push button will blink. The cause of the failure will appear on a display. The immediate identification of the part or parts that had caused the malfunction will lessen downtime. Furthermore, the system will be automatically monitored for a possible failure as long as the power switch is on.

In the event that power to the unit has been accidentally disrupted, a battery operated auxiliary power supply will automatically enable the patient turner to change the system to a flat mode. At the same time, the nurse or the caregiver will be alerted by the sound of a beeper and a blinking light in the reset push button indicating that there is a message on the display.

Precautions

Though they are not shown in the drawings, padded side rails are to be attached to the hospital bed unless a jurisdiction has prohibited their use. This patient turner is safe for general use for immobile patients. Nevertheless, the condition of each patient is unique; therefore, the following label will be affixed on each device:

1) The Automatic Patient Turner should only be used by a patient upon the advice and written permission of the attending physician.
2) The bed or hospital bed should be sufficiently wide to properly accommodate the width of the Automatic Patient Turner mattress.
3) Unless prohibited, padded side rails should be attached to the hospital bed.
4) The automatic turn mode must never be used when wires or tubing are connected to the patient, The Automatic Patient Turner can be used in the non-automatic turn mode as each single turn is carefully monitored.

What is claimed is:

1. An automatic patient turning device, being a significant and major improvement on the conventional rotational, patient-tilting air mattress with only the capability of alternately and laterally tilting a patient to a maximum of a 45-degrees incline without having to strap the patient to the mattress, having now the ability, without strapping in the patient, of first laterally tilting and then safely turning from one complete side to the other, constituting a 180-degee turn, an immobile, bedridden patient in the high-risk category of developing pressure sores, lying along a generally longitudinal axis of a bed or hospital bed, comprising a right-back inflatable and a left-back inflatable and at least one right knee inflatable (6) attached to the top surface of a rotational, patient-tilting air mattress (2), and located on the right side of the patient's bent knees (1), and at least one left knee inflatable (7) attached to the top surface of a rotational, patient-tilting air mattress (2), and located on the left side of the patient's bent knees (1), where the said knee inflatables (6 and 7), being of sufficient length for accommodating the bent knee portion, but not the torso portion of patients of varying size when bringing the bent knees (1) to a perpendicular position relative to the mattress (2) in a horizontal position, thereby enabling the said bent knees (1), when sandwiched between the inflating knee inflatables (6 and 7), to serve as a lever arm in the turning process by alternately turning the patient from one complete side to the other when pushed by at least one said fully inflated knee inflatable (6 or 7), due to the raising of alternate longitudinal sides of the said rotational mattress (2), thereby moving the bent knees (1) well beyond their perpendicular position, causing them, while resting upon at least one deflating knee inflatable (6 or 7), to descend pulling the entire body of the patient in the direction of the turn, resulting, with the deflation of all said knee inflatables (6 and 7), and the lowering of both longitudinal sides of the said rotational, patient-tilting mattress (2), in having the patient at the end of the turning process lying on one side upon a flat surface until turned to the other side.

2. The automatic patient turning device of claim 1 wherein said back-support inflatables comprise at least one right back-support inflatable pillow (8) of sufficient length to accommodate patients of varying size, thereby enabling it to adequately lend support to the patient's back, being attached to the top surface of the said rotational, patient-tilting mattress (2) and located beneath the right side of the patient's back, and at least one left back-support inflatable pillow (9) of sufficient length to accommodate patients of varying size, thereby enabling it to adequately lend support to the patient's back, being attached to the top surface of the said rotational, patient-tilting mattress (2) and located beneath the left side of the patient's back, where, in conjunction with the alternate full inflation of at least one right or left knee inflatable (6 or 7) in coordination with the alternate raising of the same longitudinal side of the said mattress (2) as the fully inflated knee inflatable (6 or 7), the gradual inflation of at least one said back-support inflatable pillow (8 or 9) located on that same longitudinal side as the fully inflated knee inflatable (6 or 7) and the same longitudinal side as the raised encased rotational mattress (2), aids in the turning process by aligning the back of the patient with the gradual turning of the bent knees (1) and the lower half of the patient's body, lending continuous support to the patient's back until turned to the other side, as all other inflatables deflate.

3. An automatic patient turning device, designed to prevent pressure sores and the accumulation of fluid in the lungs, with the capability of first laterally tilting and then safely turning from one complete side to the other, constituting a 180-degree turn, an immobile, bedridden patient in the high-risk category of developing pressure sores, lying along a generally longitudinal axis of a bed or hospital bed, comprising a right-back inflatable and a left-back inflatable and at least one right knee inflatable (6) attached to the top surface of a stationary, non-patient-tilting mattress (2), and located on the right side of the patient's bent knees (1), and at least one left knee inflatable (7) attached to the top surface of a stationary, non-patient-tilting mattress (2), and located on the left side of the patient's bent knees (1), where the said knee inflatables (6 and 7), being of sufficient length for accommodating the bent knee portion, but not the torso portion of patients of varying size when bringing the bent knees (1) to a perpendicular position relative to the mattress (2) in a horizontal position, thereby enabling the said bent knees (1), when sandwiched between the inflating knee inflatables (6 and 7), to serve as a lever arm in the turning process by alternately turning the patient from one complete side to the other when pushed, gradually moving the said bent knees (1) well beyond their perpendicular position, causing them, while resting upon at least one said deflating knee inflatable (6 or 7), to descend, pulling the entire body of the patient in the direction of the turn due to the force of gravity, with the patient lying on a flat surface at the end of the turning process, until turned to the other side.

4. The automatic patient turning device of claim 3, further comprising at least one right, pressure-exerting inflatable (10) attached to the top surface of a stationary, non-tilting mattress (2), and located adjacent to the patient-side of at least one right knee inflatable (6), and at least one left, pressure-exerting inflatable (11) attached to the top surface of a stationary, non-tilting mattress (2), and located adjacent to the patient-side of at least one left knee inflatable (7), so with the full inflation of at least one said knee inflatable (6 or 7) in a perpendicular position relative to the flat said mattress (2), serving as a stationary, vertical support surface, the gradual inflation of at least one said pressure-exerting inflatable (10 or 11) adjacent to the patient-side of the said fully inflated said knee inflatable (6 or 7), being of sufficient size for pushing the said bent knees (1) against at least one deflating said knee inflatable (6 or 7) on the opposite side of the said patient's bent knees (2) vacating space for the said bent knees (1) to move well beyond their initial perpendicular position, causing them while resting upon at least one said deflating knee inflatable (6 or 7), and aided by the force of gravity, to descend while pulling the entire body of the patient in the direction of the turn, where, at the end of the turning process, the patient lies on his or her right or left side on the flat, stationary, non-tilting mattress (2) until turned to the other side.

5. The automatic patient turning device of claim 4 wherein said back-support inflatables comprise at least one right back-support inflatable pillow (8) of sufficient length to accommodate patients of varying size, thereby enabling it to adequately lend support to the patient's back, being attached to the top surface of the said mattress (2) and located beneath the right side of the patient's back, and at least one left back-support inflatable pillow (9) of sufficient length to accommodate patients of varying size thereby enabling it to adequately lend support to the patient's back, being attached to the top surface of the said mattress (2) and located beneath the left side of the patient's back, where, in conjunction with the coordinated alternate full inflation of at least one right or left knee inflatable (6 or 7), and the alternate inflation of at least one pressure-exerting inflatable (10 or 11) adjacent to that fully inflated knee inflatable (6 or 7), the gradual inflation of at least one said back-support inflatable (8 or 9) on that same longitudinal side of the stationary, non-tilting mattress (2), aids in the turning process by aligning the back of the patient with the gradual turning of the bent knees (1) and the lower half of the patient's body, lending continuous support to the patient's back, until turned to the other side, as all other inflatables deflate.

* * * * *